US006328880B1

(12) United States Patent
Yoshita et al.

(10) Patent No.: US 6,328,880 B1
(45) **Date of Patent: *Dec. 11, 2001**

(54) PROCESS FOR HYDROTREATING HYDROCARBON OIL

(75) Inventors: Mitsuru Yoshita; Nobuyuki Ohta; Ryuichiro Iwamoto; Takao Nozaki; Satoshi Matsuda; Toshihisa Konishi, all of Sodegaura (JP)

(73) Assignee: Idemitsu Kosan Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/704,773

(22) PCT Filed: Mar. 29, 1995

(86) PCT No.: PCT/JP95/00585

§ 371 Date: Sep. 23, 1996

§ 102(e) Date: Sep. 23, 1996

(87) PCT Pub. No.: WO95/26388

PCT Pub. Date: Oct. 5, 1995

(30) Foreign Application Priority Data

| | | |
|---|---|---|
| Mar. 29, 1994 | (JP) | 6-058643 |
| May 13, 1994 | (JP) | 6-099478 |
| Jul. 20, 1994 | (JP) | 6-168118 |
| Jul. 20, 1994 | (JP) | 6-168119 |
| Aug. 24, 1994 | (JP) | 6-199433 |

(51) Int. Cl.[7] ..... C10G 45/04

(52) U.S. Cl. ..... 208/216 R; 208/213; 208/217; 208/251 R; 208/253; 208/251 H

(58) Field of Search ..... 208/213, 216 R, 208/217, 251 R, 253, 251 H

(56) References Cited

U.S. PATENT DOCUMENTS

| | | | | |
|---|---|---|---|---|
| 3,540,999 | | 11/1970 | Jacobs | 208/59 |
| 3,567,602 | | 3/1971 | Child et al. | 208/89 |
| 3,809,644 | | 5/1974 | Johnson et al. | 208/210 |
| 3,819,509 | | 6/1974 | Wolk et al. | 208/216 |
| 4,017,380 | | 4/1977 | Byler et al. | 208/89 |
| 4,017,382 | | 4/1977 | Bonnell et al. | 208/210 |
| 4,166,026 | | 8/1979 | Fukui et al. | 208/210 |
| 4,340,466 | | 7/1982 | Inooka | 208/96 |
| 4,446,008 | * | 5/1984 | Shimakawa et al. | 208/111 |
| 4,486,295 | * | 12/1984 | Inooka | 208/96 |
| 4,495,062 | * | 1/1985 | Hensley, Jr. et al. | 208/111 |
| 4,789,462 | | 12/1988 | Byrne et al. | 208/251 H |
| 5,141,737 | * | 8/1992 | Iwamoto et al. | 423/328 |
| 5,207,893 | * | 5/1993 | Iwamoto et al. | 208/211 |
| 5,316,658 | | 5/1994 | Ushio et al. | 208/216 R |
| 5,382,349 | * | 1/1995 | Yoshita et al. | 208/49 |

FOREIGN PATENT DOCUMENTS 0 199 399 10/1986 (EP) .

(List continued on next page.)

*Primary Examiner*—Nadine Preisch
(74) *Attorney, Agent, or Firm*—Oblon, Spivak, McClelland, Maier & Neustadt, P.C.

(57) ABSTRACT

Disclosed herein is a process for efficiently and stably producing high-quality kerosene and gas oil from crude oil or crude oil from which naphtha fraction is removed through the hydrotreatment of the crude oil by using a specific hydrotreatment catalyst; a process capable of prolonging the service life of the catalyst; a process capable of extending the continuous operation period of the process equipment; a process simplifying a petroleum refinery equipment; and the like. There are used, as hydrotreatment catalysts in the hydrotreatment of a hydrocarbon oil, the metals each belonging to any of the groups 6, 8, 9 and 10 of the Periodic Table which metals are supported on a carrier composed of alumina/boria, metal-containing aluminosilicate, alumina/an alkaline earth metal compound, alumina/phosphorus, alumina/titania or alumina/zirconia.

10 Claims, 7 Drawing Sheets

(1)

(2)

FOREIGN PATENT DOCUMENTS

| | | |
|---|---|---|
| 0 514 549 | 11/1992 | (EP) . |
| 2 124 252 | 2/1984 | (GB) . |
| 46-11101 | 3/1971 | (JP) . |
| 50-144702 | 11/1975 | (JP) . |
| 54-37105 | 3/1979 | (JP) . |
| 54-39404 | 3/1979 | (JP) . |
| 55-131093 | 10/1980 | (JP) . |
| 56-2118 | 1/1981 | (JP) . |
| 58-2214 | 1/1983 | (JP) . |
| 58-252 | 1/1983 | (JP) . |
| 59-25887 | 2/1984 | (JP) . |
| 59-196745 | 11/1984 | (JP) . |
| 2-194092 | 7/1990 | (JP) . |
| 4-224890 | 8/1992 | (JP) . |
| 4-224892 | 8/1992 | (JP) . |
| 5-78670 | 3/1993 | (JP) . |
| 5-93190 | 4/1993 | (JP) . |

* cited by examiner

PROCESS FOR HYDROTREATING HYDROCARBON OIL

TECHNICAL FIELD

The present invention relates to an improved process for the hydrotreatment of a hydrocarbon oil and a fuel oil composition produced thereby. More particularly, it pertains to an economically advantageous process capable of stably efficiently producing kerosene, gas oil and the like that have favorable color tone and high quality by treating a hydrocarbon oil such as crude oil, crude oil from which naphtha fraction is removed or the like through a step in which a specific catalyst is employed or the service life of a catalyst can be prolonged readily and inexpensively, a step capable of prolonging the continuous operation period of treating equipment, a step capable of simplifying the oil refining equipment, or the like step; and to a fuel oil composition such as kerosene, gas oil or the like which is obtained by this process for the hydrotreatment, is minimized in sulfur content and has favorable color tone.

BACKGROUND ART

As a process for the refining treatment of crude oil, there has heretofore been adopted the process which comprises the steps of atmospherically distillating crude oil to separate each of the fractions and thereafter desulfurizing the respective fractions thus separated. The above-mentioned process, however, is not necessarily satisfactory, since it involves the problems that a large number of refining apparatuses are required, the steps are intricate and troublesome, repeated cooling and heating of the petroleum products lower the energy efficiency and the like. In view of the above, a novel system of petroleum refining is eagerly desired.

From such viewpoint, an attempt has recently been made to collectively treat crude oil from which naphtha fraction is removed. There have been proposed, for example, (1) a process comprising the steps of distilling away naphtha fraction in crude oil; then collectively hydrodesulfurizing the residual petroleum free from naphtha fraction; and subsequently distilling the hydrodesulfurized petroleum to separate it into respective petroleum products (refer to Japanese Patent Application Laid-Open No. 294,390/1991), (2) a process comprising the steps of distilling away naphtha fraction in crude oil; then collectively hydrodesulfurizing the residual petroleum free from naphtha fraction; subsequently separating the hydrodesulfurized petroleum in a high pressure separating vessel into light fraction and heavy fraction; and then hydrorefining the light fraction thus obtained (refer to Japanese Patent Application Laid-Open No. 224,890/1992), (3) a process comprising the steps of distilling away naphtha fraction in crude oil; then collectively hydrodesulfurizing the residual petroleum free from naphtha fraction; subsequently separating the hydrodesulfurized petroleum in a high pressure separating vessel into light fraction and heavy fraction; catalytically cracking the heavy fraction thus obtained at around 500° C. in nitrogen atmosphere under around atmospheric pressure to obtain gasoline and light cracked oil (LCO); and then hydrorefining the LCO thus obtained and the light fraction which has been separated under high pressure (refer to Japanese Patent Application Laid-Open No. 224,892/1992), (4) a process comprising the steps of subjecting crude oil to collective treatment and atmospheric distillation; then subjecting the residual oil thus obtained to fluidized catalytic cracking or hydrocracking; and adjusting the product yields (refer to U.S. Pat. No. 3,617,501), (5) a process in which proper operating conditions having high economical efficiency are provided in a collective hydrotreatment of crude oil highly liable to metallic contamination by means of a moving-bed type reactor capable of continuously replacing a catalyst, in particular, a process in which continuous operation period of the production process is prolonged as compared with conventional processes and at the same time, the content of nitrogen, a metal or asphaltene in the residual oil is decreased by the combination of contaminant removal using the first-stage countercurrent moving-bed type reactor and hydroreforming using the second-stage fixed-bed type reactor, and the like processes.

However, with regard to the above-mentioned process (1), the use of a conventional desulfurization catalyst makes it impossible to produce kerosene and gas oil fractions that are stabilized in quality, and besides to exhibit satisfactory effect on the increased production of clear oils. Specifically, in the case where a conventional fixed-bed type reactor is used in the process (1), the continuous operation period of the production process is not satisfactory, and besides the product properties of each fraction, for example, nitrogen contents and color tones of kerosene and gas oil, the smoke point of kerosene, or the content of nitrogen, a metal or asphalten in the residual oil have been inferior to the properties of the products obtained by a conventional refining process. With respect to the aforestated process (2), although the properties of the kerosene and gas oil are improved, the smoke point of the kerosene is not fully satisfactory depending on the purpose of use, the usable crude oil is limited depending upon the demand constitution, and besides there is caused such a problem that the treating equipment is complicated because of the practice of desulfurizing treatment, followed by the hydrorefining, thereby inevitably increasing the equipment cost and running cost. As to the above-mentioned process (3), the production of gasoline is increased along with the production of LCO having the boiling point range corresponding to that of kerosene and gas oil, but the LCO thus obtained is extremely high in aromaticity and is remarkably low in the smoke point of the kerosene fraction and in the cetane value of the gas oil fraction. In order to achieve satisfactory smoke point or cetane value by hydrogenating such LCO, it is necessary to provide a high temperature and pressure unit withstanding a high degree of severeness and also to reboost the LCO up to the reaction pressure. Accordingly there has not yet been attained economical efficiency satisfactory in both fixed cost and variable cost. In regard to the process (4), the intermediate fraction obtained by fluidized catalytic cracking is extremely poor in its quality, including for example, the hue of gas oil or kerosene, the smoke point of kerosene, the cetane index of gas oil, etc. On the other hand, it is imperative in the hydrocracking, that the temperature and pressure which have once been lowered in the atmospheric distillation should be raised again to a high temperature and pressure, that is, to 300 to 450° C. and 100 to 200 kg/cm$^2$, and therefore, this process itself is not necessarily satisfactory from the viewpoints of energy efficiency and economical efficiency. Regarding the above-described process (5), although the residual oil is improved in its quality by carrying out collective desulfurizing treatment of crude oil or crude oil from which naphtha fraction is removed, by the use of a conventional desulfurization catalyst, there is caused such a problem that the kerosene and gas oil components are unsatisfactory in the quality, for example, smoke point and hue stability. Thus it has been clarified that the single use of the moving-bed type reactor is devoid of practicability for the collective treatment. Moreover, since the moving-bed type reactor must be applied to crude oil highly contaminated with metals (for example, not less than 150 ppm), that is, a heavy fraction from the economical point of view, there is a problem that the usable crude oil is restricted.

The actual circumstance at the present time of the conventional collective treatment process for crude oil from which naphtha fraction is removed is that the above process is not yet brought to practical application owing to the difficulty in producing kerosene and gas oil fractions stabilized in qualities, insufficiency in continuous operation period of the production process and expensiveness in equipment cost and running cost.

On the other hand, the hydrogenating treatment of heavy hydrocarbon oil containing asphaltene (heptane-insoluble matter), sulfur, metallic components and the like has involved the problem that the catalyst markedly deteriorates by the accumulation of metallic components, carbonaceous deposits on the catalyst during the course of the treatment. As a process for prolonging the service life of the catalyst, there are proposed, for example, (6) a process comprising the steps of passing crude oil through one of preliminary reactors that are installed in parallel on the upstream side of a principal reactor and, after the deterioration of the catalyst, passing crude oil through the other preliminary reactor to maintain the catalyst activity (refer to Japanese Patent Publication No. 6163/1974); (7) a process comprising the steps of passing crude oil through a reactor which is divided into the former stage packed inside with a demetallization catalyst and the latter stage packed inside with a desulfurization catalyst, and, after the deterioration of the catalytic performance, withdrawing the catalyst in the former stage to replace it with a fresh catalyst, subsequently replacing the desulfurization catalyst in the latter stage with demetallization catalyst, replacing the demetallization catalyst in the former stage with desulfurization catalyst, and reversing the order of oil passage to prolong the service life of active catalyst (refer to U.S. Pat. No. 3,985,643); and the like processes.

Nevertheless the aforesaid process (6) involves the problem that the use of a plurality of preliminary reactors complicates the process equipment, thus increasing the equipment cost and running cost. The process (7) causes the problem that the replacement of the catalyst increases the catalysts costs and forces the discontinuance of operation during the course of the treatment. The actual situation at the present time is that a satisfactory process capable of readily inexpensively prolonging the service life of the catalyst has not yet been achieved.

Aside from the foregoing, environmental destruction on global scale is presently becoming a problem. In particular, NOx which is formed accompanying the combustion of a fossil fuel and turns to acid rain destroys forest, and besides particulate NOx exerts evil influence on human body when being inhaled. The exhaust gas from a diesel engine which is the source of generating and migrating NOx and particulate thereof, must be treated with a post-treatment unit and a catalyst. Since the sulfur in gas oil causes the catalyst to be poisoned and deteriorated therewith and limits the service life of the catalyst, it is necessary to reduce the content of sulfur in gas oil in order to stably maintain the sufficient treatment performance of the catalyst for a long period of time. The upper limit of sulfur content in gas oil is aimed at 0.05% by weight worldwide by the presently reinforced regulation of sulfur content. It is hoped, however, to further reduce sulfur content in future, and there is a possibility that the regulation be further strengthened to restrict the sulfur content finally as low as 0.03% by weight. On the other hand, even if the sulfur content reduction is realized, it is important to maintain the practical quality inherent in gas oil and therefore it is sought to actualize a low sulfur gas-oil maintaining the practical performance thereof.

Numerous techniques have already been developed for the hydrodesulfurization of a hydrocarbon oil. The sulfur content reduction can be achieved usually by raising the desulfurization temperature from the technical viewpoint, but it is well known that the gas oil thus obtained is rapidly deteriorated in hue. For the purpose of improving the hue thus deteriorated, there are proposed a two-stage hydrogenating treatment process (refer to Japanese Patent Application Laid-Open No. 78/670/1993), the use of a catalyst comprising a noble metal and the like. The aforesaid proposals, however, involve the problems that the treatment unit is complicated or the catalyst is unreasonably expensive. It is thought that the substances causing coloration and deteriorating the hue are exemplified by polycyclic aromatic compounds having at least three rings such as benzanthracene, perylene, benzofluoranthene and benzopyrene. These substances don't originally exist in crude oil, but is formed by desulfurization reaction at an elevated temperature. On the contrary, high temperature reaction is required for the purpose of realizing low sulfur content, and thus it is difficult to allow sulfur content reduction through the desulfurization reaction at a high temperature to be consistent with the prevention of forming the substances causing coloration.

DISCLOSURE OF THE INVENTION

Under such circumstances, it is a general object of the present invention to provide an economically advantageous process for treating a hydrocarbon oil which is capable of stably and efficiently producing kerosene, gas oil and the like that have favorable color tone and high quality through a collective hydrodesulfurizing treatment of a hydrocarbon oil such as crude oil and crude oil from which naphtha fraction is removed; and at the same time, a fuel oil composition such as kerosene and gas oil which is obtained by the present process and which is minimized in sulfur content and has favorable color tone and high quality.

As a result of intensive research and investigation accumulated by the present inventors for the purpose of achieving the above-mentioned object, there have been found that, in the case of hydrotreating crude oil or crude oil from which naphtha fraction is removed, (1) the above-mentioned object can be achieved by the use of a specific metal supported on a specific carrier as a catalyst; (2) the service life of catalyst as a whole can be prolonged by reversing the flow direction of a feed oil against a catalyst bed upon the elapse of a prescribed time after the time at which the catalyst is deteriorated to some extent, paying attention to that the deterioration mechanism of catalyst bed is different in each of the deterioration stages; (3) high-quality kerosene and gas oil can stably and efficiently be produced and it is made possible to prolong continuous operational period of a process plant and to simplify petroleum refining equipment, by a hydrotreatment process for hydrodesulfurizing crude oil or crude oil from which naphtha fraction is removed in the presence of a catalyst and then distilling the desulfurized oil to separate into each fraction which process comprises using a moving-bed type hydrorefining unit in the former stage of the process, using fixed-bed type hydrotreatment unit in the latter stage thereof, and employing a catalyst enhanced in hydrogenation performance in the fixed-bed type hydrogenating treatment unit in the latter stage; (4) it is made possible to produce intermediate fractions having high degree of saturation, enhance the yield thereof and improving the quality thereof, by a hydrogenation treatment process for hydrodesulfurizing crude oil or crude oil from which naphtha fraction is removed in the presence of a catalyst and then atmospherically distilling the desulfurized oil to separate into each fraction which process comprises combining a hydroreforming treatment with the latter stage of the above-mentioned atmospheric distillation; (5) it is made possible to produce intermediate fractions having high degree of saturation, enhance the yield thereof and improving the quality thereof, by a collective hydrodesulfurization process for crude oil or crude oil from which naphtha fraction is removed which process comprises separating the feed oil into gaseous components and liquid hydrocarbon components in a high pressure gas-liquid separator placed in the former stage of atmospheric distillation, thereafter hydroforming the intermediate fractions in the form of gas, and hydrodesulfurizing the heavy fractions in the form of liquid; (6) it is made possible to produce intermediate fractions having high degree of saturation, enhance the yield thereof and improving the quality thereof, by a hydrogenation treatment process for hydrodesulfurizing crude oil or crude oil from which naphtha fraction is removed in the presence of a catalyst and then distilling the hydrodesulfurized oil to separate into each fraction which process comprises subsequent to a collective hydrotreatment process, separating the feed oil into gaseous components and liquid hydrocarbon components in a high pressure gas-liquid separator, and thereafter bringing the liquid hydrocarbon components into contact with a catalyst to proceed with hydrocracking treatment; and (7) a coloring substance contained in a fuel oil composition has a characteristic absorption at 440 nm in a visible spectrum, the coloring substance is extracted with N,N-dimethylformamide, and the transmission factor at 440 nm of the visible spectrum of the extract with N,N-dimethylformamide, which lowers as the hue of the composition is worsened, enables the determination of the coloring substance.

The present invention has been accomplished on the basis of the above-mentioned finding and information.

Specifically, the present invention provides the following eight aspects of the invention including:

(1) a process for hydrotreating a hydrocarbon oil which comprises hydrotreating crude oil or crude oil from which naphtha fraction is removed, in the presence of a catalyst comprising (A) at least one metal selected from the group consisting of the metals each belonging to any of the groups 6, 8, 9 and 10 of the Periodic Table, said metal being supported on at least one carrier selected from the group consisting of alumina/boria carrier, a carrier containing metal-containing aluminosilicate, alumina/phosphorus carrier, alumina/alkaline earth metal compound carrier, alumina/titania carrier and alumina/zirconia carrier (hereinafter referred to as the first aspect of the invention);

(2) a process for hydrotreating a hydrocarbon oil which comprises hydrotreating crude oil or crude oil from which naphtha fraction is removed in the presence of said catalyst (A) in combination with (B) a demetallization catalyst (hereinafter referred to as the second aspect of the invention);

(3) a process for hydrotreating a hydrocarbon oil which comprises hydrotreating a hydrocarbon oil containing at least one from among asphaltene, sulfur and a metal component in the presence of a catalyst by reversing the flow direction of the hydrocarbon oil against the catalyst according to the extent of the deterioration of the catalyst performance after the elapse of a prescribed treatment time (hereinafter referred to as the third aspect of the invention);

(4) a process for hydrotreating a hydrocarbon oil which comprises hydrotreating crude oil or crude oil from which naphtha fraction is removed, said crude oil containing at most 135 ppm by weight of at least one metallic component selected from the group consisting of vanadium, nickel and iron and at most 12% by weight of asphalten through the consecutive steps of ① bringing the hydrocarbon oil into contact with a catalyst in a moving-bed type hydrorefining unit under a pressure of 21.8 to 200 kg/cm$^2$, at a temperature of 315 to 450° C., at a liquid hourly space velocity (LHSV) of 0.5 to 2.5 hr$^{-1}$ at a hydrogen/oil ratio of 50 to 500 Nm$^3$/kiloliter (KL) to proceed with hydrotreatment; thereafter ② carrying out hydrotreatment in a fixed-bed type hydrotreating unit packed inside with a hydrotreatment catalyst under a pressure of 30 to 200 kg/cm$^2$, at a temperature of 300 to 450° C., at an LHSV of 0.1 to 3.0 hr$^{-1}$ at a hydrogen/oil ratio of 300 to 2000 Nm$^3$/KL; and further ③ carrying out distillation to produce hydrocarbon oil fractions having different boiling range from each other (hereinafter referred to as the fourth aspect of the invention);

(5) a process for hydrotreating a hydrocarbon oil which comprises the steps of hydrodesulfurizing crude oil or crude oil from which naphtha fraction is removed as the feed oil in the presence of hydrogen by bringing the feed oil into contact with a catalyst; atmospherically distilling the resulting hydrotreated oil to separate it into naphtha fraction, kerosene fraction, gas oil fraction and heavy oil fraction; and hydrotreating at least one fraction from the kerosene fraction and the gas oil fraction thus separated by bringing the at least one fraction into contact with a hydrogenation catalyst (hereinafter referred to as the fifth aspect of the invention);

(6) a process for hydrotreating a hydrocarbon oil which comprises the steps of demetallizing crude oil or crude oil from which naphtha fraction is removed as the feed oil by bringing the feed oil into contact with a demetallization catalyst; separating the effluent from the demetallizing step in a high pressure gas-liquid separating vessel into gaseous components and liquid hydrocarbon components; subsequently hydrorefining the resultant gaseous components by bringing them into contact with a hydrorefining catalyst; hydrodesulfurizing the resultant liquid hydrocarbon components by bringing them into contact with a hydrodesulfurization catalyst; combining said hydrorefined gaseous components and said hydrodesulfurized liquid hydrocarbon components into a combination; and atmospherically distilling the resulting combination to produce hydrocarbon fractions different in a boiling range from each other (hereinafter referred to as the sixth aspect of the invention);

(7) a process for hydrotreating a hydrocarbon oil which comprises the steps of hydrodesulfurizing crude oil or crude oil from which naphtha fraction is removed as the feed oil in the presence of hydrogen by bringing the feed oil into contact with a catalyst; separating the effluent therefrom in a high pressure gas-liquid separating vessel 1 into gaseous components 1 and liquid hydrocarbon components 1; hydrocracking the resultant liquid hydrocarbon components 1 in the presence of hydrogen by bringing them into contact with a catalyst; subsequently combining said gaseous components 1 and the effluent from the hydrocracking step into a combination; and atmospherically distilling the resulting combination to produce hydrocarbon fractions different in a boiling range from each other (hereinafter referred to as the seventh aspect of the invention); and (8) a fuel oil composition which comprises a hydrocarbon oil that has a boiling point range at atmospheric pressure of 215 to 380° C., a sulfur content of at most 0.03% by weight, the ASTM color of at most 0.8, a content of bicyclic aromatic compounds of at most 5% by volume and a content of tricyclic aromatic compounds of at most 0.5% by volume, and shows at least 30% in the transmission factor at 440 nm of the visible spectrum of the extract therefrom into N,N-dimethylformamide (hereinafter referred to as the eighth aspect of the invention).

THE MOST PREFERRED EMBODIMENT TO CARRY OUT THE INVENTION

Figure 1:
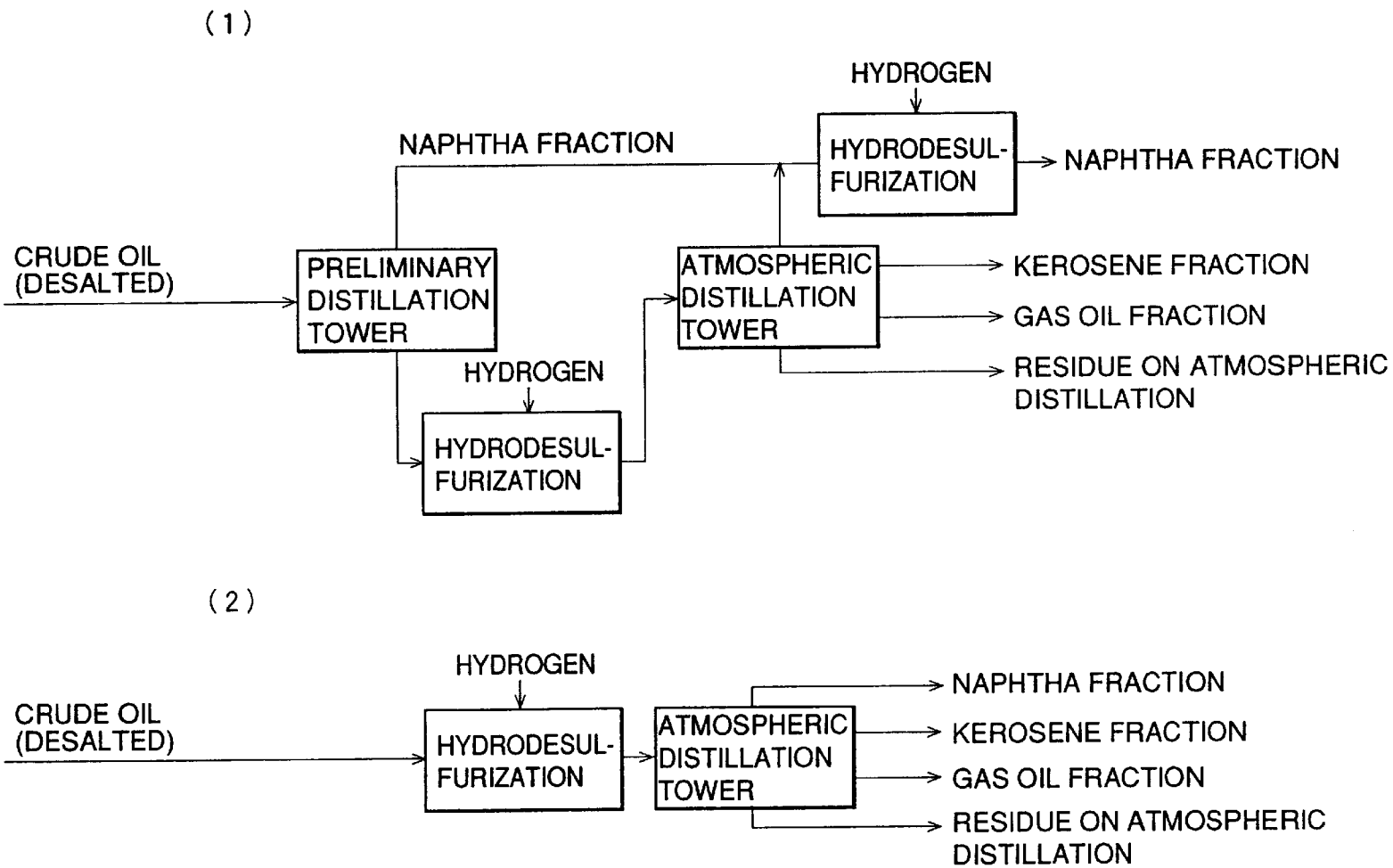
FIG. 1 is a schematic block flow diagram showing an example for the separation of crude oil into various petroleum products, including a hydrotreating step for a hydrocarbon oil in the first and second aspects of the invention.

With respect to the first aspect of the invention, at the time of hydrotreating crude oil or crude oil from which naphtha fraction is removed, there is employed a catalyst comprising (A) at least one metal selected from the group consisting of the metals each belonging to any of the groups 6, 8, 9 and 10 of the Periodic Table, said metal being supported on at least one carrier selected from the group consisting of alumina/boria carrier, a carrier containing metal-containing aluminosilicate, alumina/phosphorous carrier, alumina/alkaline earth metal compound carrier, alumina/titania carrier and alumina/zirconia carrier; and in the second aspect of the invention there is employed, as a catalyst, the combination of the catalyst (A) and (B) a demetallization catalyst.

The preferable metals in the above-mentioned catalyst (A) to be supported on any of the various carriers, include tungsten and molybdenum as a metal belonging to the group 6 of the Periodic Table, and nickel and cobalt as a metal belonging to any of the groups 8, 9 and 10 of the same. The metal belonging to the group 6 and the metal belonging to any of the groups 8, 9 and 10 may each be used alone or in combination with at least one other. In particular, examples of preferable combination include Ni—Mo, Co—Mo, Ni—W and Ni—Co—Mo because of their high hydrogenation activity and limited deterioration.

The amount of any of the aforesaid metals to be supported on the carrier is not specifically limited, but may be selected according to various conditions. The amount thereof is usually in the range of 1 to 35% by weight expressed in terms of the oxide thereof based on the whole amount of the catalyst in the case where the carrier is any of alumina/boria, alumina/phosphorus, alumina/alkali earth metal compound, alumina/titania and alumina/zirconia. An amount thereof less than 1% by weight results in failure to sufficiently exert the working effect as a hydrogenation catalyst, whereas that more than 35% by weight leads to economical disadvantage in that the enhancement of the hydrogenation activity is not remarkable in consideration of the amount supported. The amount thereof is particularly preferably in the range of 5 to 30% by weight from the viewpoints of hydrogenation activity as well as economical efficiency.

On the other hand, in the case where the carrier is metal-containing aluminosilicate, the amount of the metal to be supported on the carrier is usually in the range of 1 to 44% by weight expressed in terms of the oxide thereof based on the whole amount of the catalyst. An amount thereof less than 1% by weight results in failure to sufficiently exert the working effect as a hydrogenation catalyst, whereas that more than 44% by weight leads to economical disadvantage in that the enhancement of the hydrogenation activity is not remarkable in consideration of the amount supported. The amount thereof is particularly preferably in the range of 10 to 28% by weight from the viewpoints of hydrogenation activity as well as economical efficiency.

In the following some description will be given of various carriers to be used for the above-mentioned catalyst (A). Regarding the alumina/boria carrier, it is preferable that boria (oxide of boron) be contained in a proportion of 3 to 20% by weight based on the whole amount of the alumina/boria carrier. A content of boria less than 3% by weight results in limited working effect on the enhancement of hydrogenation activity, whereas that more than 20% by weight is unfavorable, since the enhancement of the hydrogenation activity is not sufficiently manifested in consideration of the large amount used, thus making the usage uneconomical, and besides the desulfurization activity is liable to be lowered. The content thereof is particularly preferably in the range of 5 to 15% by weight from the standpoint of the working effect on the enhancement of hydrogenation activity.

In addition, it is preferable in the foregoing alumina/boria carrier that the boron atom dispersibility be not less than 85% of the theoretical dispersibility. The boron atom dispersibility in the carrier is measured by means of X-ray photoelectron spectroscopy (hereinafter abbreviated to "XPS") and is derived from the theoretical formula of monolayer dispersion. The XPS is a procedure of quantitative and qualitative analysis for atoms present in the region from the surface of a solid to a depth of 10 to 30 Å, approx. therefrom. This procedure, when applied to the determination of boron atoms that are dispersedly supported on alumina carrier to express the result by the ratio of B peak intensity to Al peak intensity, greatly reflects the dispersion state of the boron atoms by reason of the procedure being surface sensitive. Accordingly, even if the boron content in the carrier is constant, the XPS intensity ratio varies depending upon whether the boron is highly dispersed on alumina or it is present in the state of bulk. The XPS intensity ratio is high when the boron atoms are in highly dispersed state, while it is low when the boron atoms are poorly dispersed, thus allowing bulk boria to be present. Thus, the evaluation of boron dispersibility is to estimate the amount of Al—O—B bond which is formed on alumina, and besides, to determine the amount of acid developed there. The acidity of a solid is a factor of importance which is directly concerned with hydrocracking characteristics and denitrification activity, and thus the boron dispersibility is closely correlated with the hydrocracking characteristics.

It is made possible from the foregoing reason to specify the state of boria dispersed on the alumina/boria carrier and determine the dispersion range wherein the boria added to the carrier functions most effectively, by the use of the surface analysis technique called XPS.

Next, some description will be given of a specific method of evaluating the boron dispersibility. When a measurement is made of the XPS of boria ($B_2O_3$) supported on the surface of the carrier ($Al_2O_3$), the XPS intensity ratio can be found as follows from the theoretical formula (1) derived by Moulijn et al. ["Journal of Physical Chemistry" (J. Phys. Chem), vol. 83, 1979, pp. 1612 to 1619]

$$\left(\frac{I_B}{I_{Al}}\right)_{theoret.} = \left(\frac{B}{Al}\right)_{atom} \times \frac{\sigma_{(B)}\beta_1\{1+\exp(-\beta_2)\}}{2\sigma_{(Al)}\{1-\exp(-\beta_2)\}} \times \frac{D(\varepsilon_B)}{D(\varepsilon_{Al})} \quad (1)$$

wherein $(I_B/I_{Al})_{theoret.}$ is the XPS peak intensity ratio of B to Al which can be theoretically evaluated; $(B/Al)_{atom}$ is the atomic ratio of B to Al, $\sigma_{(Al)}$ is the cross-sectional area of ionized $Al_{2S}$ electrons; $\sigma_{(B)}$ is the cross-sectional area of ionized $B_{1s}$ electrons; $\beta_1$ and $\beta_2$ are found from the following respective formulae $$\beta_1 = 2/(\lambda_{(Al)}\rho So)$$

$$\beta_2 = 2/(\lambda_{(B)}\rho So)$$

wherein $\lambda_{(Al)}$ is the escaping depth of $Al_{2S}$ electrons, $\lambda_{(B)}$ is the escaping depth of $B_{1s}$ electrons, $\rho$ is the density of alumina, and So is the specific surface area of alumina; and $D(\epsilon_{Al})$ and $D(\epsilon_B)$ are the efficiencies of detectors ($D\ 1/\epsilon$) for $Al_{2s}$ and $B_{ls}$, respectively.

The values of $\lambda(Al_{2S})$ and $\lambda(B_{1s})$ are 18.2 Å and 18.8 Å, respectively, which are derived by the use of Penn's formula ["Journal of Electron Spectroscopy and Related Phenomena" vol. 9, 1976, pp. 29 to 40]. The values of $\sigma(Al_{2S})$ and $\sigma(B_{1s})$ are 0.753 and 0.486, respectively, which are found in the literature by Scofield ["Journal of Electron Spectroscopy and Related Phenomena" vol. 8, 1976, pp. 129 to 137] using AlKα ray as the origin of excitation. The ratio by weight of boria to alumina, when expressed by $(B_2O_3/Al_2O_3)_{wt}$ gives $(B/Al)_{atom}=1.465\ (B_2O_3/Al_2O_3)_{wt}$. Then, substitution of the above-obtained values $\lambda(Al_{2S})$, $\lambda(B_{ls})$, $\sigma(Al_{2S})$, $\sigma(B_{1s})$ and $(B/Al)_{atom}$ using $Al_{2S}$ and $B_{1s}$ as XPS peaks of Al and B, respectively into the foregoing formula (1), give the formula (2)

$$\left(\frac{I_B}{I_{Al}}\right)_{theoret.} = \left(\frac{B_2O_3}{Al_2O_3}\right)_{wt} \times \frac{5.487\times10^8\{1+\exp(-1.064\times10^9/\rho So)\}}{\rho So\{1-\exp(-1.064\times10^9/\rho So)\}} \quad (2)$$

In the formula (2), $(I_B/I_{Al})_{theoret.}$ is the XPS peak intensity ratio of B to Al which can be theoretically evaluated. The symbol So in the formula (2) indicating the specific surface area of alumina can not be specified, since there is adopted a method in which alumina or a precursor thereof is kneaded with a boron compound as the preparation method in the present invention. Such being the case, the specific surface area of the alumina/boria carrier $S_{Al\text{-}B}$ shall be used in place of So in the present invention. Therefore, the theoretical value for boron dispersibility can be found as follows from the theoretical formula (3)

$$\left(\frac{I_B}{I_{Al}}\right)_{theoret.} = \left(\frac{B_2O_3}{Al_2O_3}\right)_{wt.} \times \frac{5.487\times10^8\{1+\exp(-1.064\times10^9/\rho S_{Al-B})\}}{\rho S_{Al-B}\{1-\exp(-1.064\times10^9/\rho S_{Al-B})\}} \quad (3)$$

That is to say in the present invention, the formula (3) is employed to calculate the theoretical $I_B/I_{Al}$ value in the case where the boron is supported as a monolayer on the surface of the alumina and thus the theoretical $I_B/I_{Al}$ value is the theoretical value of dispersibility. In the formula (3), the units of $\rho$ and $S_{Al\text{-}B}$ are $g/m^3$ and $m^2/g$, respectively. The dispersibility of boron atoms is found $I_B/I_{Al}$ value, that is, is the observed XPS peak intensity ratio of B to Al.

It is desirable in the above-mentioned alumina/boria carrier that the boron atom dispersibility observed in the above way be not less than 85% of the theoretical dispersibility. A boron atom dispersibility less than 85% of the theoretical value involves a fear of causing such disadvantage that the manifestation of an acid point is made insufficient and a high hydrocracking activity or denitrification activity can't be expected.

The above-mentioned alumina/boria can be prepared, for example, by a process which comprises the steps of adding, in a prescribed proportion, a boron compound to alumina or a precursor thereof having a moisture content of not less than 65% by weight; kneading with heating the resultant mixture at a temperature of around 60 to 100° C. for at least one, preferably at least 1.5 hour; and thereafter carrying out molding, drying and firing by a publicly known method. Kneading with heating for shorter than one hour involves a fear of causing insufficient kneading and poor dispersion state of boron atoms. A kneading temperature departing from the above-prescribed range unfavorably results in failure to highly disperse boria. The addition of the aforesaid boron compound may be carried out, according to the necessity, in a state of solution in which the compound is dissolved in water with heating.

An alumina precursor is not specifically limited provided that it is made into alumina by firing. It is exemplified by aluminum hydroxide and alumina hydrates such as pseudo-boehmite, boehmite, bayerite and gibbsite. The aforesaid alumina or a precursor thereof is preferably used in a moisture content of not lower than 65% by weight. A moisture content therein lower than 65% by weight involves a fear of insufficiency in the dispersion of the boron compound thus added.

There are usable various boron compounds in addition to boron oxide provided that the compounds are each convertible into boron oxide by firing. Examples thereof include boric acid, ammonium borate, sodium borate, sodium perborate, orthoboric acid, tetraboric acid, boron pentasulfide, boron trichloride, ammonium perborate, calcium borate, diborane, magnesium borate, methyl borate, butyl borate and tricyclohexyl borate.

The carrier containing metal-containing aluminosilicate is composed preferably of 10 to 90% by weight of metal-containing aluminosilicate and 90 to 10% by weight of an inorganic oxide. A content of the metal-containing aluminosilicate in the carrier lower than 10% by weight results in failure to sufficiently exhibit the working effect as a hydrogenation catalyst, whereas that higher than 90% by weight lead to economical disadvantage in that the enhancement of the hydrogenation activity is not remarkable in consideration of the amount supported. The aforestated carrier is composed particularly preferably of 30 to 70% by weight of metal-containing aluminosilicate and 70 to 30% by weight of an inorganic oxide from the viewpoints of hydrogenation activity as well as economical efficiency.

The inorganic oxide to be used in the foregoing carrier containing metal-containing aluminosilicate is exemplified by alumina such as boehmite gel and alumina sol, silica such as silica sol and porous matter such as silica/alumina.

On the other hand, the metal-containing aluminosilicate used in said carrier is preferably iron-containing aluminosilicate whose principal chemical composition in the form of oxide is represented by the general formula (4).

$$a\mathrm{Fe_2O_3}.\mathrm{Al_2O_3}.b\mathrm{SiO_2}.n\mathrm{H_2O} \quad (4)$$

wherein n is a real number from 0 to 30, b satisfies $15<b<100$, preferably $18<b<40$. and a and b satisfy $0.005<a/b<0.15$, preferably $0.02<a/b<0.05$. In addition, the iron-containing aluminosilicate may contain small amounts of an alkali metal oxide such as $Na_2O$ and an alkaline earth metal oxide.

In general, there exist various forms of iron compounds in iron-containing aluminosilicate including ① an inert iron compound which is merely physically adsorbed onto the aluminosilicate, and is reduced in single step ($Fe^{3+}\rightarrow Fe^0$) at 500° C. or lower in an atmosphere of hydrogen; and ② an iron compound regularly interacting with aluminosilicate skeleton which compound is exemplified by a variety of forms of iron compounds such as ion exchange iron compounds and iron compounds constituting aluminosilicate skeleton. In an atmosphere of hydrogen, the iron compound is reduced in two steps from $Fe^{3+}$ to $Fe^{2+}$ at the lower temperature portion (room temperature to 700° C.), and from $Fe^{2+}$ to $Fe^0$ at the higher temperature portion (700 to 1200° C.).

The iron compound ① can be disriminated by the content of inert iron compounds $[Fe]_{dep.}$ which is calculated by the measurement of temperature raising program reduction (TPR), while the iron compound ② can be discriminated by the reduction peak at the higher temperature portion also through TRR measurement.

It is preferable in the iron-containing aluminosilicate to be used in the carrier that the $[Fe]_{dep}$ which is calculated by the above-mentioned TPR measurement be at most 35%, and further at most 30%. Moreover, at least one reduction peak temperature at the higher temperature portion Th is preferably in the following range.

$$700°\ \mathrm{C.} \leqq Th \leqq (-300\times UD+8320)°\ \mathrm{C.},$$

more preferably $$850°\ \mathrm{C.} \leqq Th \leqq (-300\times UD+8320)°\ \mathrm{C.}$$

wherein UD is the lattice constant (Å) of the iron-containing aluminosilicate. The TPR measurement is performed by measuring the hydrogen consumption at the time of heating a sample to raise the temperature thereof in a stream of hydrogen. The state of the metal in the sample can easily be grasped by the behavior of the metal oxide due to reduction by hydrogen.

There are observed a reduction peak at the lower temperature portion and a reduction peak at the higher temperature portion in the reduction peaks through TRP measurement that are observed in the iron-containing aluminosilicate. As the reduction peak at the lower temperature portion, the peak at the time when $Fe^{3+}$ is reduced into $Fe^{2+}$ is observed in the range of room temperature to 700° C. As the reduction peak at the higher temperature portion, the peak at the time when $Fe^{2+}$ is reduced into $Fe^0$ is observed in the range of 700° C. to (−300×UD+8320)° C. In general, the reduction peak at the higher temperature portion tends to shift to low temperature side with heightening activity of the iron-containing aluminosilicate, and tends to shift to high temperature side with decreasing lattice constant of zeolite. When there are two or more reduction peaks at the higher temperature portion, at least one of said peaks is observed in the temperature range of 700° C. to (−300×UD+8320)° C.

With regard to the Fe species contained in the iron-containing aluminosilicate, the ratio of the reduction peak area at the higher temperature portion (higher temperature peak area, Sh) which corresponds to hydrogen consumption at the higher temperature portion to the reduction peak area at the lower temperature portion (lower temperature peak area, Sl) which corresponds to hydrogen consumption at the lower temperature portion (Sh/Sl) must ideally be 2 when calculated from the valency to be reduced. However, the existence of an inert iron compound (impurity) decreases the aforesaid ratio to less than 2 because of the peak present only at the lower temperature portion. Accordingly, the content of inert iron compounds $[Fe]_{dep.}$ can be defined by the formula $$[Fe]_{dep.}=(Sl-Sh/2)/St\times 100\%$$

wherein St is the total sum of the peak area. When the content of inert iron compounds is evaluated by the formula, the content of the iron-containing aluminosilicate is preferably at most 35%, more preferably at most 30%. A variety of such aluminosilicate are applicable insofar as various conditions mentioned above are satisfied. From the viewpoint of enhancing the hydrogenation activity of the catalyst, the zeolite of faujasite type or Y type, that is, crystalline aluminosilicate is preferable, among which that having a lattice constant of 24.15 to 24.40, especially 24.20 to 24.37 is most preferable.

In the production of the above-mentioned iron-containing aluminosilicate, the zeolite of faujasite type having a molar ratio of silica to alumina-$SiO_2/Al_2O_3$ of not less 3.5 is preferably used. A $SiO_2/Al_2O_3$ molar ratio less than 3.5 brings about insufficient heat resistance and tends to destroy the crystallizability. In particular, from the standpoint of preserving its heat resistance and crystallizability, the zeolite of faujasite type having a $SiO_2/Al_2O_3$ molar ratio of not less than 4.6 is more preferable. Such aluminosilicate may contain $Na_2O$ in an amount of about 2.4% or less by weight, preferably 1.8% or less by weight.

The production of the foregoing iron-containing aluminosilicate is performed usually by the following process.

First of all, the aluminosilicate as the starting raw material is subjected to steaming treatment to form steamed aluminosilicate. The conditions of steaming treatment is suitably selected according to various circumstances, and it is preferable in general to treat it in the presence of steam at a temperature of 540 to 810° C. The steam may be used in flow system or the aluminosilioate as the starting raw material is held and heated in an enclosed vessel to proceed with self-steaming by means of the moisture contained therein.

Subsequently the steamed aluminosilicate obtained by the steaming treatment is treated with a mineral acid. There are available a wide variety of mineral acids, that are exemplified by hydrochloric acid, nitric acid, sulfuric acid, etc. as general ones, and in addition thereto, phosphoric acid, perchloric acid, etc. as usable ones.

Then, an iron salt is added to the reaction system to proceed with iron salt treatment. In this case, the iron salt may be added immediately after the addition of a mineral acid to proceed with the treatment, or after a mineral acid is added, followed by sufficient stirring. Alternatively, a prescribed amount of a mineral acid is added and thereafter the balance thereof and the iron salt may be simultaneously added to the reaction system. At any rate, it is necessary to add an iron salt to the reaction system in which the steamed aluminosilicate is incorporated with a mineral acid, in other words, to add an iron salt in the presence of a mineral acid.

The treatment conditions under which the steamed aluminosilicate is treated after the addition of a mineral acid and further an iron salt vary depending upon various situations, and can not unequivocally be determined, but may be optionally selected from the usual conditions including a treatment temperature of 5 to 100° C., preferably 50 to 90° C., a treatment time of 0.1 to 24 hours, preferably 0.5 to 5 hours and a treatment pH of 0.5 to 2.5, preferably 1.4 to 2.1. A pH of the treating liquid higher than 2.5 brings about the disadvantage that polymerized iron colloid is formed, whereas that lower than 0.5 causes a fear of destroying the crystallizability of zeolite (aluminosilicate). The amount of mineral acid to be added to the system is about 5 to 20 moles per 1 kg of aluminosilicate. The concentration of the mineral acid is usually 0.5 to 50% by weight, preferably 1 to 20% by weight in a solution. As mentioned hereinbefore, the time of adding a mineral acid is prior to the addition of an iron compound. The temperature of the mineral acid at the time of adding may be selected in the above-mentioned range, and is preferably from room temperature to 100° C., particularly preferably from 50 to 100° C.

The iron salt to be added is not specifically limited in the kind, but is usually exemplified by ferrous chloride, ferric chloride, ferrous nitrate, ferric nitrate, ferrous sulphate and ferric sulphate. The iron salt may be added as it is, but is preferably added in the form of a solution. The solvent for the salt needs only be capable of dissolving the iron salt, and is preferably selected from water, alcohols, ethers and ketones. The concentration of the iron salt is usually 0.02 to 10.0 M, preferably 0.05 to 5.0 M. The time of adding the iron salt should be after the pH of the aluminosilicate slurry is made to 1 to 2 by the addition of the aforesaid mineral acid. The temperature of the iron salt at the time of adding is preferably from room temperature to 100° C., particularly preferably from 50 to 100° C. It is effective to preheat the iron salt prior to its adding.

In adding the mineral acid and iron salt to aluminosilicate to treat the same, the slurry ratio, that is, the ratio of the volume of the treating solution (liter: L) to the weight of aluminosilicate (kg) is preferably in the range of 1 to 50, more preferably 5 to 30.

The iron-containing aluminosilicate having the aforestated properties is obtained by the consecutive or simultaneous treatment with the mineral acid and iron salt. On the other hand, when the aluminosilicate is treated with the mineral acid, and thereafter is dried and fired, followed by the iron salt treatment, the iron-containing aluminosilicate having the objective properties can not be produced.

It is also effective to suitably subject, as necessary, the resultant iron-containing aluminosilicate further to water washing, drying and firing.

With regard to alumina/phosphorus carrier, alumina/alkaline earth metal compound carrier, alumina/titania carrier and alumina/zirconia carrier, the carriers preferably bear a phosphorus oxide, an alkaline earth metal compound, titania and zirconia, respectively each in an amount of 0.5 to 20% by weight based on the whole amount of the carrier. An amount thereof less than 0.5% by weight limits the working effect on enhancing the hydrogenation activity, whereas that more than 20% by weight is unfavorable, since the enhancement of the hydrogenation activity is not sufficiently manifested in consideration of the large amount used, thus making the usage uneconomical, and besides the desulfurization activity is liable to be lowered. The amount thereof is particularly preferable in the range of 1 to 18% by weight from the viewpoint of the working effect on the enhancement of hydrogenation activity.

The dispersibility of each of the foregoing metals in the carrier is measured by means of XPS and is derived from the theoretical formula of monolayer dispersion. This procedure, when applied to the determination of phosphorus atoms that are dispersedly supported on alumina/phosphorus carrier to express the result by the ratio of P peak intensity to Al peak intensity, greatly reflects the dispersion state of the phosphorus atoms by reason of the procedure being surface sensitive. Accordingly, even if the phosphorus content in the carrier is constant, the XPS intensity ratio varies depending upon whether the phosphorus is highly dispersed on alumina or it is present in the state of bulk. The P/Al intensity ratio in XPS is high when the phosphorus atoms are in highly dispersed state, while it is low when the phosphorus atoms are poorly dispersed, allowing a phosphorus oxide in bulk to be present. Thus, the evaluation of phosphorus dispersibility is to estimate the amount of AL—O—P bond which is formed on alumina, and besides, to determine the amount of acid developed there. The acidity of a solid is a factor of importance which is directly concerned with hydrocracking characteristics and denitrification activity, and thus the phosphorus dispersibility is closely correlated with the hydrocracking characteristics.

It is made possible from the foregoing reason to specify the state of phosphorus dispersed on the alumina/phosphorus carrier and to determine the dispersion range wherein the phosphorus added to the carrier functions most effectively, by the use of the surface analysis technique called XPS. The XPS for alumina/phosphorus carrier almost holds in the case of alkaline earth metal compound, titania and zirconia each supported on alumina.

Next, some description will be given of a specific method of evaluating the dispersibilities of phosphorus, alkaline earth metal compound, titania and zirconia, for example, in the case of phosphorus. When a measurement is made of the XPS of phosphorus supported on the surface of the carrier ($Al_2O_3$), the XPS intensity ratio can be found as follows from the theoretical formula (5) derived by Moulijn et al. ["Journal of Physical Chemistry" (J. Phys. Chem), vol. 83, 1979, pp. 1612 to 1619]

$$\left(\frac{I_P}{I_{Al}}\right)_{theoret.} = \left(\frac{P}{Al}\right)_{atom} \times \frac{\sigma_{(P)}\beta_1\{1+\exp(-\beta_2)\}}{2\sigma_{(Al)}\{1-\exp(-\beta_2)\}} \times \frac{D(\varepsilon_P)}{D(\varepsilon_{Al})} \quad (5)$$

wherein $(I_P/I_{Al})_{theoret.}$ is the XPS peak intensity ratio of P to Al which can be theoretically evaluated; $(P/Al)_{atom}$ is the atomic ratio of P to Al, $\sigma_{(Al)}$ is the cross-sectional area of ionized $Al_{2S}$ electrons; $\sigma_{(P)}$ is the cross-sectional area of ionized $P_{2P}$ electrons; $\beta_1$ and $\beta_2$ are found from the following respective formulae $$\beta_1=2/(\lambda_{(Al)}\rho So)$$

$$\beta_2=2/(\lambda_{(P)}\rho So)$$

wherein $\lambda_{(Al)}$ is the escaping depth of $Al_{2S}$ electrons, $\lambda_{(P)}$ is the escaping depth of $P_{1s}$ electrons, $\rho$ is the density of alumina, and So is the specific surface area of alumina; and $D(\epsilon_{Al})$ and $D(\epsilon_P)$ are the efficiencies of detectors (D 1 ) for $Al_{2S}$ and $P_{1s}$, respectively.

The values of $\lambda(Al_{2S})$ and $\lambda(P_{2P})$ are 18.2 Å and 20.4 Å, respectively, which are derived by the use of Penn's formula ["Journal of Electron Spectroscopy and Related Phenomena" vol. 9, 1976, pp. 29 to 40]. The values of $\sigma(Al_{2S})$ and $\sigma(P_{2P\ 1/2})$ are 0.753 and 0.403, respectively, which are found in the literature by Scofield ["Journal of Electron Spectroscopy and Related Phenomena" vol. 8, 1976, pp. 129 to 137] using AlK $\alpha$ ray as the origin of excitation. The ratio by weight of phosphorus to alumina, when expressed by $(P_2O_5/Al_2O_3)_{wt}$ gives $(P/Al)_{atom}=0.7183\ (P_2O_5/Al_2O_3)_{wt}$. Then, substitution of the above-obtained values $\lambda(Al_{2S})$, $\lambda(P_{2P})$, $\sigma(Al_{2S})$ $\sigma(P_{2P\ 1/2})$ and $(P/Al)_{atom}$ using $Al_{2S}$ and $P_{2P}$ as XPS peaks of Al and P, respectively into the foregoing formula (5), give the formula (6)

$$\left(\frac{I_P}{I_{Al}}\right)_{theoret.} = \left(\frac{P_2O_3}{Al_2O_3}\right)_{wt} \times \frac{6.292\times10^8\{1+\exp(-9.804\times10^8/\rho So)\}}{\rho So\{1-\exp(-9.804\times10^9/\rho So)\}} \quad (6)$$

In the formula (6), $(I_P/I_{Al})_{theoret.}$ is the XPS peak intensity ratio of P to Al which can be theoretically evaluated. The symbol So in the formula (6) indicates the specific area of alumina.

It is desirable in the above-mentioned carrier that the atomic dispersibility of each of phosphorus, alkaline earth metal, titania and zirconia which is observed in the above way be not less than 85% of the theoretical dispersibility. An atomic dispersibility less than 85% of the theoretical value involves a fear of causing such disadvantage that the manifestation of an acid point is made insufficient and a high hydrocracking activity or denitrification activity can't be expected.

The above-mentioned carrier can be prepared, for example, by a process which comprises the steps of adding, in a prescribed proportion, phosphorus, an alkaline earth metal, titanium, zirconium or a compound of any of them to alumina or a precursor thereof having a moisture content of not less than 65% by weight; kneading with heating the resultant mixture at a temperature of around 60 to 100° C. for at least one, preferably at least 1.5 hour; and thereafter carrying out molding, drying and firing by a publicly known method. Kneading with heating for shorter than one hour involves a fear of causing insufficient kneading and poor dispersion state of phosphorus atoms. A kneading temperature departing from the above-prescribed range unfavorably results in failure to highly disperse phosphorus atom or the like. The addition of the aforesaid phosphorus, an alkaline earth metal, titanium, zirconium or a compound thereof may be carried out, according to the necessity, in a state of solution in which the metal or compound is dissolved in water with heating.

As the alumina precursor, mention can be made of those same as the alumina precursors given in the description of the foregoing alumina/boria carrier. The aforesaid alumina or a precursor thereof is preferably used in a moisture content of not lower than 65% by weight. A moisture content therein lower than 65% by weight involves a fear of insufficiency in the dispersion of the compound such as a phosphorus compound.

The phosphorus component which is a constituent of the alumina/phosphorus carrier among these carriers is present mainly in the form of phosphorus oxide. The phosphorus component to be used for producing the carrier is divided into elemental phosphorus and phosphorus compounds. Examples of the elemental phosphorus include white phosphorus and red phosphorus. Examples of the phosphorus compounds include inorganic phosphoric acid with a low oxidation number such as orthophosphoric acid, phosphorous acid, hypophosphorous acid and alkali metal salts and ammonium salt thereof; polyphosphoric acid such as pyrophosphoric acid, tripolyphosphoric acid and tetrapolyphosphoric acid and alkali metal salts and ammonium salt thereof; metaphosphoric acid such as trimetaphosphoric acid, tetrametaphosphoric acid and hexametaphosphoric acid and alkali metal salts and ammonium salt thereof; chalcogenated phosphorus; organophosphoric acid, and organophosphates. Particularily preferable phosphorus compounds among them from the aspect of durability are alkali metal salts and ammonium salts of inorganic phosphoric acid with a low oxidation number, or condensed phosphoric acid.

The alkaline earth metal compound which is a constituent of the alumina/alkaline earth metal compound carrier among these carriers is principally an alkaline earth metal oxide, preferably magnesia, calcia or the like. The magnesium component to be used for producing the carrier is divided into elemental magnesium and magnesium compounds. Examples of the magnesium compounds include magnesium oxide, magnesium chloride, magnesium acetate, magnesium nitrate, basic magnesium carbonate, magnesium bromide, magnesium citrate, magnesium hydroxide, magnesium sulfate and magnesium phosphate. The calcium component is divided into elemental calcium and calcium compounds. Examples of the calcium compounds include calcium oxide, calcium chloride, calcium acetate, calcium nitrate, calcium carbonate, calcium bromide, calcium citrate, calcium hydroxide, calcium sulfate, calcium phosphate, calcium alginate and calcium ascorbate.

The titanium component which is used for producing alumina/titania carrier among these carriers is divided into elemental titanium and titanium compounds. Examples of the usable titanium compounds include titanium chloride, potassium titanium oxalate, titanium oxide acetylacetonato, titanium sulfate, potassium titanium fluoride, titanium tetrabutoxide, titanium tetraisopropoxide and titanium hydroxide.

The zirconium component which is used for producing alumina/zirconia carrier is divided into elemental zirconium and zirconium compounds. Examples of the usable zirconium compounds include zirconium chloroxide, zirconium oxychloride, zirconium nitrate dihydrate, zirconium tetrachloride, zirconium silicate, zirconium propoxide, zirconium naphthenate oxide, zirconium 2-ethylhexanate oxide and zirconium hydroxide.

The catalyst (A) to be used in the first and second aspects of the present invention comprises at least one metal selected from the group consisting of the metals each belonging to any of the groups 6, 8, 9 and 10 of the Periodic Table, said metal being supported on at least one carrier obtained in the above-mentioned manner. The method for supporting the metal is not specifically limited, but can be selected optionally from the publicly known methods including impregnation method, coprecipitation method and kneading method. Adesirable metal is supported on the carrier in a prescribed proportion, and then subjected when necessary to drying followed by firing treatment. The firing temperature and firing time are suitably selected according to the kind of metal supported and the like. In this case, the carrier may be used alone or in combination with at least one other.

The hydrotreatment catalyst obtained in the foregoing way usually has an average p ore diameter of at least 70 Å, preferably in the range of 90 to 200 Å. An average pore diameter smaller than 70 Å is liable to cause the disadvantage that the service life of the catalyst is shortened.

In the hydrotreating method according to the second aspect of the invention, there is used the combination of the above-obtained catalyst (A) and a conventional demetallization catalyst (B) according to the level of metals contained in crude oil. In this case, the catalyst (A) may be used alone or in combination with at least one other. Likewise, the catalyst (B) may be used alone or in combination with at least one other. The blending ratio thereof is preferably in the range of 10 to 80% by volume based on the whole volume of the catalysts. The application of the catalyst (B) enables suppression of the catalyst deterioration as well as decrease in metal content in the petroleum product. As the aforesaid demetallization catalyst, mention can be made of the conventional demetallization catalyst usually used by those with ordinary skill in the art, for example, a catalyst having an average pore diameter of at least 100 Å which comprises at least one metal selected from the group consisting of the metals belonging to any of the groups 6, 8, 9 and 10 of the Periodic Table which metal is supported on an inorganic oxide, an acidic carrier, a natural mineral or the like in an amount of 3 to 30% by weight expressed in terms of oxide thereof based on the whole amount of the catalyst. Specific examples thereof include a catalyst having an average pore diameter of 120 Å which comprises Ni/Mo supported on alumina in an amount of 10% by weight expressed in terms of oxides thereof based on the whole amount of the catalyst.

With regard to the first and second aspects of the invention, crude oil or crude oil from which naphtha fraction is removed is hydrotreated in the presence of the above-mentioned hydrotreatment catalyst. The reaction system using the catalyst is not specifically limited, but may be selected for use from fixed bed, fluidized bed and moving bed. Likewise, the production process is not specifically limited, but may be selected for use from various production processes, for example, the processes to be used in the third to seventh aspects of the invention as described hereunder. In FIG. 1, which is a schematic block flow diagram showing an example for the separation of various petroleum products including a hydrotreating step in the first and second aspects of the invention, (1) illustrates a step in which crude oil is, at first, fed in a preliminary distillation tower, where naphtha fraction is removed, and the residue is hydrodesulfurized and introduced in an atmospheric distillation tower to separate into naphtha fraction, kerosene fraction, gas oil fraction and residual oil, while (2) illustrates a step in which crude oil is directly hydrodesulfurized and subsequently introduced in an atmospheric distillation tower to separate into naphtha fraction, kerosene fraction, gas oil fraction and residual oil.

As shown in FIG. 1(1), crude oil from which naphtha fraction is removed in a preliminary distillation tower may be collectively hydrotreated. Alternatively, as shown in FIG. 1(2), crude oil as such may be collectively hydrotreated without removing naphtha fraction in the case where the content of sulfur in naphtha fraction need not be reduced to less than 1 ppm, for example, in the case of employing naphtha fraction as the raw material for an ethylene production unit.

As crude oil to be fed in a preliminary distillation tower and that to be fed in a hydrotreating step, there are usable crude oil and crude oil from which naphtha fraction is removed, each being usually available. It is preferable that such crude oil be desalted in advance in order to prevent fouling or clogging inside the preliminary distillation tower and to prevent the hydrotreatment catalyst from being deteriorated. As a method for desalting treatment, there is usable any of the conventional methods generally used by those with ordinary skill in the art including chemical desalting method, Petreco electric desalting method and Hau Baker electric desalting method.

As shown in FIG. 1(1) in the case where crude oil is treated in a preliminary distillation tower, naphtha fraction and more light fraction are removed at the top thereof under the distillation conditions including usually a temperature in the range of 145 to 200° C., and a pressure in the range of atmospheric pressure to 10 kg/cm$^2$, preferably about 1.5 kg/cm$^2$. The naphtha fraction which is distilled away at the top thereof preferably has a boiling range of 10° C. or higher to the upper limit of 125 to 174° C. However, the naphtha fraction need not be precisely distilled therein, since it is hydrodesulfurized accompanied with rectification in the next step. Naphtha fraction having a boiling range of 10 to 125° C. usually has 5 to 8 carbon atoms, and naphtha fraction having a boiling range of 10 to 174° C. usually has 5 to 10 carbon atoms. When naphtha fraction is cut off at a boiling point lower than 125° C., the partial pressure of hydrogen drops in the subsequent hydrotreatment step, thus causing a fear of lowering the hydrotreatment efficiency, whereas cutting off of the fraction at a boiling point higher than 174° C. causes a tendency of lowering the smoke point of the kerosene fraction obtained by distillation in the subsequent hydrotreatment step.

The reaction conditions in the case of hydrodesulfurizing crude oil from which naphtha fraction is removed include usually a reaction temperature of 300 to 450° C., a hydrogen partial pressure of 30 to 200 kg/cm$^2$, a hydrogen/oil ratio of 300 to 2,000 Nm$^3$/KL and a liquid hourly space velocity (LHSV) of 0.1 to 3 hr$^{-1}$. However, the reaction conditions include preferably a reaction temperature of 360 to 420° C., a hydrogen partial pressure of 100 to 180 kg/cm$^2$, a hydrogen/oil ratio of 500 to 1,000 Nm$^3$/KL and an LHSV of 0.15 to 0.5 hr$^{-1}$, since these conditions enables hydrodesulfurization to be carried out efficiently.

The reaction conditions in the case of hydrodesulfurizing crude oil as such are basically the same as those in the case of hydrodesulfurizing crude oil from which naphtha fraction is removed, but it is preferable to increase hydrogen partial pressure and hydrogen/oil ratio within the above-mentioned range to compensate for lowering of hydrogen partial pressure.

After crude oil or crude oil from which naphtha fraction is removed is collectively hydrodesulfurized in the foregoing way, the resultant treated oil is fed in an atmospheric distillation tower, where the oil is separated into various products such as naphtha fraction, kerosene fraction, gas oil fraction and residue on atmospheric distillation. The operational conditions for the atmospheric distillation tower, which are the same as those for a process for atmospherically distilling crude oil presently prevailing in petroleum refineries, include usually a temperature of about 300 to 380° C. and a pressure of atmospheric pressure to 1.0 $kg/cm^2G$.

By carrying out the foregoing step following the hydrodesulfurizing step, it is made possible to contrive heat recovery and greatly curtail the operational cost. In addition, the construction cost can be curtailed by transferring hydrodesulfurized oil to a petroleum refinery located at other place to separate the petroleum products in order to effectively utilize an existing atmospheric distillation tower for crude oil.

According to the first and second aspects of the invention, it is made possible to produce kerosene and gas oil that are favorable and stabilized in quality in increased amounts and to simplify petroleum refinery equipment by carrying out hydrodenitrification in combination with hydrocracking by the use of the specific catalyst in the collective hydrodesulfurization of crude oil or crude oil from which naphtha fraction is removed.

The third aspect of the invention relates to a process for hydrotreating a hydrocarbon oil which comprises hydrotreating a hydrocarbon oil containing at least one from among asphalten, sulfur and a metal component, in the presence of a catalyst by reversing the flow direction of the oil against the catalyst according to the extent of the deterioration of the catalyst performance after the elapse of a prescribed treatment time. The period of time until reversing the flow direction of the oil may be determined by the treatment conditions and the desired performance without specific limitation. For example, the flow direction may be reversed at the point of time when the desulfurization activity is made impossible to keep up with rising reaction temperature.

Figure 2:
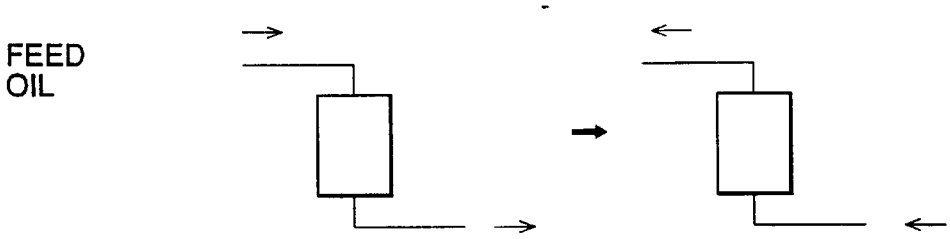
FIG. 2 is a schematic view showing an example of hydrotreating process for a hydrocarbon oil in the third aspect of the invention.
Figure 3:
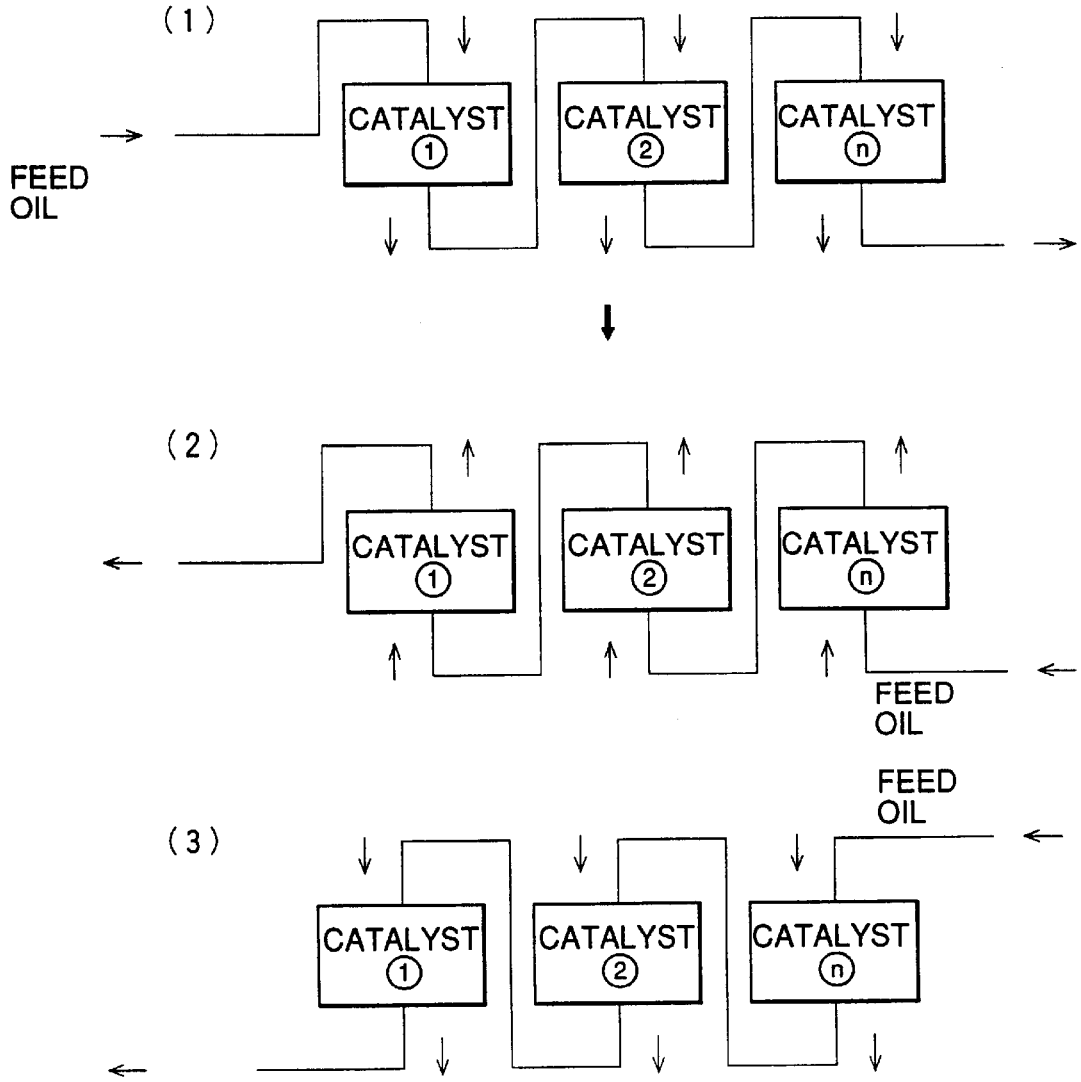
FIG. 3 is schematic view showing an example in which a plurality of reactors are employed in hydrotreating process for a hydrocarbon oil in the third aspect of the invention.

FIG. 2 is a schematic view simply showing an example of hydrotreating process in the third aspect of the invention. In converting the flow of the crude oil to the reverse direction, mention is generally made of a method in which an upward flow is changed to a downward flow. FIG. 3 illustrates an example in which a plurality of reactors are used in a hydrotreating process. In the case of reversing the flow direction of a feed oil according to FIG. 3, it is possible to change the upward flow to the downward flow per each of the reactors as shown in (2) and also to reverse the order of oil flow through the reactors without changing the upward flow as shown in (3).

The conversion of a flow direction to the reverse flow direction can be made when necessary by dividing into plural times per a short period of time.

The catalyst to be used in this process is not specifically limited, but may be selected for use from the catalysts that are conventionally used. There are preferably usable, in particular, the catalyst (A) to be used in the first and second aspects of the invention and a catalyst comprising at least one metal selected from the metals each belonging to any of the groups 6, 8, 9 and 10 of Periodic Table, which metal is supported on alumina as a carrier.

In the present invention, the hydrotreatment catalyst may be used alone, but it is preferable that a reactor be packed inside with a catalyst combination wherein the hydrotreatment catalyst is sandwiched between a catalyst with high demetallization activity and a catalyst with high desulfurization activity because of the capability of further prolonging the service life of the catalyst.

In more detail, it is preferable in the present invention that the catalyst be a catalyst combination which is divided into an (a) catalytic component having a specific surface area of 100 to 250 $m^2/g$, a specific pore volume of 0.4 to 1.5 $cm^3/g$, a pore volume ratio of pores having 80 to 200 Å diameter being 60 to 95% based on the whole pore volume, a pore volume ratio of pores having 200 to 800 Å diameter being 6 to 15% based on the same, and a pore volume ratio of pores having 800 Å or larger diameter being 3 to 30% based on the same and a (b) catalytic component having a specific surface area of 150 to 300 $m^2/g$, a specific pore volume of 0.3 to 1.2 $cm^3/g$, a pore volume ratio of pores having 70 to 150 Å diameter being 80 to 95% based on the whole pore volume and a pore volume ratio of pores having 150 Å or larger diameter being 5 to 20% based on the same, said catalytic components being alternately placed in the order of (a), (b) and (a) against the flow direction of the hydrocarbon oil.

A specific surface area of less than 100 $m^2/g$ instead of 100 to 250 $m^2/g$ in the above-mentioned catalyst (a) unfavorably results in failure to sufficiently exhibit the necessary activity, whereas that more than 250 $m^2/g$ unfavorably brings about the difficulty in regulating the pore diameters to optimum ranges. Moreover the specific surface thereof is more preferably in the range of 150 to 230 $m^2/g$. A specific pore volume of less than 0.4 $cm^3/g$ instead of 0.4 to 1.5 $cm^3/g$ in the catalyst (a) markedly accelerates catalyst deterioration, whereas that more than 1.5 $cm^3/g$ results in failure to sufficiently exhibit necessary catalytic performance, both being unfavorable. Thus, the specific pore volume thereof is more preferably in the range of 0.45 to 1.2 $cm^3/g$. Further it is preferable that a pore volume ratio of pores having 80 to 200 Å diameter be 60 to 95% based on the whole pore volume, a pore volume ratio of pores having 200 to 800 Å diameter be 6 to 15% based on the same, and a pore volume ratio of pores having 800 Å or larger diameter be 3 to 30% based on the same. The above-mentioned range is preferable because of the reasons described hereunder. A pore volume ratio of pores having 80 to 200 Å diameter, when being less than 60%, results in failure to sufficiently exert necessary catalytic performance, but when being more than 95%, makes it impossible to assure the pores having 800 Å or larger diameter which is effective for suppressing the deterioration of catalyst activity. A pore volume ratio of pores having 200 to 800 Å diameter, when being less than 6%, results in failure to effectively diffuse the feed oil between the pores having 80 to 200 Å diameter and the pores having 800 Å or larger diameter, but when being more than 15%, makes it impossible to assure the pores having 80 to 200 Å and pores having 800 Å or larger diameter, both being effective for suppressing the deterioration of catalyst activity and enhancing the catalyst activity. In addition, a pore volume ratio of pores having 800 Å or larger diameter, when being less than 3%, brings about the acceleration of catalyst deterioration, but when being more than 30%, causes a fear of lowering the strength of the catalyst.

In the catalyst (a) of the present invention, it is preferable from the aforesaid viewpoints, that pore volume ratios of pores having 80 to 200 Å diameter, pores having 200 to 800 Å diameter and pores having 800 Å or larger diameter be 65 to 90%, 8 to 12% and 5 to 25%, respectively based on the whole pore volume.

A specific surface area of less than 150 $m^2/g$ instead of 150 to 300 $m^2/g$ in the above-mentioned catalyst (b) unfavorably results in failure to sufficiently exhibit the necessary activity, whereas that more than 300 $m^2/g$ unfavorably brings about the difficulty in regulating the pore diameters to optimum ranges. Moreover the specific surface thereof is more preferably in the range of 160 to 285 $m^2/g$. A specific pore volume of less than 0.3 $cm^3/g$ instead of 0.3 to 1.2 $cm^3/g$ in the catalyst (b) markedly accelerates catalyst deterioration, whereas that more than 1.2 $cm^3/g$ results in failure to sufficiently exhibit necessary catalytic performance, both being unfavorable. Thus, the specific pore volume thereof is more preferably in the range of 0.35 to 1.1 $cm^3/g$. Further it is preferable that a pore volume ratio of pores having 70 to 150 Å diameter be 80 to 95% based on the whole pore volume, and a pore volume ratio of pores having 150 Å or larger diameter be 5 to 20% based on the same. The above-mentioned range is preferable because of the reasons described hereunder. A pore volume ratio of pores having 70 to 150 Å diameter, when being less than 80%, results in failure to sufficiently exert necessary catalytic performance, but when being more than 95%, makes it impossible to assure the pores having 150 Å or larger diameter which is effective for suppressing the deterioration of catalyst activity. In addition, a pore volume ratio of pores having 150 Å or larger diameter, when being less than 5%, brings about the acceleration of catalyst deterioration, but when being more than 20%, results in failure to sufficiently exert catalytic performance.

In the catalyst (b) of the present invention, it is preferable from the aforesaid viewpoints, that pore volume ratios of pores having 70 to 150 Å diameter, and pores having 150 Å or larger diameter be 82 to 93%, and 7 to 18%, respectively based on the whole pore volume.

It is preferable from the standpoint of enhancing the activity of the demetallization to use the catalyst (a) having an average pore diameter larger than that of the catalyst (b).

In the present invention, the combination of the catalysts (a) and (b) can be preferably used by placing them in the order of (a), (b) and (a) against the flow direction of the hydrocarbon oil. The use of such combination and order enables the catalyst to be further prolonged in its service life. A catalyst other than the catalysts (a) and (b) may optionally be used in combination therewith, between (a) and (b) or (b) and (a) or in front of or in rear of (a).

In the case where the catalyst (a) and (b) are used in combination in the above manner according to the present invention, the catalyst combination preferably comprises 20 to 40% by volume of the catalyst (a) and 20 to 60% by volume of the catalyst (b) based on the total volume of the catalyst. An amount of the catalyst (a) less than 20% by volume unfavorably causes deterioration of demetallization activity, whereas that more than 40% by volume unfavorably results in failure to sufficiently exhibit desulfurization activity. On the other hand, an amount of the catalyst (b) less than 20% by volume unfavorably results in failure to sufficiently exert desulfurization activity, whereas that more than 60% by volume unfavorably gives rise to the acceleration of catalyst deterioration. In view of the above, the above-mentioned catalyst combination more preferably comprises 25 to 35% by volume of the catalyst (a) and 30 to 50by volume of the catalyst (b) based on the total volume of the catalyst.

The hydrocarbon oil to be used as the feed oil in the present invention is exemplified by crude oil, crude oil from which naphtha fraction is removed, residue on atmospheric distillation and residue on vacuum distillation. Crude oil, when being used, may be introduced in a preliminary distillation tower, where the naphtha fraction is removed, and the resulting naphtha-free crude oil may be collectively hydrotreated. When the sulfur content in the naphtha fraction need not be lowered to less than 1 ppm, for example, in the case of applying the naphtha fraction to the raw material for an ethylene production plant, the crude oil as such may be collectively hydrotreated without being fed to the preliminary distillation tower for the removal of the naphtha fraction.

As already described in the description of the first and second aspects of the invention, the crude oil to be fed to a preliminary distillation tower or a hydrotreating step is preferably subjected in advance to desalting treatment. The treatment conditions in the preliminary distillation tower for crude oil and the post-treatment of the hydrotreated oil are the same as in the first and second aspects of the invention as described hereinbefore.

According to the third aspect of the invention, it is made possible to readily and inexpensively prolong the service life of the catalyst and at the same time, greatly enhance the operation factor of the hydrotreatment plant through increased continuous operational period of the plant, by reversing the flow direction of the feed oil against the catalyst according to the extent of the deterioration of the catalyst performance after the elapse of a prescribed treatment time.

Figure 4:
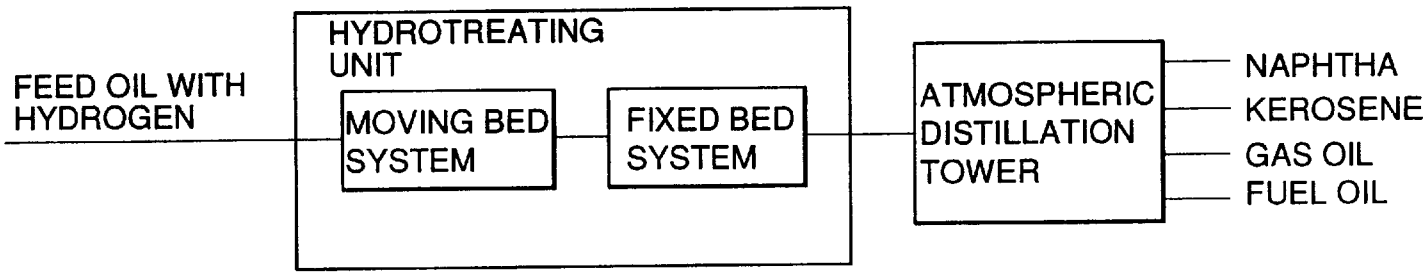
FIG. 4 is a schematic block flow diagram showing an example of hydrotreating process for a hydrocarbon oil in the fourth aspect of the invention.

The fourth aspect of the invention relates to a process for the hydrotreatment of a hydrocarbon oil which comprises hydrotreating crude oil or crude oil from which naphtha fraction is removed as the feed oil through the consecutive steps of at first bringing the feed oil into contact with a catalyst in a moving-bed type hydrotreating unit; then carrying out hydrotreatment in a fixed-bed type hydrotreating unit packed inside with a hydrotreatment catalyst; and carrying out distillation to produce hydrocarbon oil fractions having a different boiling range from each other. FIG. 4 is a schematic block flow diagram showing a hydrotreating process for a hydrocarbon oil in the fourth aspect of the invention.

There is used in the fourth aspect of the invention, crude oil or crude oil from which naphtha fraction is removed, which contains at most 135 ppm by weight of at least one metallic component selected from among vanadium, nickel and iron and at most 12% by weight of asphaltene. The crude oil containing any of the above metallic component in an amount exceeding 135 ppm by weight remarkably shortens the service life of the catalyst owing to the accumulation of the metallic component, while that containing asphaltene in an amount exceeding 12% by weight markedly shortens the service life of the catalyst on account of carbon deposition.

The process for hydrotreating a hydrocarbon oil according to the fourth aspect of the invention specifically comprises hydrotreating crude oil or crude oil from which naphtha fraction is removed as the feed oil through the consecutive steps of ① bringing the crude oil into contact with a catalyst in a moving-bed type hydrorefining unit under a pressure of 21.8 to 200 $kg/cm^2$, at a temperature of 315 to 450° C., at a liquid hourly space velocity (LHSV) of 0.5 to 2.5 $hr^{-1}$ at a hydrogen/oil ratio of 50 to 500 $Nm^3$/kiloliter (KL) to proceed with hydrotreatment; and thereafter ② carrying out hydrotreatment in a fixed-bed type hydrotreating unit packed inside with a hydrotreatment catalyst under a pressure of 30 to 200 $kg/cm^2$, at a temperature of 300 to 450° C., at an LHSV of 0.1 to 3.0 $hr^{-1}$ at a hydrogen/oil ratio of 300 to 2000 $Nm^3$/KL.

The following reaction conditions are applied to the hydrotreatment of the crude oil or crude oil from which naphtha fraction is removed in a moving-bed type hydrorefining unit to be used in the step ①. First of all, the reaction temperature therein is in the range of 315 to 450° C. A reaction temperature therein lower than 315° C. remarkably lowers the rate of reaction, whereas that higher than 450° C. leads to the formation of hydrocarbons with high aromaticity, thereby deteriorating the qualities of kerosene and gas oil fractions. For the reasons mentioned above, the reaction temperature therein is preferably in the range of 371 to 440° C. The reaction pressure, that is, the partial pressure of hydrogen is in the range of 21.8 to 200 kg/cm$^2$. A reaction pressure therein lower than 21.8 kg/cm$^2$ remarkably lowers the rate of reaction, whereas that higher than 200 kg/cm$^2$ is uneconomical. For the reasons mentioned above, the partial pressure of hydrogen is preferably in the range of 35.5 to 160 kg/cm$^2$. The hydrogen/oil ratio is in the range of 50 to 500 Nm$^3$/KL. A hydrogen/oil ratio less than 50 Nm$^3$/KL results in failure to sufficiently proceed with the reaction, whereas that more than 500 Nm$^3$/KL will bring about the problem with the operation of the unit due to catalyst entrainment. For the reasons mentioned above, the aforesaid ratio is preferably in the range of 200 to 500 Nm$^3$/KL. The liquid hourly space velocity (LHSV) is in the range of 0.5 to 2.5 hr$^{-1}$. An LHSV less than 0.5 hr$^{-1}$ results in failure to assure sufficient rate of treatment from the economical point of view, whereas that more than 2.5 hr$^{-1}$ causes a fear that an insufficient reaction time makes it impossible to complete the hydrorefining of the feed oil. For the reasons mentioned above, the LHSV is preferably in the range of 1.0 to 2.0 hr$^{-1}$.

The catalyst to be used therein is preferably a catalyst having the physical properties similar to those of the demetallization catalyst available on the market for heavy oil and having a shape well suited for movement, for example, at least one metal selected from the metals each belonging to any of the groups 6, 8, 9 and 10 of the Periodic Table, which metal is supported on an alumina carrier having an average pore diameter exceeding 100 Å. The preferable metals in the catalyst include tungsten and molybdenum as a metal belonging to the group 6 of the Periodic Table; and nickel and cobalt as a metal belonging to any of the groups 8, 9 and 10 of the same. The metal belonging to the group 6 and the metal belonging to any of the groups 8, 9 and 10 may each be used alone or in combination with at least one other. In particular, examples of preferable combination include Ni—Mo, Co—Mo, Ni—W, Ni—Co—Mo because of their high hydrogenation activity and limited deterioration.

Figure 5:
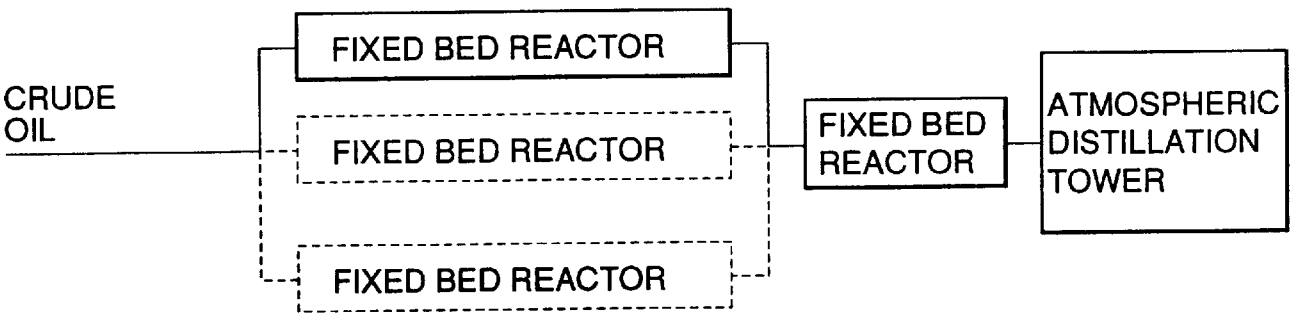
FIG. 5 is a schematic block flow diagram showing an example of unit which comprises a plurality of fixed bed reactors located in parallel and exhibit a function similar to that of moving bed.

The term "moving bed" as used in the present invention refers to the system in which catalyst replacement is performed without discontinuing the reaction, while continuous treatment of crude oil is maintained, and which is exemplified, for example, in Japanese Patent Application Laid-Open No. 30890/1984. The moving bed can include the embodiment as illustrated in FIG. 5 wherein a plurality of fixed bed reactors are set up in parallel, and the operation of the reactors are periodically switched over to one another to maintain the catalyst activity and besides to continue the state approximate to the foregoing moving bed.

It is preferable in the moving bed type hydrorefining unit that the crude oil or crude oil from which naphtha fraction is removed be fed in the unit in the direction countercurrent against the catalyst because of its capability of lessening the catalyst consumption.

The following reaction conditions are applied to the further hydrotreatment in the fixed bed type hydrotreatment unit in the step ② for the crude oil which has been treated in the step ①.

First of all, the reaction temperature therein is in the range of 300 to 450° C. A reaction temperature therein lower than 300° C. remarkably lowers the rate of reaction, whereas that higher than 450° C. leads to the formation of carbonaceous solid, thereby remarkably shortens the service life of the catalyst. For the reasons mentioned above, the reaction temperature therein is preferably in the range of 360 to 420° C. The reaction pressure, that is, the partial pressure of hydrogen is in the range of 30 to 200 kg/cm$^2$. A reaction pressure therein lower than 30 kg/cm$^2$ remarkably shortens the service life of the catalyst because of the deposition of carbonaceous solid, whereas that higher than 200 kg/cm$^2$ is uneconomical from the viewpoint of equipment design. For the reasons mentioned above, the partial pressure of hydrogen is preferably in the range of 100 to 180 kg/cm$^2$. The hydrogen/oil ratio is in the range of 300 to 2000 Nm$^3$/KL. A hydrogen/oil ratio less than 300 Nm$^3$/KL results in failure to sufficiently proceed with the reaction, whereas that more than 2000 Nm$^3$/KL is uneconomical from the viewpoint of equipment design. For the reasons mentioned above, the aforesaid ratio is preferably in the range of 500 to 1000 Nm$^3$/KL. The liquid hourly space velocity (LHSV) is in the range of 0.1 to 3.0 hr$^{-1}$. An LHSV less than 0.1 hr$^{-1}$ results in failure to assure sufficient rate of treatment from the economical point of view, whereas that more than 3.0 hr$^{-1}$ causes a fear that an insufficient reaction time makes it impossible to complete the hydrorefining of the feed oil. For the reasons mentioned above, the LHSV is preferably in the range of 0.2 to 0.8 hr$^{-1}$.

Figure 6:
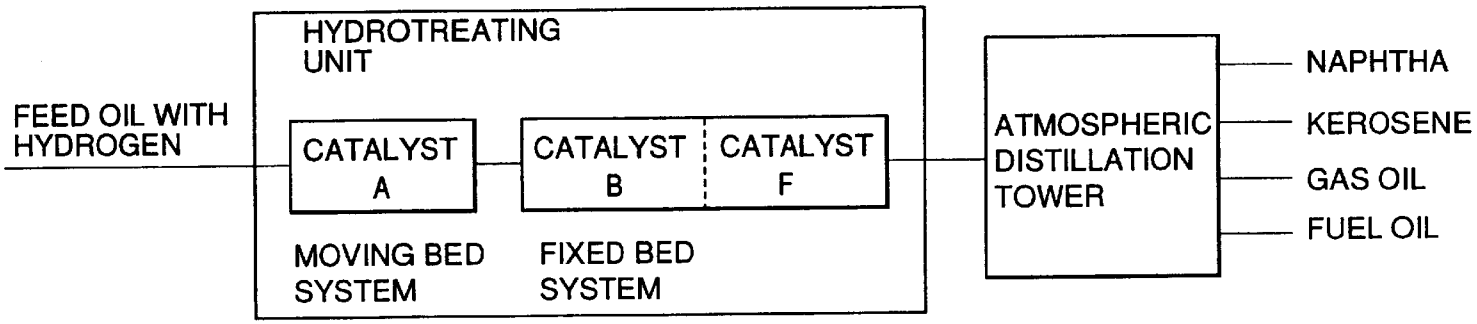
FIG. 6 is a schematic block flow diagram showing an example of hydrotreating process for a hydrocarbon oil in the fourth aspect of the invention, differing from FIG. 4.

It is advantageous in the present invention as illustrated in FIG. 6 that the fixed bed type hydrotreatment unit be equipped with a catalyst bed divided into at least two stages, preferably two stages that are each packed with catalysts different in average pore diameter from each other. At least one catalyst among them is preferably a catalyst (I) having an average pore diameter of 80 Å or larger. The catalysts to be used therein, when being totally smaller than 80 Å in average pore diameter, unfavorably prevent heavy molecules from sufficiently diffusing in the pores, thus bringing about unsatisfactory product characteristics (e.g. metal content) of the residual oil due to insufficient reaction. From the above viewpoint, the catalyst (I) preferably has an average pore diameter in the range of 80 to 120 Å. On the other hand, at least one catalyst among the at least two catalysts different in average pore diameter from each other is preferably a catalyst (II) having an average pore diameter smaller than 80 Å. The catalysts to be used therein, when being totally larger than 80 Å in average pore diameter, unfavorably brings about unsatisfactory product characteristics of the light kerosene and gas oil fractions. In view of the above, the aforesaid catalyst (II) preferably has an average pore diameter in the range of 20 to 70 Å.

The packing ratio between at least two catalysts different in average pore diameter from each other is not specifically limited, but is preferably in the range of 1 to 80 in terms of the catalyst (I)/catalyst (II) ratio by volume in the case of two-stage catalyst layer judging from the service life of catalyst.

As mentioned above, it is advantageous in this aspect of the invention to divide the catalyst bed in the fixed-bed type hydrotreatment unit into at least two stages each packed with catalyst different in average pore diameter from one another. In this case, it is preferable to prolong the service life of the catalyst to pack the catalyst (I) on the upstream side of the feed oil and pack the catalyst (II) on the downstream thereof. Conversely, there is preferably usable a method in which the catalyst (I) and catalyst (II) are packed on the downstream and upstream sides, respectively for the purpose of assuring desulfurization and demetallization activities. There are preferably applicable the above-mentioned embodiments to the two-stage catalyst bed in this aspect of the invention, and in particular, the former embodiment is preferably applicable.

The catalyst to be used in the fixed bed type hydrotreatment unit is not specifically limited, but may be selected for use from the catalysts that are conventionally used, and in particular, the catalyst (A) in the above-mentioned first and second aspects of the invention is preferably usable.

In the step ②, a known demetallization catalyst may be used according to the content of metals in the feed oil in combination with the aforesaid catalysts in an amount of about 10 to 80% by volume based on the total volume of the catalysts. The demetallization catalyst, when used, can suppress the catalyst deterioration due to metals and at the same time, decrease the content of metals in the petroleum products. Examples of such catalyst include a demetallization catalyst presently used by those with ordinary skill in the art, for example, a catalyst with 100 Å or larger average pore diameter comprising at least one metal selected from the metals each belonging to any of the groups 6, 8, 9 and 10 of the Periodic Table which metal is supported on a carrier such as an organic oxide, an acidic carrier or a natural mineral, in an amount of about 3 to 30% by weight expressed in terms of oxide based on the total weight of the catalyst, specifically, a catalyst with 120 Å average pore diameter comprising Ni—Mo supported on alumina in an amount of 10% by weight as oxide based on the total weight of the catalyst.

It is preferable to add hydrogen to the effluent from the moving bed-type hydrorefining unit between the steps ① and ② and carry out hydrotreatment in the second stage fixed bed-type hydrotreatment unit. It is also preferable to separate the effluent from the first stage moving bed-type hydrorefining unit into gas and liquid, further add hydrogen to the separated liquid between the steps ① and ② and conduct hydrotreatment in the second stage fixed bed-type hydrotreatment unit. In this case, the separation into gas and liquid is generally performed by a method in which a high pressure separator is used without considerably changing the temperature or pressure of the reaction effluent.

Whether or not the effluent from the moving bed-type hydrorefining unit is separated into gas and liquid, the amount of hydrogen to be added needs only be sufficient for efficiently proceed with the reaction in the second stage fixed bed-type hydrotreatment unit, and is preferably in the range of 500 to 1000 $Nm^3/KL$ expressed in terms of hydrogen/oil ratio.

After crude oil or crude oil from which naphtha fraction is removed is collectively hydrodesulfurized, the resultant treated oil is separated in an atmospheric distillation tower as shown in FIG. 1 into various petroleum products such as naphtha fraction, kerosene fraction, gas oil fraction, residue on atmospheric distillation, etc.

As the process for the hydrotreatment of hydrocarbon oil in the fourth aspect of the invention, mention is made of the process as illustrated in FIG. 1. As shown therein, crude oil may be introduced in a preliminary distillation tower, where the naphtha fraction is removed, and the resulting naphtha-free crude oil may be collectively hydrotreated. When the sulfur content in the naphtha fraction need not be lowered to less than 1 ppm, for example, in the case of applying the naphtha fraction to the raw material for an ethylene production plant, the crude oil as such may be collectively hydrotreated without being fed to the preliminary distillation tower for the removal of the naphtha fraction.

As already described in the description of the first and second aspects of the invention, the crude oil to be fed to a preliminary distillation tower or a hydrotreating step is preferably subjected in advance to desalting treatment. The treatment conditions in the preliminary distillation tower for crude oil and the post-treatment of the hydrotreated oil are the same as in the first and second aspects of the invention as described hereinbefore.

According to the fourth aspect of the invention, it is made possible to effectively carry out the hydroreforming of kerosene and gas oil as well as the hydrodesulfurization of heavy oil, produce high-quality kerosene and gas oil in increased quantities, prolong the continuous operation period of the production plant and simplify petroleum refinery equipment, by using a moving bed-type hydrorefining unit in the former stage and a fixed bed-type hydrotreatment unit in the latter stage in the collective hydrodesulfurizing step of crude oil or crude oil from which naphtha fraction is removed.

The fifth aspect of the invention relates to a process for hydrotreating a hydrocarbon oil which comprises the steps of hydrodesulfurizing crude oil or crude oil from which naphtha fraction is removed as the feed oil in the presence of hydrogen by bringing the feed oil into contact with a catalyst; atmospherically distilling the resulting hydrotreated oil to separate it into naphtha fraction, kerosene fraction, gas oil fraction and heavy oil fraction; and hydrotreating at least one fraction from the kerosene fraction and the gas oil fraction thus separated by bringing the at least one fraction into contact with a hydrogenation catalyst.

In this process, crude oil may be introduced in a preliminary distillation tower, where the naphtha fraction is removed, and the resulting naphtha-free crude oil may be collectively hydrotreated. When the sulfur content in the naphtha fraction need not be lowered to less than 1 ppm, for example, in the case of applying the naphtha fraction to the raw material for an ethylene production plant, the crude oil as such may be collectively hydrotreated without being fed to the preliminary distillation tower for the removal of the naphtha fraction.

As already described in the description of the first and second aspects of the invention, the crude oil to be fed to a preliminary distillation tower or a hydrotreating step is preferably subjected in advance to desalting treatment. The treatment conditions in the preliminary distillation tower for crude oil are the same as in the first and second aspects of the invention as described hereinbefore.

There is used in the fifth aspect of the invention, crude oil or crude oil from which naphtha fraction is removed, which contains at most 135 ppm by weight of at least one metallic component selected from among vanadium, nickel and iron and at most 12% by weight of asphalten. The crude oil containing any of the above metallic component in an amount exceeding 135 ppm by weight remarkably shortens the service life of the catalyst owing to the accumulation of the metallic component, while that containing asphaltene in an amount exceeding 12% by weight markedly shortens the service life of the catalyst on account of carbon deposition, whereby both the cases are made unfavorable.

The following reaction conditions are applied to the hydrotreatment of the crude oil or crude oil from which naphtha fraction is removed in the hydrodesulfurization step in the present invention.

First of all, the reaction temperature therein is preferably in the range of 300 to 450° C. A reaction temperature therein lower than 300° C. remarkably lowers the rate of reaction, whereas that higher than 450° C. leads to the formation of carbonaceous solid (coke) on the catalyst thereby remarkably shortens the service life of the catalyst. For the reasons mentioned above, the reaction temperature therein is more preferably in the range of 360 to 420° C. The reaction pressure, that is, the partial pressure of hydrogen is preferably in the range of 30 to 200 kg/cm$^2$. A reaction pressure therein lower than 30 kg/cm$^2$ remarkably shortens the service life of the catalyst because of the deposition of carbonaceous solid, whereas that higher than 200 kg/cm$^2$ is uneconomical from the viewpoint of equipment design. For the reasons mentioned above, the partial pressure of hydrogen is more preferably in the range of 100 to 180 kg/cm$^2$. The hydrogen/oil ratio is preferably in the range of 300 to 2000 Nm$^3$/KL. A hydrogen/oil ratio less than 300 Nm$^3$/KL results in failure to sufficiently proceed with the hydrorefining, whereas that more than 2,000 Nm$^3$/KL is uneconomical from the viewpoint of equipment design. For the reasons mentioned above, the aforesaid ratio is more preferably in the range of 500 to 1,000 Nm$^3$/KL. The liquid hourly space velocity (LHSV) is preferably in the range of 0.1 to 3.0 hr$^{-1}$. An LHSV less than 0.1 hr$^{-1}$ results in failure to assure sufficient rate of treatment from the economical point of view, whereas that more than 3.0 hr$^{-1}$ causes the defect of an insufficient reaction time, thereby failing to complete the hydrotreatment of the feed oil. For the reasons mentioned above, the LHSV is more preferably in the range of 0.15 to 0.5 hr$^{-1}$.

The reaction conditions in the case of hydrodesulfurizing crude oil as such are basically the same as those in the case of hydrodesulfurizing crude oil from which naphtha fraction is removed, but it is preferable to increase hydrogen partial pressure and hydrogen/oil ratio within the above-mentioned range to compensate for lowering of the hydrogen partial pressure.

The catalyst to be used in the foregoing hydrodesulfurization step is not specifically limited, but may be selected for preferable use from the catalyst (A) in the above-mentioned first and second aspect of the invention and at least one metal selected from the metals each belonging to any of the groups 6, 8, 9 and 10 of the Periodic Table, which metal is supported on alumina carrier or alumina incorporated with a silicon compound as a carrier. The preferable metals in the catalyst include tungsten and molybdenum as a metal belonging to the group 6 of the Periodic Table; and nickel and cobalt as a metal belonging to any of the groups 8, 9 and 10 of the same. The metal belonging to the group 6 and the metal belonging to any of the groups 8, 9 and 10 may each be used alone or in combination with at least one other. In particular, examples of preferable combination include Ni—Mo, Co—Mo, Ni—W, Ni—Co—Mo because of their high hydrogenation activity and limited deterioration.

A method in which alumina carrier or alumina incorporated with a silicon compound as a carrier is made to support at least one metal selected from the metals each belonging to any of the groups 6, 8, 9 and 10 of the Periodic Table and the amount of the metal to be supported are the same as the method in the catalyst (A) in which the carrier composed of alumina/boria, alumina/phosphorus, alumina/an alkaline earth metal compound, alumina/titania or alumina/zirconia is made to support the metal and the amount of the supported metal in the case of the catalyst (A), respectively.

In the case of using the carrier comprising alumina and a silicon compound added thereto, the silicon compound is preferably contained in an amount of 0.5 to 20% by weight based on the whole amount of the carrier.

An amount thereof less than 0.5% by weight limits the working effect on enhancing the hydrogenation activity, whereas that more than 20% by weight is unfavorable, since the enhancement of the hydrogenation activity is not sufficiently manifested in consideration of the large amount used, thus making the usage uneconomical, and besides the desulfurization activity is liable to be lowered. The amount thereof is particularly preferably in the range of 1 to 18% by weight from the viewpoint of the working effect on the enhancement of hydrogenation activity.

The carrier comprising alumina and a silicon compound added thereto can be prepared, for example, by a process which comprises the steps of adding, in a prescribed proportion, a silicon compound to alumina or a precursor thereof having a moisture content of not less than 65% by weight; kneading with heating the resultant mixture at a temperature of around 60 to 100° C. for at least one, preferably at least 1.5 hour; and thereafter carrying out molding, drying and firing by a publicly known method. Kneading with heating for shorter than one hour involves a fear of causing insufficient kneading and poor dispersion state of silicon atoms. A kneading temperature departing from the above-prescribed range unfavorably results in failure to highly disperse silicon atoms or the like. The addition of the aforesaid silicon compound may be carried out, according to the necessity, in a state of solution in which the compound is dissolved in water with heating.

As the alumina precursor, mention is made of the alumina precursors same as those that were exemplified in the description of the carrier of the catalyst (A) in the first and second aspects of the invention. There are usable, as a silicon compound, any of various compounds that are convertible into silicon oxide by means of firing in addition to silicon oxide itself. Examples of such compounds include silicic acid, metasilicic acid, hexafluorosilicic acid, an alkali metal salt thereof, silicon fluoride, silicon chloride, silicon sulfide, silicon acetate, siloxane, siloxene, halogen-substituted derivative therefrom, alkyl-substituted derivative therefrom and aryl-substituted derivative therefrom. Of these, an alkali metal salt of silicic acid is preferable because of its water resistance, heat resistance and durability.

The average pore diameter of the aforesaid catalyst is preferably in the range of 50 to 200 Å. A pore diameter thereof smaller than 50 Å results in that the deterioration of the catalyst is markedly accelerated, whereas that larger than 200 Å causes a fear of lowered catalyst strength.

The catalyst may be used alone or in combination with at least one other. Likewise, the reaction system using the catalyst is not specifically limited, but may be selected for use from fixed bed, fluidized bed, moving bed and the like. In addition, a known demetallization catalyst may be used according to the content of metals in the feed oil in combination with the aforesaid catalyst in the first stage of catalyst bed in an amount of about 10 to 80% by volume based on the total volume of the catalysts. The demetallization catalyst, when used, can preferably suppress the catalyst deterioration due to metals and at the same time, decrease the content of metals in the petroleum products. Examples of such catalyst include a demetallization catalyst, for example, a catalyst with 100 Å or larger average pore diameter comprising at least one metal selected from the metals each belonging to any of the groups 6, 8, 9 and 10 of the Periodic Table which metal is supported on a carrier such as an organic oxide, an acidic carrier or a natural mineral, in an amount of about 3 to 30% by weight expressed in terms of oxide based on the total weight of the catalyst, specifically, a catalyst with 120 Å average pore diameter comprising Ni—Mo supported on alumina in an amount of 10% by weight as oxide based on the total weight of the catalyst.

After crude oil or crude oil from which naphtha fraction is removed is collectively hydrodesulfurized in the foregoing way, the resultant treated oil is fed in an atmospheric distillation tower, where the oil is separated into various products such as naphtha fraction, kerosene fraction, gas oil fraction and residue on atmospheric distillation. The operational conditions for the atmospheric distillation tower, which are almost the same as those for a process for atmospherically distilling crude oil presently prevailing in petroleum refineries, include usually a temperature of about 300 to 380° C. and a pressure of atmospheric pressure to 1.0 $kg/cm^2G$.

By carrying out the foregoing step following the hydrodesulfurizing step, it is made possible to contrive heat recovery and greatly curtail the operational cost. In addition, the construction cost can be curtailed by transferring hydrosulfurized oil to a petroleum refinery located at other place to separate the petroleum products in order to effectively utilize an existing atmospheric distillation tower for crude oil.

In the present invention, hydrotreatment is applied to at least one from the kerosene fraction and the gas oil fraction that have been separated in the aforesaid atmospheric distillation. The following reaction conditions are applied to the hydrorefining unit to be used in the above hydrotreatment.

First of all, the reaction temperature therein is preferably in the range of 300 to 450°C. A reaction temperature therein lower than 300° C. results in failure to improve the smoke point of the kerosene fraction, whereas that higher than 450° C. leads to the deterioration of the hue of the gas oil fraction, thereby deteriorating the qualities of kerosene and gas oil fractions. For the reasons mentioned above, the reaction temperature therein is more preferably in the range of 360 to 420° C. The reaction pressure, that is, the partial pressure of hydrogen is preferably in the range of 30 to 200 $kg/cm^2$. A reaction pressure therein lower than 30 $kg/cm^2$ remarkably shortens the service life of the catalyst because of the deposition of carbonaceous solid, whereas that higher than 200 $kg/cm^2$ is uneconomical from the viewpoint of equipment design. For the reasons mentioned above, the partial pressure of hydrogen is more preferably in the range of 100 to 180 $kg/cm^2$. The hydrogen/oil ratio is preferably in the range of 300 to 5,000 $Nm^3/KL$. A hydrogen/oil ratio less than 300 $Nm^3/KL$ results in failure to sufficiently proceed with the reaction, whereas that more than 5000 $Nm^3/KL$ is uneconomical from the viewpoint of equipment design. For the reasons mentioned above, the aforesaid ratio is preferably in the range of 500 to 1,000 $Nm^3/KL$. The liquid hourly space velocity (LHSV) is preferably in the range of 1.0 to 10.0 $hr^{-1}$. An LHSV less than 1.0 $hr^{-1}$ results in failure to assure sufficient rate of treatment from the economical point of view, whereas that more than 10.0 $hr^{-1}$ causes insufficient reaction time, thereby failing to obtain satisfactory yield of cracked oil. For the reasons mentioned above, the LHSV is more preferably in the range of 1.5 to 5 $hr^{-1}$.

As the hydrogenation catalyst to be used in the hydrotreatment, mention is made of the catalysts same as those exemplified as the catalyst to be used in the above-mentioned hydrodesulfurization step. The hydrogenation catalyst may be used alone or in combination with at least one other. The reaction system using the catalyst is not specifically limited, but may be selected for use from fixed bed, fluidized bed, moving bed and the like.

According to the fifth aspect of the invention, it is made possible to effectively carry out the hydroreforming of kerosene and gas oil as well as the hydrodesulfurization of heavy oil, produce high-quality kerosene and gas oil in increased quantities, and simplify petroleum refinery equipment, by separately performing the hydrotreatments of kerosene fraction and gas oil fraction in the steps of collectively hydrodesulfurizing crude oil or crude oil from which naphtha fraction is removed and subsequently atmospherically distilling the resultant desulfurized petroleum.

The sixth aspect of the invention relates to a process for hydrotreating a hydrocarbon oil which comprises the steps of demetallizing crude oil or crude oil from which naphtha fraction is removed as the feed oil by bringing the feed oil into contact with a demetallization catalyst; separating the effluent from the demetallizing step in a high pressure gas-liquid separating vessel into gaseous components and liquid hydrocarbon components; subsequently hydrorefining the resultant gaseous components by bringing them into contact with a hydrorefining catalyst; hydrodesulfurizing the resultant liquid hydrocarbon components by bringing them into contact with a hydrodesulfurization catalyst; combining said hydrorefined gaseous components and said hydrodesulfurized liquid hydrocarbon components into a combination; and atmospherically distilling the resulting combination to produce hydrocarbon fractions different in a boiling range from each other.

Figure 7:
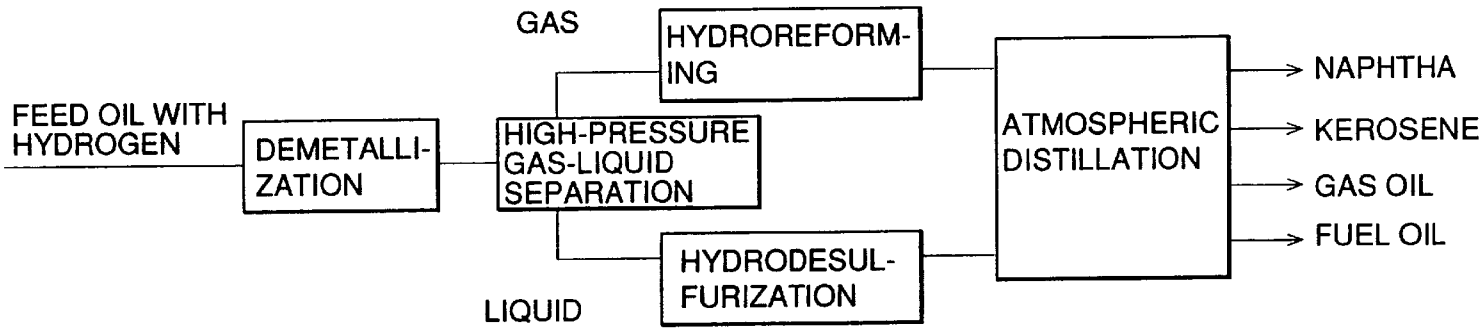
FIG. 7 is a schematic block flow diagram showing an example of hydrotreating process for a hydrocarbon oil in the sixth aspect of the invention.

In FIG. 7 is shown a schematic block flow diagram of an example of hydrotreating process for a hydrocarbon oil in the sixth aspect of the invention.

In this process, crude petroleum may be introduced in a preliminary distillation tower, where the naphtha fraction is removed, and the resulting naphtha-free crude petroleum may be demetallized. When the sulfur content in the naphtha fraction need not be lowered to less than 1 ppm, for example, in the case of applying the naphtha fraction to the raw material for an ethylene production plant, the crude oil as such may be directly demetallized without being fed to the preliminary distillation tower for the removal of the naphtha fraction.

As already described in the description of the first and second aspects of the invention, the crude oil to be fed to a preliminary distillation tower or a demetallizing step is preferably subjected in advance to desalting treatment. The treatment conditions in the preliminary distillation tower for crude oil are the same as in the first and second aspects of the invention as described hereinbefore.

There is used in the sixth aspect of the invention, crude oil or crude oil from which naphtha fraction is removed, which contains at most 135 ppm by weight of at least one metallic component selected from among vanadium, nickel and iron and at most 12% by weight of asphalten. The crude oil containing any of the above metallic component in an amount exceeding 135 ppm by weight remarkably shortens the service life of the catalyst owing to the accumulation of the metallic component, while that containing asphalten in an amount exceeding 12% by weight markedly shortens the service life of the catalyst on account of carbon deposition, whereby both the cases are made unfavorable.

The following reaction conditions are applied to the demetallizing treatment of the crude oil or crude oil from which naphtha fraction is removed in the demetallizing treatment step in the present invention. First of all, the reaction temperature therein is preferably in the range of 300 to 450° C. A reaction temperature therein lower than 300° C. remarkably lowers the rate of reaction, whereas that higher than 450° C. leads to the formation of carbonaceous solid (coke), thereby remarkably shortens the service life of the catalyst. For the reasons mentioned above, the reaction temperature therein is more preferably in the range of 360 to 420° C. The reaction pressure, that is, the partial pressure of hydrogen is preferably in the range of 30 to 200 $kg/cm^2$. A reaction pressure therein lower than 30 $kg/cm^2$ remarkably shortens the service life of the catalyst because of the deposition of carbonaceous solid, whereas that higher than 200 kg/cm$^2$ is uneconomical from the viewpoint of equipment design. For the reasons mentioned above, the partial pressure of hydrogen is more preferably in the range of 100 to 180 kg/cm$^2$. The hydrogen/oil ratio is preferably in the range of 300 to 2,000 Nm$^3$/KL. A hydrogen/oil ratio less than 300 Nm$^3$/KL results in failure to sufficiently proceed with the hydrorefining whereas that more than 2,000 Nm$^3$/KL is uneconomical from the viewpoint of equipment design. For the reasons mentioned above, the aforesaid ratio is more preferably in the range of 500 to 1,000 Nm$^3$/KL. The liquid hourly space velocity (LHSV) is preferably in the range of 0.1 to 3.0 hr$^{-1}$. An LHSV less than 0.1 hr$^{-1}$ results in failure to assure sufficient rate of treatment from the economical point of view, whereas that more than 3.0 hr$^{-1}$ causes the defect of an insufficient reaction time, thereby failing to complete the demetallizing treatment of the feed oil. For the reasons mentioned above, the LHSV is more preferably in the range of 0.5 to 2 hr$^{-1}$.

The reaction conditions in the case of hydrodesulfurizing crude oil as such are basically the same as those in the case of hydrodesulfurizing crude oil from which naphtha fraction is removed, but it is preferable to increase hydrogen partial pressure and hydrogen/oil ratio within the above-mentioned range to compensate for lowering of the hydrogen partial pressure.

As the catalyst preferably usable as the above-mentioned demetallization catalyst, mention is made of a publicly known demetallization catalyst for heavy oil, for example, at least one metal selected from the metals each belonging to any of the groups 6, 8 and 10 of the Periodic Table, which metal is supported on an alumina carrier. The preferable metals in the catalyst include tungsten and molybdenum as a metal belonging to the group 6 of the Periodic Table; and nickel and cobalt as a metal belonging to any of the groups 8, 9 and 10 of the same. The metal belonging to the group 6 and the metal belonging to any of the groups 8, 9 and 10 may each be used alone or in combination with at least one other. In particular, examples of preferable combination include Ni—Mo, Co—Mo, Ni—W, Ni—Co—Mo because of their high hydrogenation activity and limited deterioration.

The amount of any of the above metals to be supported on the carrier is not specifically limited, but may be suitably selected according to various conditions. The amount thereof is usually in the range of 1 to 35% by weight expressed in terms of the oxide thereof based on the whole amount of the catalyst. An amount thereof less than 1% by weight results in failure to sufficiently exert the working effect as a demetallization catalyst, whereas that more than 35% by weight leads to economical disadvantage in that the enhancement of the demetallization activity is not remarkable in consideration of the amount supported. The amount thereof is particularly preferably in the range of 5 to 30% by weight from the viewpoints of demetallization activity as well as economical efficiency.

The reaction system using the above-mentioned catalyst is not specifically limited, but may be selected for use from fixed bed, fluidized bed, moving bed and the like.

There is employed in this aspect of the invention, a process in which after the demetallizing treatment, the effluent from the demetallization step is separated in advance into gaseous components and liquid hydrocarbons as the liquid components, and both the components are separately treated. The reaction effluent, when directly hydrotreated, causes the partial pressure of hydrogen to be lowered, thereby lowering the hydrotreatment efficiency. In this case, there is used a high-pressure gas-liquid separating vessel, where the gaseous components and liquid components are separated from each other without considerably altering the temperature and pressure of the reaction effluent.

The liquid hydrocarbons as the liquid components thus separated under a high pressure are hydrodesulfurized under the following reaction conditions.

First of all, the reaction temperature therein is preferably in the range of 300to 450° C. Are action temperature therein lower than 300° C. remarkably lowers the rate of reaction, whereas that higher than 450° C. leads to the formation of carbonaceous solids (coke), thereby remarkably shortens the service life of the catalyst. For the reasons mentioned above, the reaction temperature therein is more preferably in the range of 360 to 420° C. The reaction pressure, that is, the partial pressure of hydrogen is preferably in the range of 30 to 200 kg/cm$^2$. A reaction pressure therein lower than 30 kg/cm$^2$ remarkably shortens the service life of the catalyst because of the deposition of carbonaceous solid, whereas that higher than 200 kg/cm$^2$ is uneconomical from the viewpoint of equipment design. For the reasons mentioned above, the partial pressure of hydrogen is more preferably in the range of 100 to 180 kg/cm$^2$. The hydrogen/oil ratio is preferably in the range of 300 to 2,000 Nm$^3$/KL. A hydrogen/oil ratio less than 300 Nm$^3$/KL results in failure to sufficiently proceed with the hydrodesulfurization, whereas that more than 2,000 Nm$^3$/KL is uneconomical from the viewpoint of equipment design. For the reasons mentioned above, the aforesaid ratio is more preferably in the range of 500 to 1,000 Nm$^3$/KL. The liquid hourly space velocity (LHSV) is preferably in the range of 0.1 to 3.0 hr$^{-1}$. An LHSV less than 0.1 hr$^{-1}$ results in failure to assure sufficient rate of treatment from the economical point of view, whereas that more than 3.0 hr$^{-1}$ causes the defect of an insufficient reaction time, thereby failing to complete the hydrodesulfurization of the feed oil. For the reasons mentioned above, the LHSV is more preferably in the range of 0.15 to 0.5 hr$^{-1}$.

The catalyst to be used in this hydrodesulfurizing step is not specifically limited, but may be selected for use from various catalysts. Examples of preferably usable catalysts include the catalysts same as those exemplified as the hydrodesulfurization catalyst in the above-described fifth aspect of the invention. The catalyst may be used alone or in combination with at least other one.

On the other hand in this aspect of the invention, hydrorefining is further applied, under the following reaction conditions, to the gaseous components that has been obtained through the gas liquid separation after the demetallizing treatment.

First of all, the reaction temperature therein is preferably in the range of 300 to 450° C. A reaction temperature therein lower than 300° C. results in failure to improve the smoke point of the kerosene fraction, whereas that higher than 450° C. leads to the deterioration of the hue of the gas oil fraction, thereby deteriorating the qualities of kerosene and gas oil fractions. For the reasons mentioned above, the reaction temperature therein is more preferably in the range of 360 to 420° C. The reaction pressure, that is, the partial pressure of hydrogen is preferably in the range of 30 to 200 kg/cm$^2$. A reaction pressure therein lower than 30 kg/cm$^2$ remarkably shortens the service life of the catalyst because of the deposition of carbonaceous solid, whereas that higher than 200 kg/cm$^2$ is uneconomical from the viewpoint of equipment design. For the reasons mentioned above, the partial pressure of hydrogen is more preferably in the range of 100 to 180 kg/cm$^2$. The hydrogen/oil ratio is preferably in the range of 300 to 5,000 $Nm^3/KL$. A hydrogen/oil ratio less than 300 $Nm^3/KL$ results in failure to sufficiently proceed with the hydrotreatment reaction, whereas that more than 5,000 $Nm^3/KL$ is uneconomical from the viewpoint of equipment design. For the reasons mentioned above, the aforesaid ratio is more preferably in the range of 500 to 1,000 $Nm^3/KL$. The liquid hourly space velocity (LHSV) is preferably in the range of 1.0 to 10.0 $hr^{-1}$. An LHSV less than 1.0 $hr^{-1}$ results in failure to assure sufficient rate of treatment from the economical point of view, whereas that more than 10.0 $hr^{-1}$ causes insufficient reaction time, thereby failing to obtain satisfactory yield of cracked oil. For the reasons mentioned above, the LHSV is more preferably in the range of 0.5 to 2 $hr^{-1}$.

The hydrorefining catalyst to be used in this hydrorefining treatment step is not specifically limited. Examples of usable catalyst include the catalysts same as those exemplified as the hydrodesulfurization catalyst in the foregoing fifth aspect of the invention. The catalyst may be used alone or in combination with at least one other. The reaction system using the catalyst is not specifically limited, but may be selected for use from fixed bed, fluidized bed, moving bed and the like.

After crude oil or crude oil from which naphtha fraction is removed is demetallizingly treated, the treated petroleum is separated, in advance, into gaseous components and liquid hydrocarbons as liquid components, both the components are separately treated, and the resultant treated oils are combined together and is fed in an atmospheric distillation tower, where the combined oil is separated into various products such as naphtha fraction, kerosene fraction, gas oil fraction and residue on atmospheric distillation. The operational conditions for the atmospheric distillation tower, which are almost the same as those for a process for atmospherically distilling crude oil presently prevailing in petroleum refineries, include usually a temperature of about 300 to 380° C. and a pressure of atmospheric pressure to 1.0 $kg/cm^2G$.

By carrying out the foregoing step, following the hydrodesulfurizing and hydrorefining steps, it is made possible to contrive heat recovery and greatly curtail the operational cost. In addition, the construction cost can be curtailed by transferring hydrosulfurized oil to a petroleum refinery located at other place to separate the petroleum products in order to effectively utilize an existing atmospheric distillation tower for crude oil.

According to the sixth aspect of the invention, it is made possible to produce kerosene and gas oil that are favorable and stabilized in quality in increased amounts and to simplify petroleum refinery equipment by assuring intermediate fractions with high degree of saturation through the hydrocracking of residual oil in the collective hydrodesulfurization of crude oil or crude oil from which naphtha fraction is removed.

The seventh aspect of the invention relates to a process for hydrotreating a hydrocarbon oil which comprises the steps of hydrodesulfurizing crude oil or crude oil from which naphtha fraction is removed as the feed oil in the presence of hydrogen by bringing the feed oil into contact with a catalyst; separating the effluent therefrom in a high pressure gas-liquid separating vessel 1 into gaseous components 1 and liquid hydrocarbon components 1; hydrocracking the resultant liquid hydrocarbon components 1 in the presence of hydrogen by bringing them into contact with a catalyst; subsequently combining said gaseous components 1 and the effluent from the hydrocracking step into a combination; and atmospherically distilling the resulting combination to produce hydrocarbon fractions different in a boiling range from each other.

In this process, crude oil may be introduced in a preliminary distillation tower, where the naphtha fraction is removed, and the resulting naphtha-free crude oil may be collectively hydrodesulfurized. When the sulfur content in the naphtha fraction need not be lowered to less than 1 ppm, for example, in the case of applying the naphtha fraction to the raw material for an ethylene production plant, the crude oil as such may be collectively hydrotreated without being fed to the preliminary distillation tower for the removal of the naphtha fraction.

As already described in the description of the first and second aspects of the invention, the crude oil to be fed to a preliminary distillation tower or a hydrotreating step is preferably subjected in advance to desalting treatment. The treatment conditions in the preliminary distillation tower for crude oil are the same as in the first and second aspects of the invention as described hereinbefore.

There is used in the seventh aspect of the invention, crude oil or crude oil from which naphtha fraction is removed, which contains at most 135 ppm by weight of at least one metallic component selected from among vanadium, nickel and iron and at most 12% by weight of asphaltene. The crude oil containing any of the above metallic components in an amount exceeding 135 ppm by weight remarkably shortens the service life of the catalyst owing to the accumulation of the metallic component, while that containing asphaltene in an amount exceeding 12% by weight markedly shortens the service life of the catalyst on account of carbon deposition, whereby both the cases are made unfavorable.

The following reaction conditions are applied to the hydrodesulfurization of the crude oil or crude oil from which naphtha fraction is removed in a hydrodesulfurizing step. First of all, the reaction temperature therein is preferably in the range of 300 to 450° C. A reaction temperature therein lower than 300° C. remarkably lowers the rate of reaction, whereas that higher than 450° C. leads to the formation of carbonaceous solid (coke) on the catalyst, thereby remarkably shortens the service life of the catalyst. For the reasons mentioned above, the reaction temperature therein is more preferably in the range of 360 to 420° C. The reaction pressure, that is, the partial pressure of hydrogen is preferably in the range of 30 to 200 $kg/cm^2$. A reaction pressure therein lower than 30 $kg/cm^2$ remarkably shortens the service life of the catalyst because of the deposition of carbonaceous solid, whereas that higher than 200 $kg/cm^2$ is uneconomical from the viewpoint of equipment design. For the reasons mentioned above, the partial pressure of hydrogen is more preferably in the range of 100 to 180 $kg/cm^2$. The hydrogen/oil ratio is preferably in the range of 300 to 2,000 $Nm^3/KL$. A hydrogen/oil ratio less than 300 $Nm^3/KL$ results in failure to sufficiently proceed with the hydrodesulfurization reaction, whereas that more than 2,000 $Nm^3/KL$ is uneconomical from the viewpoint of equipment design. For the reasons mentioned above, the aforesaid ratio is more preferably in the range of 500 to 1,000 $Nm^3/KL$. The liquid hourly space velocity (LHSV) is preferably in the range of 0.1 to 3.0 $hr^{-1}$. An LHSV less than 0.1 $hr^{-1}$ results in failure to assure sufficient rate of treatment from the economical point of view, whereas that more than 3.0 $hr^{-1}$ causes the defect of an insufficient reaction time, thereby failing to complete the hydrodesulfurization of the feed oil. For the reasons mentioned above, the LHSV is more preferably in the range of 0.2 to 0.8 $hr^{-1}$.

The catalyst to be used in this hydrodesulfurizing step is not specifically limited, but may be selected for use from various catalysts. Examples of preferably usable catalysts include the catalysts same as those exemplified as the hydrodesulfurization catalyst in the above-described fifth aspect of the invention. The catalyst may be used alone or in combination with at least one other.

It is further preferable from the viewpoint of service life of the catalyst in the present invention to divide the catalyst bed into two stages, and simultaneously pack, in the upstream stage, with a catalyst having an average pore diameter of 200 to 5,000 Å, preferably 1,000 to 3,000 Å, and in the downstream stage, with a catalyst having an average pore diameter of about 80 to 120 Å.

The reaction conditions in the case of hydrodesulfurizing crude oil as such are basically the same as those in the case of hydrodesulfurizing crude oil from which naphtha fraction is removed, but it is preferable to increase hydrogen partial pressure and hydrogen/oil ratio within the above-mentioned range to compensate for lowering of the hydrogen partial pressure.

The crude oil which has been subjected to hydrodesulfurization in the above manner is separated into gaseous components 1 and liquid hydrocarbon components 1, and then the latter components are hydrocracked. For the purpose of such gas-liquid separation, there is employed a high-pressure gas-liquid separating vessel for its capability of separation without considerably altering the temperature and pressure of the reaction effluent. The following reaction conditions are applied to the hydrocracking step. First of all, the reaction temperature therein is preferably in the range of 300 to 450° C. A reaction temperature therein lower than 300° C. remarkably lowers the rate of reaction, whereas that higher than 450° C. leads to the progress of overcracking and uneconomically lowers the yield of the intermediate fractions through increase in the yield of gases. For the reasons mentioned above, the reaction temperature therein is more preferably in the range of 360 to 420° C. The reaction pressure, that is, the partial pressure of hydrogen is preferably in the range of 30 to 200 kg/cm$^2$. A reaction pressure therein lower than 30 kg/cm$^2$ results in the deterioration of intermediate fractions characteristics such as hue and smoke point whereas that higher than 200 kg/cm$^2$ is uneconomical from the viewpoint of equipment design. For the reasons mentioned above, the partial pressure of hydrogen is more preferably in the range of 100 to 180 kg/cm$^2$. The hydrogen/oil ratio is preferably in the range of 300 to 2,000 Nm$^3$/KL. A hydrogen/oil ratio less than 300 Nm$^3$/KL results in failure to sufficiently proceed with the reaction and in the deterioration of the characteristics of the product cracked oil, whereas that more than 2,000 Nm$^3$/KL is uneconomical from the viewpoint of equipment design. For the reasons mentioned above, the aforesaid ratio is more preferably in the range of 500 to 1,000 Nm$^3$/KL. The liquid hourly space velocity (LHSV) is preferably in the range of 0.1 to 3.0 hr$^{-1}$. An LHSV less than 0.1 hr$^{-1}$ results in failure to assure sufficient rate of treatment from the economical point of view, whereas that more than 3.0 hr$^{-1}$ causes an insufficient reaction time, thereby failing to achieve sufficient yield of cracked oil. For the reasons mentioned above, the LHSV is more preferably in the range of 0.2 to 0.8 hr$^{-1}$.

Examples of the catalysts usable in the above-mentioned hydrocracking treatment include a publicly known zeolite-based catalyst for cracking residual oil which is described, for example, in Japanese Patent Publication No. 24106/1992, column 3, line 18 through column 6, line 30. There is specifically usable a catalyst comprising at least one metal selected from the metals each belonging to any of the groups 6, 8, 9 and 10 of the Periodic Table which metal is supported on a carrier composed of crystalline aluminosilicate, preferably iron-containing aluminosilicate or a mixture of the same and an inorganic oxide. The above carrier consists preferably of 10 to 90% by weight of iron-containing aluminosilicate and 90 to 10% by weight of an inorganic oxide. A content of iron-containing aluminosilicate in the carrier less than 10% by weight results in failure to sufficiently exert the effect as the hydrocracking catalyst, whereas that more than 90% by weight is economically disadvantageous, since the effect on enhancing hydrocracking activity is not so exhibited as expected considering the amount used. The carrier consists particularly preferably of 30 to 70% by weight of iron-containing aluminosilicate and 70 to 30% by weight of an inorganic oxide.

Examples of the inorganic oxide to be used in the iron-containing aluminosilicate carrier include alumina such as boehmite gel and alumina sol, silica such as silica sol and porous oxide such as silica-alumina. Of these, alumina is preferably usable in particular.

The preparation and properties of the catalyst comprising the iron-containing aluminosilicate as the carrier is detailed in the description of the catalyst (A) in the first and second aspects of the invention.

In this aspect of the invention, the gaseous components 1 separated in the high-pressure gas-liquid separating vessel after the aforestated hydrodesulfurization may be subjected, as necessary, to further hydrorefining treatment under the following conditions.

First of all, the reaction temperature therein is preferably in the range of 300 to 450° C. A reaction temperature therein lower than 300° C. remarkably lowers the rate of reaction, whereas that higher than 450° C. leads to the progress of overcracking, uneconomically lowering the yield of the intermediate fraction products through increase in gas yield. For the reasons mentioned above, the reaction temperature therein is more preferably in the range of 360 to 420° C. The reaction pressure, that is, the partial pressure of hydrogen is preferably in the range of 30 to 200 kg/cm$^2$, more preferably 100 to 180 kg/cm$^2$. Although the pressure at around 30 kg/cm$^2$ is sufficient, it is determined by the reaction conditions in the preceding hydrodesulfurization, since it is economical to feed the gaseous components in the high-pressure gas-liquid separation vessel as such to the reactor. The hydrogen/oil ratio is preferably in the range of 200 to 2,000 Nm$^3$/KL, more preferably 500 to 1,500 Nm$^3$/KL. The above ratio, although sufficient at around 200 Nm$^3$/KL, is determined by the reaction conditions in the preceding hydrodesulfurization, since it is economical to feed the gaseous components in the vessel as such to the reactor. The liquid hourly space velocity (LHSV) is preferably in the range of 0.5 to 8.0 hr$^{-1}$. An LHSV less than 0.5 hr$^{-1}$ results in failure to assure sufficient rate of treatment from the economical point of view, whereas that more than 8.0 hr$^{-1}$ causes an insufficient reaction time, thereby failing to achieve satisfactory yield of cracked oil. For the reasons mentioned above, the LHSV is more preferably in the range of 1.0 to 5.0 hr$^{-1}$.

The hydrorefining catalyst to be used in the hydrorefining treatment is not specifically limited, but may be selected for use from various catalysts, which are typically exemplified by the catalyst (A) in the first and second aspects of the invention; at least one metal selected from the metals each belonging to any of the groups 6, 8, 9 and 10 of the Periodic table which metal is supported on a carrier such as alumina, silica or the like as is the case with the catalyst (A); and the catalysts same as those to be used in the above-mentioned hydrodesulfurization and hydrocracking.

Such hydrorefining catalyst preferably has an average pore diameter of 20 to 60 Å. An average pore diameter thereof smaller than 20 Å results in failure to sufficiently proceed with the reaction on account of unreasonably high diffusion resistance inside the catalyst, whereas that larger than 60 Å causes smaller specific surface area, thereby failing to achieve sufficient rate of reaction.

In this aspect of the invention, there is preferably used a process in which the effluent from the hydrocracking treating step is separated into gaseous components 2 and liquid hydrocarbon components 2 in the high-pressure gas-liquid separating vessel; the combination of the aforesaid gaseous components 2 and the gaseous components 1 from the high-pressure gas-liquid separating vessel 1 in the above-mentioned hydrodesulfurization step is brought into contact with the hydrorefining catalyst under the conditions including 30 to 200 kg/cm$^2$ pressure, 300 to 450° C. temperature, 0.5 to 8.0 hr$^{-1}$ LHSV and 200 to 2,000 Nm$^3$/KL hydrogen/oil ratio; and the combination of the gaseous components thus contacted and the above liquid hydrocarbon components 2 is subjected to atmospheric distillation. Such process brings about the advantage of improvements in the smoke point of kerosene, the hue of gas oil, cetane index of the same and the like.

In the atmospheric distillation tower according to the invention, the combined oil is separated into various products such as naphtha fraction, kerosene fraction, gas oil fraction and residue on atmospheric distillation. The operational conditions for the atmospheric distillation tower, which are almost the same as those for a process for atmospherically distilling crude oil presently prevailing in petroleum refineries, include usually a temperature of about 300 to 380° C. and a pressure of atmospheric pressure to 1.0 kg/cm$^2$G.

By carrying out the foregoing step, following each hydrotreating step, it is made possible to contrive heat recovery and greatly curtail the operational cost. In addition, the construction cost can be curtailed by transferring hydrosulfurized oil to a petroleum refinery located at other place to separate the petroleum products in order to effectively utilize an existing atmospheric distillation tower for crude petroleum.

According to the seventh aspect of the invention, it is made possible to effectively carry out hydroreforming of kerosene and gas oil in combination with the hydrocracking of residual oil, produce kerosene and gas oil that are favorable and stabilized in quality in increased amounts and to simplify petroleum refinery equipment by assuring intermediate fractions with high degree of saturation through the hydrocracking of residual oil in the collective hydrodesulfurization of crude oil or crude oil from which naphtha fraction is removed.

Lastly the eighth aspect of the invention provides a fuel oil composition having specific characteristics which can be produced through the method of the present invention (the first to seventh aspects).

The fuel oil composition according to the present invention is required to have a boiling point range at atmospheric pressure of 215 to 380° C. as distillation characteristics. A fraction having a boiling point lower than 215° C., when contained in a large amount, brings about such disadvantage as limited usage in summer, and a fraction having a boiling point higher than 380° C., when contained in a large amount, causes the problem that particulate substances in exhaust gas increase. For the reasons mentioned above, the composition preferably contains a fraction with 220 to 375 boiling point range in a proportion of at least 50% by weight, preferably 60 to 100% by weight. Within the aforesaid preferable range, hue-worsening substances decrease, thus advantageously attain an object of the present invention.

In addition, sulfur content therein is at most 0.03% by weight, preferably at most 0.02% by weight. A sulfur content more than 0.03% by weight causes the problem that the prospective use of this composition as a fuel oil in a Diesel engine can not meet the future regulation and the catalyst for the treatment of exhaust gas is deteriorated, thus failing to attain the object of the present invention. The above preferable range of 0.02% or lower by weight is favorable for attaining an object of the present invention.

Moreover, the ASTM color of the composition is at most 0.8, preferably at most 0.7. A hue thereof more than 0.8 involves a fear of causing practical problems.

Next, the composition is required to have a content of bicyclic aromatic components of at most 5% by volume. A content thereof more than 5% by volume involves a fear of worsening the hue. The preferable content thereof from the aspect of hue is at most 4% by volume. The bicyclic aromatic components signify, for example, naphthalene, biphenyl and derivatives thereof.

Further, the composition is required to have a content of tricyclic aromatic components of at most 0.5% by volume. A content thereof more than 0.5% by volume involves a fear of worsening the hue. The preferable content thereof from the aspect of hue is at most 0.4% by volume. The tricyclic components signify, for example, benzanthracene, perillene, benzofluoranthene,benzopyrene and derivatives thereof.

Furthermore, the composition is required to indicate at least 30% in the transmission factor at 440 nm of the visible spectrum of the extract therefrom into N,N-dimethylformamide. A transmission factor thereof less than 30% tends to remarkably worsen the hue of the composition. The preferable transmission factor thereof from the aspect of hue is at least 35%. The methods for extraction with N,N-dimethylformamide and for determination are described in the under-mentioned working examples.

The fuel oil composition having the above-mentioned specific characteristics can easily be produced by any of the hydrotreating methods for a hydrocarbon oil in the first to seventh aspects of the present invention.

The fuel oil composition according to this aspect of the invention is minimized in sulfur content and excellent in hue, thus making itself well suited for use, for example, as a fuel oil in a Diesel engine.

In the following, the present invention will be described in more detail with reference to examples, which however, shall never limit the present invention thereto.

EXAMPLE 1

There was used, as the feed oil, an Arabian heavy crude oil which had been desalted and from which naphtha fraction (C5 to 157° C.) had been removed. The properties of the feed oil are as follows.

| | | |
|---|---|---|
| Density (15° C.) | 0.9319 | g/cm$^3$ |
| Sulfur | 3.24% | by weight |
| Nitrogen | 1500 | ppm by weight |
| Vanadium | 55 | ppm by weight |
| Nickel | 18 | ppm by weight |
| Kerosene fraction (>157° C., ≦239° C.) | 9.8% | by weight |
| Gas oil fraction (>239° C., ≦370° C.) | 25.8% | by weight |
| Residue (>370° C.) | 64.4% | by weight |

Then the catalyst composition consisting of 20% by volume of the catalyst A (demetallization catalyst available on the market) and 80% by volume of the catalyst B which catalysts are shown in Table 1 was packed in that order in a 1000 milliliter (mL) tubular reactor. Subsequently the feed petroleum was subjected to hydrotreatment by passing itself through the reactor under the reaction conditions including a hydrogen partial pressure of 130 kg/cm$^2$, a hydrogen/oil ratio of 800 Nm$^3$/KL, a reaction temperature of 380° C. and an LHSV of 0.4 hr$^{-1}$.

The hydrotreated petroleum thus obtained was fractionated into naphtha fraction (C5 to ≦157° C. boiling range), kerosene fraction (>157° C. to ≦239° C. boiling range), gas oil fraction (≧239° C. to ≦370° C. boiling range) and residue (>370° C. boiling range), and evaluations were made of the properties of the fractions thus obtained. The results are given in Table 2.

In addition, storage stability tests were made of the kerosene fraction and the gas oil fraction by a specific method in which 400 mL of sample was placed in a 500 mL glass vessel with a vent, which was stored in a dark place kept at 43° C. for 30 days, and the results before and after the storage stability test were evaluated. The results are given in Table 3.

It can be seen from Table 3 that high-quality kerosene and gas oil each having stabilized hue on storage can be produced from the residue formed by removing naphtha fraction from desalted Arabian heavy crude oil.

EXAMPLE 2

The procedure in Example 1 was repeated to carry out the hydrotreatment of the feed oil except that the catalyst composition as shown in Table 1 consisting of 20% by volume of the catalyst A (demetallization catalyst available on the market), 30% by volume of the catalyst C and 50% by volume of the catalyst B was packed in that order in a 2000 mL tubular reactor and that the reaction temperature was altered to 390° C.

The hydrotreated petroleum thus obtained was fractionated in the same manner as in Example 1, and evaluations were made of the properties of the fractions thus obtained. The results are given in Table 2. In addition, storage stability tests were made of the kerosene fraction and gas oil fraction in the same manner as in Example 1. The results are given in Table 3.

It can be seen from Table 3 that high quality kerosene and gas oil each having stabilized hue on storage can be produced in increased quantity from Arabian heavy crude oil which had been desalted and from which naphtha fraction had been removed.

EXAMPLE 3

The procedure in Example 1 was repeated to carry out the hydrotreatment of the feed oil except that the catalyst composition as shown in Table 1 consisting of 20% by volume of the catalyst A (demetallization catalyst available on the market) and 80% by volume of the catalyst C was packed in that order in a 1000 mL tubular reactor and that the reaction temperature was altered to 400° C.

The hydrotreated petroleum thus obtained was fractionated in the same manner as in Example 1, and evaluations were made of the properties of the fractions thus obtained. The results are given in Table 2. In addition, storage stability tests were made of the kerosene fraction and gas oil fraction in the same manner as in Example 1. The results are given in Table 3.

It can be seen from Table 3 that high quality kerosene and gas oil each having stabilized hue on storage can be produced in increased quantity from Arabian heavy crude oil which had been desalted and from which naphtha fraction had been removed.

EXAMPLE 4

There was used, as the feed oil, an Arabian light crude oil which had been desalted. The properties of the feed oil are as follows.

| | |
|---|---|
| Density (15° C.) | 0.8639 g/cm$^3$ |
| Sulfur | 1.93% by weight |
| Nitrogen | 850 ppm by weight |
| Vanadium | 18 ppm by weight |
| Nickel | 5 ppm by weight |
| Naphtha fraction (C5 to 157° C.) | 14.7% by weight |
| Kerosene fraction (>157° C., ≦239° C.) | 14.2% by weight |
| Gas oil fraction (>239° C., ≦370° C.) | 25.6% by weight |
| Residue (>370° C.) | 45.5% by weight |

The procedure in Example 1 was repeated to carry out the hydrotreatment of the feed oil except that the reaction conditions were altered to those including a hydrogen partial pressure of 120 kg/cm$^2$, a reaction temperature of 395° C., and an LHSV of 0.35 hr$^{-1}$.

The hydrotreated petroleum thus obtained was fractionated in the same manner as in Example 1, and evaluations were made of the properties of the fractions thus obtained. The results are given in Table 2. In addition, storage stability tests were made of the kerosene fraction and gas oil fraction in the same manner as in Example 1. The results are given in Table 3.

It can be seen from Table 3 that high quality kerosene and gas oil each having stabilized hue on storage can be produced from Arabian light crude oil which had been desalted.

Comparative Example 1

The procedure in Example 1 was repeated to carry out the hydrotreatment of the feed oil except that the catalyst composition as shown in Table 1 consisting of 20% by volume of the catalyst A (demetallization catalyst available on the market) and 80% by volume of the catalyst D was packed in that order in a 1000 mL tubular reactor.

The hydrotreated petroleum thus obtained was fractionated in the same manner as in Example 1, and evaluations were made of the properties of the fractions thus obtained. The results are given in Table 2. In addition, storage stability tests were made of the kerosene fraction and gas oil fraction in the same manner as in Example 1. The results are given in Table 3.

It can be seen from Table 3 that the kerosene and gas oil obtained from Arabian heavy crude oil which had been desalted and from which naphtha fraction had been removed are unsatisfactory in quality, yield and hue on storage.

Comparative Example 2

The procedure in Example 4 was repeated to carry out the hydrotreatment of the feed oil except that the catalyst composition as shown in Table 1 consisting of 20% by volume of the catalyst A (demetallization catalyst available on the market) and 80% by volume of the catalyst D was packed in that order in a 1000 mL tubular reactor.

The hydrotreated petroleum thus obtained was fractionated in the same manner as in Example 1, and evaluations were made of the properties of the fractions thus obtained. The results are given in Table 2. In addition, storage stability tests were made of the kerosene fraction and gas oil fraction in the same manner as in Example 1. The results are given in Table 3.

It can be seen from Table 3 that the kerosene and gas oil obtained from Arabian heavy crude oil which had been desalted and from which naphtha fraction had been removed are unsatisfactory in quality, yield and hue on storage.

TABLE 1

| | Catalyst | Catalyst A | Catalyst B | Catalyst C | Catalyst D |
|---|---|---|---|---|---|
| Carrier | Composition, wt. % based on carrier | | | | |
| | alumina | 100 | 90 | 35 | 100 |
| | boria | — | 10 | — | — |
| | iron-containing aluminosilicate | — | — | 65 | — |
| | boron dispersibility, found/theoretical (%) | — | 91.9 | — | — |
| | Physical properties of iron-containing aluminosilicate | | | | |
| | $Fe_2O_3/SiO_2$ (molar ratio) | — | — | 0.031 | — |
| | $SiO_2/Al_2O_3$ (molar ratio) | — | — | 22.3 | — |
| | lattice constant (Å) | — | — | 24.32 | — |
| | content of inert iron on TPR(%) | — | — | 1.0 | — |
| | peak temperature in high temp. side on TPR(° C.) | — | — | 996 | — |
| Catalyst | Composition, wt. % based on catalyst | | | | |
| | nickel oxide | 2.5 | — | — | 3.7 |
| | molybdenum oxide | 8.0 | 14.0 | 10.0 | 12.1 |
| | cobalt oxide | — | 3.7 | 4.0 | — |
| | Specific surface area ($m^2/g$) | 220 | 228 | 445 | 220 |
| | Pore volume (ml/g) | 0.60 | 0.71 | 0.62 | 0.60 |
| | Average pore diameter (Å) | 118 | 124 | 158 | 110 |

Catalyst A: Demetallization catalyst available on the market
Catalysts B, C and D: Desulfurization catalyst available on the market

TABLE 2-1

| | Feed oil composition (wt. %) | Product composition (wt. %) | Density 15° C. ($g/cm^3$) | Sulfur content (wt. %) | Nitrogen content (wt. ppm) |
|---|---|---|---|---|---|
| Example 1 | | | | | |
| Naphtha fraction | 0 | 1.0 | 0.7537 | 0.005 | 1> |
| Kerosene fraction | 9.8 | 12.0 | 0.7951 | 0.002 | 6 |
| Gas oil fraction | 25.8 | 29.0 | 0.8475 | 0.01 | 43 |
| Residue | 64.4 | 55.0 | 0.9298 | 0.48 | 1100 |
| Example 2 | | | | | |
| Naphtha fraction | 0 | 5.3 | 0.7418 | 0.01 | 1> |
| Kerosene fraction | 9.8 | 15.0 | 0.8027 | 0.002 | 5 |
| Gas oil fraction | 25.8 | 27.5 | 0.8391 | 0.01 | 35 |
| Residue | 64.4 | 44.8 | 0.9342 | 0.64 | 1700 |
| Example 3 | | | | | |
| Naphtha fraction | 0 | 10.2 | 0.7355 | 0.030 | 1> |
| Kerosene fraction | 9.8 | 22.2 | 0.8031 | 0.006 | 7 |

TABLE 2-1-continued

| | Feed oil composition (wt. %) | Product composition (wt. %) | Density 15° C. ($g/cm^3$) | Sulfur content (wt. %) | Nitrogen content (wt. ppm) |
|---|---|---|---|---|---|
| Gas oil fraction | 25.8 | 24.1 | 0.8330 | 0.05 | 50 |
| Residue | 64.4 | 35.0 | 0.9335 | 1.10 | 2000 |
| Example 4 | | | | | |
| Naphtha fraction | 14.7 | 15.3 | 0.7282 | 0.002 | 1> |
| Kerosene fraction | 14.2 | 16.7 | 0.7958 | 0.001 | 5 |
| Gas oil fraction | 25.6 | 27.9 | 0.8463 | 0.02 | 79 |
| Residue | 45.5 | 33.6 | 0.9145 | 0.21 | 800 |
| Comparative Example 1 | | | | | |
| Naphtha fraction | 0 | 1.2 | 0.7656 | 0.009 | 1> |
| Kerosene fraction | 9.8 | 12.1 | 0.7969 | 0.002 | 13 |
| Gas oil fraction | 25.8 | 27.1 | 0.8483 | 0.05 | 130 |
| Residue | 64.4 | 57.6 | 0.9353 | 0.55 | 1700 |
| Comparative Example 2 | | | | | |
| Naphtha fraction | 14.7 | 15.2 | 0.7240 | 0.005 | 1> |
| Kerosene fraction | 14.2 | 16.8 | 0.7888 | 0.001 | 11 |
| Gas oil fraction | 25.6 | 26.1 | 0.8456 | 0.04 | 120 |
| Residue | 45.5 | 35.1 | 0.9198 | 0.30 | 1300 |

TABLE 2-2

| | Smoke point (mm) | Cetane Index | Carbon residue (wt. %) | Vanadium content (wt. ppm) | Nickel content (wt. ppm) |
|---|---|---|---|---|---|
| Example 1 | | | | | |
| Naphtha fraction | — | — | — | — | — |
| Kerosene fraction | 23.5 | — | — | — | — |
| Gas oil fraction | — | 59 | — | — | — |
| Residue | — | — | 6.1 | 25 | 11 |
| Example 2 | | | | | |
| Naphtha fraction | — | — | — | — | — |
| Kerosene fraction | 21.0 | — | — | — | — |
| Gas oil fraction | — | 60 | — | — | — |
| Residue | — | — | 8.3 | 14 | 8 |
| Example 3 | | | | | |
| Naphtha fraction | — | — | — | — | — |
| Kerosene fraction | 20.0 | — | — | — | — |
| Gas oil fraction | — | 60 | — | — | — |
| Residue | — | — | 8.9 | 9 | 5 |
| Example 4 | | | | | |
| Naphtha fraction | — | — | — | — | — |
| Kerosene | 22.0 | — | — | — | — |

TABLE 2-2-continued

| | Smoke point (mm) | Cetane Index | Carbon residue (wt. %) | Vanadium content (wt. ppm) | Nickel content (wt. ppm) |
|---|---|---|---|---|---|
| fraction | | | | | |
| Gas oil fraction | — | 60 | — | — | — |
| Residue | — | — | 4.2 | 6 | 4 |
| Comparative Example 1 | | | | | |
| Naphtha fraction | — | — | — | — | — |
| Kerosene fraction | 23.0 | — | — | — | — |
| Gas oil fraction | — | 59 | — | — | — |
| Residue | — | — | 7.6 | 29 | 13 |
| Comparative Example 2 | | | | | |
| Naphtha fraction | — | — | — | — | — |
| Kerosene fraction | 22.5 | — | — | — | — |
| Gas oil fraction | — | 59 | — | — | — |
| Residue | — | — | 4.4 | 8 | 4 |

TABLE 3

| | Kerosene fraction | | Gas oil fraction | |
|---|---|---|---|---|
| | Hue before storage | Hue after storage | Hue before storage | Hue after storage |
| Example 1 | Saybolt color +30 | Saybolt color +28 | ASTM color 0.4 | ASTM color 0.5 |
| Example 2 | Saybolt color +30 | Saybolt color +29 | ASTM color 0.4 | ASTM color 0.5 |
| Example 3 | Saybolt color +30 | Saybolt color +29 | ASTM color 0.4 | ASTM color 0.5 |
| Example 4 | Saybolt color +30 | Saybolt color +29 | ASTM color 0.5 | ASTM color 0.6 |
| Comparative Example 1 | Saybolt color +30 | Saybolt color +23 | ASTM color 0.5 | ASTM color 0.9 |
| Comparative Example 2 | Saybolt color +30 | Saybolt color +24 | ASTM color 0.6 | ASTM color 0.9 |

EXAMPLE 5

Hydrotreatment of the feed oil same as in Example 1 was performed by the use of the catalyst composition as shown in Table 4 consisting of 20% by volume of the catalyst A (demetallization catalyst available on the market) and 80% by volume of the catalyst B (alumina/phosphorus based catalyst) which was packed in that order in a 1000 mL tubular reaction under the reaction conditions including a reaction temperature of 380° C., a hydrogen partial pressure of 130 kg/cm$^2$, a hydrogen/oil ratio of 800 Nm$^3$/KL and an LHSV of 0.4 hr$^{-1}$.

The hydrotreated petroleum thus obtained was fractionated in the same manner as in Example 1, and evaluations were made of the properties of the fractions thus obtained. The results are given in Table 5. In addition, storage stability tests were made of the kerosene fraction and gas oil fraction in the same manner as in Example 1. The results are given in Table 6.

It can be seen from Tables 5 & 6 that high quality kerosene and gas oil each having stabilized hue on storage can be produced from Arabian heavy crude oil which had been desalted and from which naphtha fraction had been removed by virtue of using the alumina/phosphorus based catalyst.

EXAMPLE 6

The procedure in Example 5 was repeated to carry out the hydrotreatment of the feed oil except that the feed oil same as in Example 4 was used and the reaction conditions were altered to those including a reaction temperature of 395° C., a hydrogen partial pressure of 120 kg/cm$^2$, an LHSV of 0.35 hr$^{-1}$.

The hydrotreated petroleum thus obtained was fractionated in the same manner as in Example 1, and evaluations were made of the properties of the fractions thus obtained. The results are given in Table 5. In addition, storage stability tests were made of the kerosene fraction and gas oil fraction in the same manner as in Example 1. The results are given in Table 6.

It can be seen from Tables 5 & 6 that high quality kerosene and gas oil each having stabilized hue on storage can be produced from Arabian heavy crude oil which had been desalted and from which naphtha fraction had been removed by virtue of using the alumina/phosphorus based catalyst.

EXAMPLE 7

The procedure in Example 5 was repeated to carry out the hydrotreatment of the feed oil except that the catalyst composition as shown in Table 4 consisting of 20% by volume of the catalyst A (demetallization catalyst available on the market) and 80% by volume of the catalyst C (alumina/magnesia based catalyst) was packed in that order in a 1000 mL tubular reactor.

The hydrotreated petroleum thus obtained was fractionated in the same manner as in Example 1, and evaluations were made of the properties of the fractions thus obtained. The results are given in Table 5. In addition, storage stability tests were made of the kerosene fraction and gas oil fraction in the same manner as in Example 1. The results are given in Table 6.

It can be seen from Tables 5 & 6 that high quality kerosene and gas oil each having stabilized hue on storage can be produced in increased quantity from Arabian heavy crude oil which had been desalted and from which naphtha fraction had been removed by virtue of using the alumina/magnesia based catalyst.

EXAMPLE 8

The procedure in Example 5 was repeated to carry out the hydrotreatment of the feed oil except that the catalyst composition as shown in Table 4 consisting of 20% by volume of the catalyst A (demetallization catalyst available on the market) and 80% by volume of the catalyst D (alumina/calcia based catalyst) was packed in that order in a 1000 mL tubular reactor.

The hydrotreated petroleum thus obtained was fractionated in the same manner as in Example 1, and evaluations were made of the properties of the fractions thus obtained. The results are given in Table 5. In addition, storage stability tests were made of the kerosene fraction and gas oil fraction in the same manner as in Example 1. The results are given in Table 6.

It can be seen from Tables 5 & 6 that high quality kerosene and gas oil each having stabilized hue on storage can be produced in increased quantity from Arabian heavy crude oil which had been desalted and from which naphtha fraction had been removed by virtue of using the alumina/calcia based catalyst.

EXAMPLE 9

The procedure in Example 5 was repeated to carry out the hydrotreatment of the feed oil except that the catalyst composition as shown in Table 4 consisting of 20% by volume of the catalyst A (demetallization catalyst available on the market) and 80% by volume of the catalyst E (alumina/titania based catalyst) was packed in that order in a 1000 mL tubular reactor.

The hydrotreated petroleum thus obtained was fractionated in the same manner as in Example 1, and evaluations were made of the properties of the fractions thus obtained. The results are given in Table 5. In addition, storage stability tests were made of the kerosene fraction and gas oil fraction in the same manner as in Example 1. The results are given in Table 6.

It can be seen from Tables 5 & 6 that high quality kerosene and gas oil each having stabilized hue on storage can be produced in increased quantity from Arabian heavy crude oil which had been desalted and from which naphtha fraction had been removed by virtue of using the alumina/titania based catalyst.

EXAMPLE 10

The procedure in Example 5 was repeated to carry out the hydrotreatment of the feed oil except that the catalyst composition as shown in Table 4 consisting of 20% by volume of the catalyst A (demetallization catalyst available on the market) and 80% by volume of the catalyst F (alumina/zirconia based catalyst) was packed in that order in a 1000 mL tubular reactor.

The hydrotreated petroleum thus obtained was fractionated in the same manner as in Example 1, and evaluations were made of the properties of the fractions thus obtained. The results are given in Table 5. In addition, storage stability tests were made of the kerosene fraction and gas oil fraction in the same manner as in Example 1. The results are given in Table 6.

It can be seen from Tables 5 & 6 that high quality kerosene and gas oil each having stabilized hue on storage can be produced in increased quantity from Arabian heavy crude oil which had been desalted and from which naphtha fraction had been removed by virtue of using the alumina/zirconia based catalyst.

TABLE 4

| Catalyst | A | B | C | D | E | F |
|---|---|---|---|---|---|---|
| Carrier | | | | | | |
| Composition, wt. % based on carrier | | | | | | |
| Alumina | 100 | 94.5 | 90.0 | 90.0 | 89.8 | 89.5 |
| Phosphorus oxide | — | 5.5 | — | — | — | — |
| Magnesia | — | — | 10.0 | — | — | — |
| Titania | — | — | — | — | 10.2 | — |
| Zirconia | — | — | — | — | — | 10.5 |
| Calcia | — | — | — | 10.0 | — | — |
| Dispersibility found/theoretical (%) | — | 90 | 68 | 87 | 89 | 86 |

TABLE 4-continued

| Catalyst | A | B | C | D | E | F |
|---|---|---|---|---|---|---|
| Catalyst | | | | | | |
| Composition, wt. % based on catalyst | | | | | | |
| Nickel oxide | 2.5 | 3.7 | 3.8 | 3.7 | 3.7 | 3.8 |
| Molybdenum oxide | 8.0 | 12.0 | 12.1 | 12.0 | 12.1 | 12.0 |
| Specific surface area ($m^2/g$) | 200 | 222 | 218 | 220 | 222 | 232 |
| Pore volume (ml/g) | 0.60 | 0.64 | 0.65 | 0.63 | 0.60 | 0.59 |
| Average pore diameter (A) | 118 | 104 | 105 | 104 | 95 | 96 |

Catalyst A: Demetallization catalyst
Catalysts B, C, D, E and F: Desulfurization catalyst

TABLE 5-1

| | Feed oil composition (wt. %) | Product composition (wt. %) | Density 15° C. ($g/cm^3$) | Sulfur content (wt. %) | Nitrogen content (wt. ppm) |
|---|---|---|---|---|---|
| Example 5 | | | | | |
| Naphtha fraction | 0 | 1.2 | 0.7538 | 0.004 | 1> |
| Kerosene fraction | 9.8 | 12.5 | 0.7950 | 0.002 | 11 |
| Gas oil fraction | 25.8 | 28.9 | 0.8477 | 0.01 | 50 |
| Residue | 64.4 | 55.2 | 0.9300 | 0.46 | 1220 |
| Example 6 | | | | | |
| Naphtha fraction | 14.7 | 15.5 | 0.7280 | 0.001 | 1> |
| Kerosene fraction | 14.2 | 16.9 | 0.7955 | 0.001 | 9 |
| Gas oil fraction | 25.6 | 27.7 | 0.8465 | 0.02 | 68 |
| Residue | 45.5 | 44.4 | 0.9144 | 0.20 | 960 |
| Example 7 | | | | | |
| Naphtha fraction | 0 | 1.0 | 0.7533 | 0.003 | 1> |
| Kerosene fraction | 9.8 | 11.0 | 0.7940 | 0.003 | 10 |
| Gas oii fraction | 25.8 | 30.9 | 0.8478 | 0.02 | 45 |
| Residue | 64.4 | 56.1 | 0.9305 | 0.42 | 1210 |
| Example 8 | | | | | |
| Naphtha fraction | 0 | 1.0 | 0.7532 | 0.003 | 1> |
| Kerosene fraction | 9.8 | 11.0 | 0.7940 | 0.003 | 11 |
| Gas oil fraction | 25.8 | 30.7 | 0.8476 | 0.02 | 46 |
| Residue | 64.4 | 56.0 | 0.9307 | 0.44 | 1205 |
| Example 9 | | | | | |
| Naphtha fraction | 0 | 1.2 | 0.7538 | 0.004 | 1> |
| Kerosene fraction | 9.8 | 12.3 | 0.7948 | 0.002 | 11 |
| Gas oil fraction | 25.8 | 28.7 | 0.8475 | 0.02 | 50 |
| Residue | 64.4 | 56.1 | 0.9310 | 0.43 | 1120 |
| Example 10 | | | | | |
| Naphtha fraction | 0 | 1.2 | 0.7533 | 0.003 | 1> |
| Kerosene fraction | 9.8 | 12.7 | 0.7954 | 0.002 | 11 |
| Gas oil fraction | 25.6 | 28.7 | 0.8474 | 0.02 | 50 |
| Residue | 64.4 | 56.5 | 0.9308 | 0.44 | 1120 |

TABLE 5-2

| | Smoke point (mm) | Cetane Index | Carbon residue (wt. %) | Vanadium content (wt. ppm) | Nickel content (wt. ppm) |
|---|---|---|---|---|---|
| Example 5 | | | | | |
| Naphtha fraction | — | — | — | — | — |
| Kerosene fraction | 23.5 | — | — | — | — |
| Gas oil fraction | — | 60 | — | — | — |
| Residue | — | — | 6.0 | 23 | 10 |
| Example 6 | | | | | |
| Naphtha fraction | — | — | — | — | — |
| Kerosene fraction | 23.0 | — | — | — | — |
| Gas oil fraction | — | 61 | — | — | — |
| Residue | — | — | 4.3 | 8 | 4 |
| Example 7 | | | | | |
| Naphtha fraction | — | — | — | — | — |
| Kerosene fraction | 23.5 | — | — | — | — |
| Gas oil fraction | — | 60 | — | — | — |
| Residue | — | — | 5.4 | 22 | 10 |
| Example 8 | | | | | |
| Naphtha fraction | — | — | — | — | — |
| Kerosene fraction | 23.5 | — | — | — | — |
| Gas oil fraction | — | 61 | — | — | — |
| Residue | — | — | 5.2 | 22 | 11 |
| Example 9 | | | | | |
| Naphtha fraction | — | — | — | — | — |
| Kerosene fraction | 23.0 | — | — | — | — |
| Gas oil fraction | — | 59 | — | — | — |
| Residue | — | — | 5.8 | 25 | 12 |
| Example 10 | | | | | |
| Naphtha fraction | — | — | — | — | — |
| Kerosene fraction | 23.5 | — | — | — | — |
| Gas oil fraction | — | 60 | — | — | — |
| Residue | — | — | 6.0 | 23 | 12 |

TABLE 6

| | Kerosene fraction | | Gas oil fraction | |
|---|---|---|---|---|
| | Hue before storage | Hue after storage | Hue before storage | Hue after storage |
| Example 5 | Saybolt color +30 | Saybolt color +28 | ASTM color 0.4 | ASTM color 0.6 |
| Example 6 | Saybolt color +30 | Saybolt color +29 | ASTM color 0.4 | ASTM color 0.5 |
| Example 7 | Saybolt color +30 | Saybolt color +29 | ASTM color 0.4 | ASTM color 0.6 |
| Example 8 | Saybolt color +30 | Saybolt color +28 | ASTM color 0.4 | ASTM color 0.5 |

TABLE 6-continued

| | Kerosene fraction | | Gas oil fraction | |
|---|---|---|---|---|
| | Hue before storage | Hue after storage | Hue before storage | Hue after storage |
| Example 9 | Saybolt color +30 | Saybolt color +28 | ASTM color 0.4 | ASTM color 0.6 |
| Example 10 | Saybolt color +30 | Saybolt color +29 | ASTM color 0.4 | ASTM color 0.5 |

EXAMPLE 11

There was used, as the feed oil, an Arabian light crude oil which had been desalted. The properties of the feed oil are as follows.

| | | |
|---|---|---|
| Density (15° C.) | 0.8639 | g/cm$^3$ |
| Sulfur | 1.93% | by weight |
| Nitrogen | 850 | ppm by weight |
| Vanadium | 18 | ppm by weight |
| Nickel | 5 | ppm by weight |
| Asphaltene | 1.0% | by weight |
| Naphtha fraction (C5 to 157° C.) | 14.7% | by weight |
| Kerosene fraction (>157° C., ≦239° C.) | 14.2% | by weight |
| Gas oil fraction (>239° C., ≦370° C.) | 25.6% | by weight |
| Residue (>370° C.) | 45.5% | by weight |

Then the catalyst composition consisting of 30% by volume of the catalyst A, 40% by volume of the catalyst B and 30% by volume of the catalyst A which catalysts are shown in Table 7 and supported on alumina carrier, was packed in that order in a 1000 mL tubular reactor. Subsequently the feed oil was subjected to hydrotreatment by passing itself through the tubular reactor under the reaction conditions including a hydrogen partial pressure of 135 kg/cm$^2$, a hydrogen/oil ratio of 1000 Nm$^3$/KL and a LHSV of 0.4 hr$^{-1}$, while the reaction temperature was raised so that the content of sulfur in the product petroleum was maintained at 0.30% or less by weight even if the catalyst performance was deteriorated. The reaction temperature was 385° C. after 100 days from the start of the reaction. Thereafter the flow direction of the feed oil was reversed. Thus the reaction temperature was as high as 395° C. after the elapse of further 50 days therefrom.

EXAMPLE 12

There was used, as the feed oil, an Arabian heavy crude oil which had been desalted and from which naphtha fraction (C5 to 157° C.) had been removed. The properties of original crude oil are as follows.

| | | |
|---|---|---|
| Density (15° C.) | 0.9319 | g/cm$^3$ |
| Sulfur | 3.24% | by weight |
| Nitrogen | 1500 | ppm by weight |
| Vanadium | 55 | ppm by weight |
| Nickel | 18 | ppm by weight |
| Asphaltene | 5.01% | by weight |
| Naphtha fraction (C5 to 157° C.) | 9.8% | by weight |
| Kerosene fraction (>157° C., ≦239° C.) | 25.8% | by weight |
| Gas oil fraction (>239° C., ≦370° C.) | 25.6% | by weight |
| Residue (>370° C.) | 64.4% | by weight |

Then the catalyst composition consisting of 30% by volume of the catalyst A, 40% by volume of the catalyst B and 30% by volume of the catalyst A which catalysts are shown in Table 7 and supported on alumina carrier, was packed in that order in a 1000 mL tubular reactor. Subsequently the feed oil was subjected to hydrotreatment by passing itself through the tubular reactor under the reaction conditions including a hydrogen partial pressure of 135 kg/cm$^2$, a hydrogen/oil ratio of 1000 Nm$^3$/KL and a LHSV of 0.3 hr$^{-1}$, while the reaction temperature was raised so that the content of sulfur in the product petroleum was maintained at 0.50% or less by weight even if the catalyst performance was deteriorated. The reaction temperature was 389° C. after 100 days from the start of the reaction. Thereafter the flow direction of the feed oil was reversed. Thus the reaction temperature was as high as 399° C. after the elapse of further 50 days therefrom.

EXAMPLE 13

There was used, as the feed oilan Arabian heavy crude oil-based residue on atmospheric distillation. The properties of the feed oil are as follows.

| | | |
|---|---|---|
| Density (15° C.) | 0.9798 | g/cm$^3$ |
| Sulfur | 4.13% | by weight |
| Nitrogen | 2500 | ppm by weight |
| Vanadium | 85 | ppm by weight |
| Nickel | 26 | ppm by weight |
| Asphaltene | 8.0% | by weight |
| Residue (>370° C.) | 93.4% | by weight |

Then the catalyst composition consisting of 30% by volume of the catalyst A, 40% by volume of the catalyst B and 30% by volume of the catalyst A which catalysts are shown in Table 7 and supported on alumina carrier, was packed in that order in a 1000 mL tubular reactor. Subsequently the feed oil was subjected to hydrotreatment by passing itself through the tubular reactor under the reaction conditions including a hydrogen partial pressure of 135 kg/cm$^2$, a hydrogen/oil ratio of 1000 Nm$^3$/KL and a LHSV of 0.25 hr$^{-1}$, while the reaction temperature was raised so that the content of sulfur in the product petroleum was maintained at 0.50% or less by weight even if the catalyst performance was deteriorated. The reaction temperature was 392° C. after 100 days from the start of the reaction. Thereafter the flow direction of the feed oil was reversed. Thus the reaction temperature was as high as 402° C. after the elapse of further 50 days therefrom.

EXAMPLE 14

The procedure in Example 11 was repeated to carry out the hydrotreatment of the feed oil except that the catalyst C as shown in Table 7 was employed in place of the catalyst B. As a result, the reaction temperature was 378° C. after 100 days from the start of the reaction. Thereafter the flow direction of the feed oil was reversed. Thus the reaction temperature was as high as 385° C. after the elapse of further 50 days therefrom.

EXAMPLE 15

The procedure in Example 11 was repeated to carry out the hydrotreatment of the feed oil except that the catalyst D as shown in Table 7 was employed in place of the catalyst B. As a result, the reaction temperature was 380° C. after 100 days from the start of the reaction. Thereafter the flow direction of the feed oil was reversed. Thus the reaction temperature was as high as 387° C. after the elapse of further 50 days therefrom.

Comparative Example 3

The procedure in Example 11 was repeated to carry out the hydrotreatment of the feed oil except that the flow direction of the feed oil was not reversed after 100 days from the start of the reaction. As a result, the reaction temperature was 405° C. after 150 days from the start of the reaction.

Comparative Example 4

The procedure in Example 12 was repeated to carry out the hydrotreatment of the feed oil except that the flow direction of the feed oil was not reversed after 100 days from the start of the reaction. As a result, the reaction temperature was 414° C. after 150 days from the start of the reaction.

Comparative Example 5

The procedure in Example 13 was repeated to carry out the hydrotreatment of the feed oil except that the flow direction of the feed oil was not reversed after 100 days from the start of the reaction. As a result, the reaction temperature was 416° C. after 150 days from the start of the reaction.

TABLE 7

| | Catalyst (wt. %) | A | B | C | D |
|---|---|---|---|---|---|
| Composition | Nickel oxide | 2.5 | 3.7 | 3.7 | 4.0 |
| | Molybdenum oxide | 8.0 | 12.1 | 12.0 | 15.0 |
| | Alumina | 89.5 | 84.2 | 79.0 | 73.0 |
| | Phosphorus | — | — | 5.3 | — |
| | Boria | — | — | — | 8.0 |
| Physical properties | Specific surface area (m$^2$/g) | 200 | 200 | 230 | 230 |
| | Pore volume (mL/g) | 0.60 | 0.53 | 0.64 | 0.71 |
| | Average pore diameter (Å) | 118 | 110 | 95 | 100 |
| | Proportion of pore volume for each pore size range to total pore volume (%) | | | | |
| | 80 to 200 Å | 70.4 | — | — | — |
| | 200 to 800 Å | 9.1 | — | — | — |
| | 800 Å < | 15.0 | — | — | — |
| | 70 to 150 Å | — | 88.6 | 86.5 | 85.0 |
| | 150 Å < | — | 7.2 | 8.0 | 7.3 |

EXAMPLE 16

There was used, as the feed oil, an Arabian heavy crude oil which had been desalted and from which naphtha fraction (C5 to 157° C.) had been removed. The properties of the feed oil are as follows.

| Feed oil A | | |
|---|---|---|
| Density (15° C.) | 0.9319 | g/cm$^3$ |
| Sulfur | 3.24% | by weight |
| Nitrogen | 1500 | ppm by weight |
| Vanadium | 55 | ppm by weight |
| Nickel | 18 | ppm by weight |
| Iron | 1.5 | ppm by weight |
| Asphaltene | 9.9% | by weight |
| Kerosene fraction (>157° C., ≦239° C.) | 9.8% | by weight |
| Gas oil fraction (>239° C., ≦370° C.) | 25.8% | by weight |
| Residue (>370° C.) | 64.4% | by weight |

As shown in FIG. 4, the aforesaid feed oil was subjected to hydrotreatment under the reaction conditions as given in Table 9, based on the assumption of the process using a hydrorefining unit comprising, in combination, a countercurrent moving bed reactor to which the catalyst A is fed as the first stage, and a fixed bed reactor packed inside with the catalyst B containing boron as the second stage. In practice, the countercurrent moving bed reactor as the first stage was composed of a plurality of fixed bed reactors (250 mL) as shown in FIG. 5 in parallel packed inside with the catalyst A as shown in Table 8, and was operated so as to maintain the activity of the catalyst A at a level almost equal to the catalytic activity of the countercurrent moving bed by changing one reactor to other one every 7 to 10 days. The fixed bed reactor (1000 mL) as the second stage was packed inside with the desulfurization catalyst B (average pore diameter of 100 Å) as shown in Table 8. The product oil was accumulated for a period of 2 to 3 months so that the average chemical composition thereof can simulatedly express the chemical composition of the product petroleum which is obtained from the actual reaction system as illustrated in FIG. 4. Subsequently, the hydrotreated petroleum thus obtained was fractionated by means of distillation in an atmospheric distillation tower into naphtha fraction (C5 to ≦157° C. boiling range), kerosene fraction (>157° C. to ≦239° C. boiling range), gas oil fraction (≧239° C. to ≦370° C. boiling range) and residue (>370° C. boiling range), and evaluations were made of the properties of the fractions thus obtained.

In addition, storage stability tests were made of the kerosene fraction and the gas oil fraction by a specific method in which 400 mL of sample was placed in a 500 mL glass vessel with a vent, which was stored in a dark place kept at 43° C. for 30 days, and the results before and after the storage stability test were evaluated. The results are given in Tables 10 and 11.

It can be seen from Tables 10 & 11 that high-quality kerosene and gas oil each having stabilized hue on storage and minimized in the contents of metallic components and nitrogen components can be produced from the residue formed by removing naphtha fraction from desalted Arabian heavy crude oil by virtue of using the above-mentioned catalyst containing boron as an effective ingredient.

EXAMPLE 17

There was used, as the feed oil, an Arabian light crude oil which had been desalted. The properties of the feed oil are as follows.

| Feed oil B | |
|---|---|
| Density (15° C.) | 0.8639 g/cm$^3$ |
| Sulfur | 1.93% by weight |
| Nitrogen | 850 ppm by weight |
| Vanadium | 18 ppm by weight |
| Nickel | 5 ppm by weight |
| Iron | 7.0 ppm by weight |
| Asphaltene | 3.8% by weight |
| Naphtha fraction (C5 to 157° C.) | 14.7% by weight |
| Kerosene fraction (>157° C., ≦239° C.) | 14.2% by weight |
| Gas oil fraction (>239° C., ≦370° C.) | 25.6% by weight |
| Residue (>370° C.) | 45.5% by weight |

The procedure in Example 16 was repeated to carry out the hydrotreatment of the feed oil except that the hydrotreatment thereof was performed under the reaction conditions given in Table 9 by using a fixed bed reactor in the second stage packed inside with the desulfurization catalyst C containing a phosphorus component.

The hydrotreated petroleum thus obtained was fractionated in the same manner as in Example 16, and evaluations were made of the properties of the fractions thus obtained. The results are given in Table 10. In addition, storage stability tests were made of the kerosene fraction and gas oil fraction in the same manner as in Example 16. The results are given in Table 11.

It can be seen from Tables 10 & 11 that high quality kerosene and gas oil each having stabilized hue on storage and minimized in the contents of metallic components and nitrogen components can be produced from Arabian heavy crude oil which had been desalted, by virtue of using the above catalyst containing phosphorus as an effective ingredient.

EXAMPLE 18

The procedure in Example 16 was repeated to carry out the hydrotreatment of the feed oil except that iron-containing aluminosilicate catalyst D was used in the second stage fixed bed reactor, and the reaction conditions as given in Table 9 were applied.

The hydrotreated petroleum thus obtained was fractionated in the same manner as in Example 16, and evaluations were made of the properties of the fractions thus obtained. The results are given in Table 10. In addition, storage stability tests were made of the kerosene fraction and gas oil fraction in the same manner as in Example 16. The results are given in Table 11.

It can be seen from Tables 10 & 11 that high quality kerosene and gas oil each having stabilized hue on storage and markedly improved in smoke point and cetane index can be produced in increased quantity from Arabian heavy crude oil which had been desalted and from which naphtha fraction had been removed by virtue of using the above catalyst.

Comparative Example 6

The procedure in Example 17 was repeated to carry out the hydrotreatment of the feed oil except that desulfurization catalyst E was used in the second stage fixed bed reactor.

The hydrotreated petroleum thus obtained was fractionated in the same manner as in Example 16, and evaluations were made of the properties of the fractions thus obtained. The results are given in Table 10. In addition, storage stability tests were made of the kerosene fraction and gas oil fraction in the same manner as in Example 16. The results are given in Table 11.

It can be seen from Tables 10 & 11 that the kerosene and gas oil obtained from Arabian heavy crude oil which had been desalted without the addition of the third component such as phosphorus, boron or the like are unsatisfactory in quality, in every respects to metal content, hue, smoke point and cetane index as compared with the kerosene or gas oil produced by the use of the desulfurization catalyst incorporated with any of the third components.

Comparative Example 7

The procedure in Example 16 was repeated to carry out the hydrotreatment of the feed oil except that desulfurization catalyst E was used in the second stage fixed bed reactor.

The hydrotreated petroleum thus obtained was fractionated in the same manner as in Example 16, and evaluations were made of the properties of the fractions thus obtained. The results are given in Table 10. In addition, storage stability tests were made of the kerosene fraction and gas oil fraction in the same manner as in Example 16. The results are given in Table 11.

It can be seen from Tables 10 & 11, that the kerosene and gas oil obtained from Arabian heavy crude oil which had been desalted without the addition of a third component such as phosphorus, boron or the like are unsatisfactory in quality, in every respects to metal content, hue, smoke point and cetane index as compared with the kerosene or gas oil produced by the use of the desulfurization catalyst incorporated with any of the third components.

TABLE 8

| Catalyst (wt. %) | A | B | C | D | E |
|---|---|---|---|---|---|
| Composition | | | | | |
| $Al_2O_3$ | 89.5 | 73.0 | 75.4 | 29.2 | 80.8 |
| $B_2O_3$ | — | 8.0 | — | — | — |
| $P_2O_5$ | — | — | 0.7 | — | — |

TABLE 8-continued

| Catalyst (wt. %) | A | B | C | D | E |
|---|---|---|---|---|---|
| $SiO_2$ | — | — | — | 50.9 | — |
| CoO | — | 4.0 | 2.8 | 5.6 | — |
| NiO | 3.0 | — | — | — | 4.7 |
| $Fe_2O_3$ | — | — | — | 2.6 | — |
| $MoO_3$ | 4.5 | 15.0 | 11.6 | 11.7 | 14.5 |
| Physical properties | | | | | |
| Specific surface area ($m^2/g$) | 220 | 230 | 250 | 445 | 220 |
| Pore volume (mL/g) | 0.65 | 0.71 | 0.60 | 0.62 | 0.71 |
| Average pore diameter (Å) | 120 | 100 | 100 | 158 | 100 |

TABLE 9

| | Example 16 | Example 17 | Example 18 | Comparative Example 6 | Comparative Example 7 |
|---|---|---|---|---|---|
| Feed oil | A | B | A | B | A |
| 1st stage reaction | | | | | |
| catalyst | catalyst A | catalyst A | catalyst A | catalyst A | catalyst A |
| reaction temperature (° C.) | 400 | 386 | 405 | 386 | 400 |
| hydrogen partial pressure ($kg/cm^2$) | 137 | 117 | 107 | 117 | 137 |
| LHSV ($hr^{-1}$) | 1.3 | 1.6 | 2.1 | 1.6 | 1.3 |
| hydrogen/oil ($Nm^3/KL$) | 488 | 418 | 388 | 418 | 488 |
| 2nd stage reaction | | | | | |
| catalyst | catalyst B | catalyst C | catalyst D | catalyst E | catalyst E |
| reaction temperature (° C.) | 377 | 357 | 382 | 357 | 377 |
| hydrogen partial pressure ($kg/cm^2$) | 143 | 121 | 145 | 121 | 143 |
| LHSV ($hr^{-1}$) | 0.32 | 0.4 | 0.52 | 0.4 | 0.32 |
| hydrogen/oil ($Nm^3/KL$) | 601 | 473 | 630 | 473 | 601 |

TABLE 10

| | Product yield (wt. %) | | Sulfur | Nitrogen | Carbon | Content of |
|---|---|---|---|---|---|---|
| | Feed oil | Product petroleum | content (wt %) | content (wt-ppm) | residue (wt. %) | vanadium and nickel (wt-ppm) |
| Example 16 | | | | | | |
| Naphtha fraction | 0 | 5.0 | 0.003 | 1> | — | — |
| Kerosene fraction | 9.8 | 12.6 | 0.0017 | 4 | — | — |
| Gas oil fraction | 25.8 | 31.3 | 0.01 | 38 | — | — |
| Residue | 64.4 | 46.8 | 0.34 | 880 | 5.9 | 12 + 7 |
| Example 17 | | | | | | |
| Naphtha fraction | 14.7 | 16.0 | 0.002 | 1> | — | — |
| Kerosene fraction | 14.2 | 17.9 | 0.0008 | 2 | — | — |
| Gas oil fraction | 25.6 | 28.6 | 0.02 | 67 | — | — |
| Residue | 45.5 | 31.0 | 0.20 | 720 | 4.0 | 7 + 3 |
| Example 18 | | | | | | |
| Naphtha fraction | 0 | 9.3 | 0.01 | 1> | — | — |
| Kerosene fraction | 9.8 | 21.0 | 0.004 | 6 | — | — |
| Gas oil fraction | 25.8 | 24.3 | 0.03 | 42 | — | — |
| Residue | 64.4 | 37.2 | 0.42 | 1070 | 6.8 | 10 + 6 |
| Comparative Example 6 | | | | | | |
| Naphtha fraction | 14.7 | 14.5 | 0.003 | 1> | — | — |
| Kerosene fraction | 14.2 | 16.8 | 0.001 | 5 | — | — |

TABLE 10-continued

| | Product yield (wt. %) | | Sulfur | Nitrogen | Carbon | Content of |
|---|---|---|---|---|---|---|
| | Feed oil | Product petroleum | content (wt %) | content (wt-ppm) | residue (wt. %) | vanadium and nickel (wt-ppm) |
| Gas oil fraction | 25.6 | 27.2 | 0.03 | 75 | — | — |
| Residue | 45.5 | 33.5 | 0.25 | 1050 | 4.2 | 7 + 3 |
| Comparative Example 7 | | | | | | |
| Naphtha fraction | 0 | 1.0 | 0.006 | 1> | — | — |
| Kerosene fraction | 9.8 | 12.0 | 0.002 | 6 | — | — |
| Gas oil fraction | 25.8 | 29.0 | 0.04 | 43 | — | — |
| Residue | 64.4 | 55.0 | 0.48 | 1100 | 6.1 | 13 + 8 |

TABLE 11

| | Kerosene fraction | | | Gas oil fraction | | |
|---|---|---|---|---|---|---|
| | Hue (Saybolt color) | | Smoke | Hue (ASTM color) | | |
| | Before storage | After storage | point (mm) | Before storage | After storage | Cetane Index |
| Example 16 | +30 | +28 | 24.0 | 0.4 | 0.5 | 60 |
| Example 17 | +30 | +29 | 25.0 | 0.4 | 0.5 | 60 |
| Example 18 | +30 | +28 | 24.0 | 0.5 | 0.6 | 62 |
| Comparative Example 6 | +30 | +25 | 23.5 | 0.6 | 0.8 | 59 |
| Comparative Example 7 | +30 | +24 | 22.5 | 0.6 | 0.9 | 58 |

EXAMPLE 19

There was used, as the feed oil, an Arabian heavy crude oil which had been desalted and from which naphtha fraction (C5 to 157° C.) had been removed. The properties of the feed oil are as follows.

| Feed oil A | |
|---|---|
| Density (15° C.) | 0.9319 g/cm$^3$ |
| Sulfur | 3.24% by weight |
| Nitrogen | 1500 ppm by weight |
| Vanadium | 55 ppm by weight |
| Nickel | 18 ppm by weight |
| Iron | 1.5 ppm by weight |
| Asphaltene | 9.9% by weight |
| Kerosene fraction (>157° C., ≦239° C.) | 9.8% by weight |
| Gas oil fraction (>239° C., ≦370° C.) | 25.8% by weight |
| Residue (>370° C.) | 64.4% by weight |

As shown in FIG. 6, the aforesaid feed oil A was subjected to hydrotreatment under the reaction conditions as given in Table 13, based on the assumption of the process using a hydrorefining unit comprising, in combination, a countercurrent moving bed reactor to which the catalyst A is fed as the first stage, and a fixed bed reactor packed inside with the combination of the catalyst B containing boron with a pore diameter of 80 Å or larger and the catalyst F with a pore diameter of smaller than 80 Å as the second stage. In practice, the countercurrent moving bed reactor as the first stage was composed of a plurality of fixed bed reactors (250 mL) as shown in FIG. 5 in parallel packed inside with the catalyst A as shown in Table 12, and was operated so as to maintain the activity of the catalyst A at a level almost equal to the catalytic activity of the countercurrent moving bed by changing one reactor to other one every 7 to 10 days. The fixed bed reactor (1000 mL) as the second stage was packed inside with the sulfurization catalyst B (average pore diameter of 100 Å) as shown in Table 12 and the catalyst F (average pore diameter of 60 Å) as shown in Table 12 so that the catalyst B comes on the upstream side for the flow of the feed oil. The product petroleum was accumulated for a period of 2 to 3 months so that the average chemical composition thereof can simulatedly express the chemical composition of the product petroleum which is obtained from the actual reaction system as illustrated in FIG. 6. Subsequently, the hydrotreated petroleum thus obtained was fractionated by means of distillation in an atmospheric distillation tower into naphtha fraction (C5 to ≦157° C. boiling range), kerosene fraction (>157° C. to ≦239° C. boiling range), gas oil fraction (≧239° C. to ≦370° C. boiling range) and residue (>370° C. boiling range), and evaluations were made of the properties of the fractions thus obtained.

In addition, storage stability tests were made of the kerosene fraction and the gas oil fraction by a specific method in which 400 mL of sample was placed in a 500 mL glass vessel with a vent, which was stored in a dark place kept at 43° C. for 30 days, and the results before and after the storage stability test were evaluated. The results are given in Tables 14 and 15.

It can be seen from Tables 14 & 15 that high-quality kerosene and gas oil each having stabilized hue on storage and minimized in the contents of metallic components and nitrogen components can be produced from the residue formed by removing naphtha fraction from desalted Arabian heavy crude oil by virtue of using the combination of the catalyst with a pore diameter of 80 Å or larger and the catalyst with a pore diameter of smaller than 80 Å.

EXAMPLE 20

There was used, as the feed oil, an Arabian heavy crude oil which had been desalted. The properties of the feed oil are as follows.

| | |
|---|---|
| Density (15° C.) | 0.8639 g/cm$^3$ |
| Sulfur | 1.93% by weight |
| Nitrogen | 850 ppm by weight |
| Vanadium | 18 ppm by weight |
| Nickel | 5 ppm by weight |
| Iron | 7.0 ppm by weight |

-continued

| | |
|---|---|
| Asphaltene | 3.8% by weight |
| Naphtha fraction (C5 to 157° C.) | 14.7% by weight |
| Kerosene fraction (>157° C., ≦239° C.) | 14.2% by weight |
| Gas oil fraction (>239° C., ≦370° C.) | 25.6% by weight |
| Residue (>370° C.) | 45.5% by weight |

Subsequently the procedure in Example 19 was repeated to carry out the hydrotreatment of the feed oil except that the foregoing feed oil was hydrotreated under the reaction conditions as given in Table 13 by the use of a fixed bed reactor in the second stage packed inside with the combination of phosphorus-containing catalyst C with 80 Å or larger pore diameter and catalyst G with a smaller pore diameter so that the catalyst C comes on the upstream side for the flow of the feed oil.

The hydrotreated petroleum thus obtained was fractionated in the same manner as in Example 19 and evaluations were made of the properties of the fractions thus obtained. In addition, storage stability tests were made of the kerosene fraction and gas oil fraction in the same manner as in Example 19. The results are given in Tables 14 & 15.

It can be seen from Tables 14 & 15 that high-quality kerosene and gas oil each having stabilized hue on storage can be produced even in the case of collective treatment for crude oil by the combination of the catalyst with 80 Å or larger pore diameter and that with smaller than 80 Å pore diameter.

EXAMPLE 21

The procedure in Example 19 was repeated to carry out the hydrotreatment of the feed oil B except that the feed oil was hydrorefined under the reaction conditions as given in Table 13 by the use of a fixed bed reactor in the second stage packed inside with the combination of boron-containing catalyst D with 80 Å or larger pore diameter and catalyst F with a smaller pore diameter.

The hydrotreated petroleum thus obtained was fractionated in the same manner as in Example 19, and evaluations were made of the properties of the fractions thus obtained. The results are given in Table 14. In addition, storage stability tests were made of the kerosene fraction and gas oil fraction in the same manner as in Example 19. The results are given in Table 15.

It can be seen from Tables 14 & 15 that high quality kerosene and gas oil each having stabilized hue on storage and markedly improved in smoke point and cetane index can be produced in increased quantity by the combination of the boron-containing catalyst with 80 Å or larger pore diameter and the catalyst with smaller than 80 Å pore diameter.

EXAMPLE 22

The procedure in Example 19 was repeated to carry out the hydrotreatment of the feed oil A except that the feed oil was hydrorefined under the reaction conditions as given in Table 13 by the use of a fixed bed reactor in the second stage packed inside with the combination of catalyst E with 80 Å or larger pore diameter and catalyst G with a smaller pore diameter.

The hydrotreated petroleum thus obtained was fractionated in the same manner as in Example 19, and evaluations were made of the properties of the fractions thus obtained. The results are given in Table 14. In addition, storage stability tests were made of the kerosene fraction and gas oil fraction in the same manner as in Example 19. The results are given in Table 15.

It can be seen from Tables 14 & 15 that high quality kerosene and gas oil each having stabilized hue on storage and markedly improved in smoke point and cetane index can be produced in increased quantity from residual oil formed by removing naphtha fraction from crude oil by the combination of the iron-containing aluminosilicate catalyst with 80 Å or larger pore diameter and the catalyst with smaller than 80 Å pore diameter.

EXAMPLE 23

The procedure in Example 19 was repeated to carry out the hydrotreatment of the feed oil B except that the feed oil was hydrorefined under the reaction conditions as given in Table 13 by the use of a fixed bed reactor in the second stage packed inside with the combination of catalyst B with 80 Å or larger pore diameter and catalyst F with a smaller pore diameter so that the catalyst F comes on the upstream side for the flow of the feed oil.

The hydrotreated petroleum thus obtained was fractionated in the same manner as in Example 19, and evaluations were made of the properties of the fractions thus obtained. The results are given in Table 14. In addition, storage stability tests were made of the kerosene fraction and gas oil fraction in the same manner as in Example 19. The results are given in Table 15.

It can be seen from Tables 14 & 15 that high quality kerosene and gas oil each with favorable properties and minimized in sulfur content can be produced.

TABLE 12

| Catalyst (wt. %) | A | B | C | D | E | F | G |
|---|---|---|---|---|---|---|---|
| Composition | | | | | | | |
| $Al_2O_3$ | 89.5 | 80.8 | 75.4 | 73.0 | 29.2 | 71.7 | — |
| $B_2O_3$ | — | — | — | 8.0 | — | — | — |
| $P_2O_5$ | — | — | 0.7 | — | — | — | — |
| $SiO_2$ | — | — | — | — | 50.5 | — | 81.2 |
| CoO | — | — | 2.8 | 4.0 | 5.6 | 5.4 | 4.1 |
| NiO | 3.0 | 4.7 | — | — | — | — | — |
| $Fe_2O_3$ | — | — | — | — | 2.6 | — | — |
| $MoO_3$ | 4.5 | 14.5 | 11.6 | 15.0 | 11.7 | 20.8 | 14.7 |
| Physical properties | | | | | | | |
| Specific surface area ($m^2/g$) | 220 | 220 | 250 | 230 | 445 | 250 | 285 |
| Pore volume (mL/g) | 0.65 | 0.71 | 0.60 | 0.71 | 0.62 | 0.38 | 0.33 |

TABLE 12-continued

| Catalyst (wt. %) | A | B | C | D | E | F | G |
|---|---|---|---|---|---|---|---|
| Average pore diameter (Å) | 120 | 100 | 100 | 100 | 158 | 60 | 20 |

TABLE 13

| | Example 19 | Example 20 | Example 21 | Example 22 | Example 23 |
|---|---|---|---|---|---|
| Feed oil | A | B | B | A | B |
| 1st stage reaction | | | | | |
| catalyst | catalyst A | catalyst A | catalyst A | catalyst A | catalyst A |
| reaction temperature (° C.) | 400 | 386 | 381 | 405 | 385 |
| hydrogen partial pressure (kg/cm$^2$) | 137 | 117 | 107 | 107 | 112 |
| LHSV (hr$^{-1}$) | 1.3 | 1.6 | 2.1 | 2.1 | 2.0 |
| hydrogen/oil (Nm$^3$/KL) | 488 | 418 | 388 | 388 | 393 |
| 2nd stage reaction | | | | | |
| catalyst (upper zone/lower zone) | B/F | C/G | D/F | E/G | F/B |
| packing ratio | 72/28 | 65/35 | 79/21 | 56/44 | 50/50 |
| reaction temperature (° C.) | 377 | 357 | 362 | 382 | 365 |
| hydrogen partial pressure (kg/cm$^2$) | 143 | 121 | 145 | 145 | 122 |
| LHSV (hr$^{-1}$) | 0.32 | 0.4 | 0.52 | 0.52 | 0.47 |
| hydrogen/oil (Nm$^3$/KL) | 601 | 473 | 630 | 630 | 580 |

TABLE 14

| | Product yield (wt. %) | | Sulfur | Nitrogen | Carbon | Content of |
|---|---|---|---|---|---|---|
| | Feed oil | Product petroleum | content (wt %) | content (wt-ppm) | residue (wt. %) | vanadium and nickel (wt-ppm) |
| Example 19 | | | | | | |
| Naphtha fraction | 0 | 5.0 | 0.003 | 1> | — | — |
| Kerosene fraction | 9.8 | 12.6 | 0.0017 | 4 | — | — |
| Gas oil fraction | 25.8 | 31.3 | 0.01 | 38 | — | — |
| Residue | 64.4 | 46.8 | 0.34 | 880 | 5.9 | 12 + 7 |
| Example 20 | | | | | | |
| Naphtha fraction | 14.7 | 16.0 | 0.002 | 1> | — | — |
| Kerosene fraction | 14.2 | 17.9 | 0.0008 | 2 | — | — |
| Gas oil fraction | 25.6 | 28.6 | 0.02 | 67 | — | — |
| Residue | 45.5 | 31.0 | 0.20 | 720 | 4.0 | 7 + 3 |
| Example 21 | | | | | | |
| Naphtha fraction | 14.7 | 15.8 | 0.001 | 1> | — | — |
| Kerosene fraction | 14.2 | 17.5 | 0.0007 | 2 | — | — |
| Gas oil fraction | 25.6 | 28.0 | 0.008 | 64 | — | — |
| Residue | 45.5 | 32.1 | 0.20 | 650 | 4.0 | 7 + 4 |
| Example 22 | | | | | | |
| Naphtha fraction | 0 | 9.1 | 0.01 | 1> | — | — |
| Kerosene fraction | 9.8 | 20.8 | 0.004 | 6 | — | — |
| Gas oil fraction | 25.8 | 23.3 | 0.03 | 42 | — | — |
| Residue | 64.4 | 38.0 | 0.42 | 870 | 6.6 | 11 + 7 |
| Example 23 | | | | | | |
| Naphtha fraction | 14.7 | 15.7 | 0.001 | 1> | — | — |
| Kerosene fraction | 14.2 | 17.3 | 0.0006 | 2 | — | — |
| Gas oil fraction | 25.6 | 27.5 | 0.006 | 62 | — | — |
| Residue | 45.5 | 33.0 | 0.18 | 640 | 4.0 | 7 + 3 |

TABLE 15

| | Kerosene fraction | | | Gas oil fraction | | |
|---|---|---|---|---|---|---|
| | Hue (Saybolt color) | | Smoke | Hue (ASTM color) | | |
| | Before storage | After storage | point (mm) | Before storage | After storage | Cetane Index |
| Example 19 | +30 | +28 | 24.0 | 0.4 | 0.5 | 60 |
| Example 20 | +30 | +29 | 25.0 | 0.4 | 0.5 | 60 |
| Example 21 | +30 | +29 | 28.0 | 0.4 | 0.4 | 62 |
| Example 22 | +30 | +29 | 24.0 | 0.5 | 0.6 | 62 |
| Example 23 | +30 | +29 | 27.5 | 0.4 | 0.4 | 63 |

EXAMPLE 24

There was used, as the feed oil, an Arabian heavy crude oil which had been desalted and from which naphtha fraction (C5 to 157° C.) had been removed. The properties of the feed oil are as follows.

| Feed oil A | |
|---|---|
| Density (15° C.) | 0.9319 g/cm$^3$ |
| Sulfur | 3.24% by weight |
| Nitrogen | 1500 ppm by weight |
| Vanadium | 55 ppm by weight |
| Nickel | 18 ppm by weight |
| Kerosene fraction (>157° C., ≦239° C.) | 9.8% by weight |
| Gas oil fraction (>239° C., ≦370° C.) | 25.8% by weight |
| Residue (>370° C.) | 64.4% by weight |

Then the catalyst composition consisting of 20% by volume of the catalyst A and 80% by volume of the catalyst B which catalysts are shown in Table 16 was packed in that order in a 1000 milliliter (mL) tubular reactor. Subsequently the feed oil was subject to hydrotreatment by passing itself through the reactor under the reaction conditions including a hydrogen partial pressure of 130 kg/cm$^2$, a hydrogen/oil ratio of 800 Nm$^3$/KL, a reaction temperature of 380° C. and an LHSV of 0.4 hr$^{-1}$.

The hydrotreated petroleum thus obtained was fractionated into naphtha fraction (C5 to ≦157° C. boiling range), kerosene fraction (>157° C. to ≦239° C. boiling range), gas oil fraction (≧239° C. to ≦370° C. boiling range) and residue (>370° C. boiling range). As a result, the yields of naphtha fraction, kerosene fraction, gas oil fraction and residue fraction were 1.2%, 12.5%, 28.9% and 55.2% each by weight, respectively.

Subsequently, the kerosene fraction was subjected to hydrotreatment under the reaction conditions including a hydrogen partial pressure of 130 kg/cm$^2$, a hydrogen/oil ratio of 800 Nm$^3$/KL, a reaction temperature of 380° C. and an LHSV of 2.5 hr$^{-1}$, by pass itself through a tubular reactor packed inside with the hydrogenation catalyst C as shown in Table 16. The properties of the hydrotreated kerosene fraction are given in Table 17.

It can be seen that the kerosene which is excellent in quality, minimized in the contents of sulfur and nitrogen and improved in smoke point can be obtained by hydrotreating distilled kerosene fraction.

EXAMPLE 25

The procedure in Example 24 was repeated to carry out hydrorefining treatment except that the feed oil was altered to a desalted Arabian heavy crude oil. The properties of the kerosene fraction obtained by distillation are given in Table 17.

It can be seen that the kerosene which is excellent in quality, minimized in the contents of metals and nitrogen and improved in smoke point can be obtained by the hydrotreating distilled kerosene fraction.

TABLE 16

| | Catalyst (wt. %) | A | B | C |
|---|---|---|---|---|
| Composition | $Al_2O_3$ | 89.5 | 79.9 | 62.4 |
| | $B_2O_3$ | — | — | 7.7 |
| | $P_2O_5$ | — | 4.5 | — |
| | $SiO_2$ | — | — | — |
| | CoO | — | — | — |
| | NiO | 2.5 | 3.7 | 4.4 |
| | $Fe_2O_3$ | — | — | — |
| | $MoO_3$ | 8.0 | 11.9 | — |
| | $WO_3$ | — | — | 25.6 |
| Physical properties | Specific surface area (m$^2$/g) | 200 | 202.0 | 276.8 |
| | Pore volume (mL/g) | 0.6 | 0.56 | 0.92 |
| | Average pore diameter (Å) | 118 | 55.97 | 66.99 |

TABLE 17

| | Smoke point (mm) | Nitrogen content (ppm) | Sulfur content (ppm) | Density 15° C. (g/cm$^3$) |
|---|---|---|---|---|
| Example 24 | 39.0 | ≦1 | less than 1 | 0.7877 |
| Example 25 | 34.5 | ≦1 | 38 | 0.7990 |

EXAMPLE 26

There was used, as the feed oil, an Arabian heavy crude oil which had been desalted and from which naphtha fraction (C5 to 157° C.) had been removed. The properties of the feed oil are as follows.

| Feed oil A | |
|---|---|
| Density (15° C.) | 0.9319 g/cm$^3$ |
| Sulfur | 3.24% by weight |
| Nitrogen | 1500 ppm by weight |
| Vanadium | 55 ppm by weight |
| Nickel | 18 ppm by weight |
| Kerosene fraction (>157° C., ≦239° C.) | 9.8% by weight |
| Gas oil fraction (>239° C., ≦370° C.) | 25.8% by weight |
| Residue (>370° C.) | 64.4% by weight |

Then the catalyst A (demetallization catalyst) as shown in Table 18 was packed in a 200 milliliter (mL) tubular reactor. Subsequently the feed oil was subject to hydrotreatment by passing itself through the reactor under the reaction conditions including a hydrogen partial pressure of 130 kg/cm$^2$, a hydrogen/oil ratio of 800 Nm$^3$/KL, a reaction temperature of 380° C. and an LHSV of 2.0 hr$^{-1}$.

The hydrotreated petroleum thus obtained was separated into gaseous components A1 and liquid components B1 in a high-pressure separating vessel. Subsequently the gaseous components A1 were hydrotreated in a tubular reactor packed inside with the hydrogenation catalyst B as shown in Table 18 under the reaction conditions including a hydrogen partial pressure of 130 kg/cm$^2$, a hydrogen/oil ratio of 800 Nm$^3$/KL, a reaction temperature of 380° C. and an LHSV of 2.0 hr$^{-1}$, to produce gaseous components A2. Further, the liquid components B1 were hydrotreated in a tubular reactor packed inside with the desulfurization catalyst C as shown in Table 18 under the reaction conditions including a hydrogen partial pressure of 130 kg/cm$^2$, a hydrogen/oil ratio of 800 Nm$^3$/KL, a reaction temperature of 380° C. and an LHSV of 0.5 hr$^{-1}$, to produce liquid components B2.

Thereafter the gaseous components A2 and the liquid components B2 were mixed and the resultant mixture was fractionated into naphtha fraction (C5 to ≦157° C. boiling range), kerosene fraction (>157° C. to ≦239° C. boiling range), gas oil fraction (≧239° C. to ≦370° C. boiling range) and residue (>370° C. boiling range), and evaluations were made of the properties of the fractions thus obtained. The results are given in Table 19.

It can be seen that the kerosene which is excellent in quality, minimized in sulfur content and improved in smoke point can be obtained by individually hydrotreating the gaseous components and liquid components thus separated.

EXAMPLE 27

The procedure in Example 26 was repeated to carry out hydrotreatment except that the feed oil was altered to a desalted Arabian heavy crude oil. The resultant hydrotreated oil was fractionated to obtain the kerosene fraction whose properties are given in Table 19.

It can be seen that the kerosene fraction excellent in quality and improved in smoke point can be obtained by individually hydrotreating the gaseous components and liquid components thus separated.

TABLE 18

| | Catalyst (wt. %) | A | B | C |
|---|---|---|---|---|
| Composition | $Al_2O_3$ | 89.5 | 62.4 | 79.9 |
| | $B_2O_3$ | — | 7.7 | — |
| | $P_2O_5$ | — | — | 4.5 |
| | $SiO_2$ | — | — | — |
| | CoO | — | — | — |
| | NiO | 2.5 | 4.4 | 3.7 |
| | $Fe_2O_3$ | — | — | — |
| | $MoO_3$ | 8.0 | — | 11.9 |
| | $WO_3$ | — | 25.6 | — |
| Physical properties | Specific surface area (m$^2$/g) | 200 | 276.8 | 202.0 |
| | Pore volume (mL/g) | 0.6 | 0.93 | 0.56 |
| | Average pore diameter (Å) | 118 | 66.99 | 55.97 |

TABLE 19

| | Smoke point (mm) | Nitrogen content (ppm) | Sulfur content (ppm) |
|---|---|---|---|
| Example 26 | 39.0 | ≦1 | 4 |
| Example 27 | 34.0 | ≦1 | 4 |

EXAMPLE 28

There was used, as the feed oil, an Arabian heavy crude oil which had been desalted and from which naphtha fraction (C5 to 157° C.) had been removed. The properties of the feed oil are as follows.

| Feed oil A | |
|---|---|
| Density (15° C.) | 0.9319 g/cm$^3$ |
| Sulfur | 3.24% by weight |

-continued

| Feed oil A | |
|---|---|
| Nitrogen | 1500 ppm by weight |
| Vanadium | 55 ppm by weight |
| Nickel | 18 ppm by weight |
| Iron | 1.5 ppm by weight |
| Asphaltene | 9.9% by weight |
| Kerosene fraction (>157° C., ≦239° C.) | 9.8% by weight |
| Gas oil fraction (>239° C., ≦370° C.) | 25.8% by weight |
| Residue (>370° C.) | 64.4% by weight |

Figure 8:
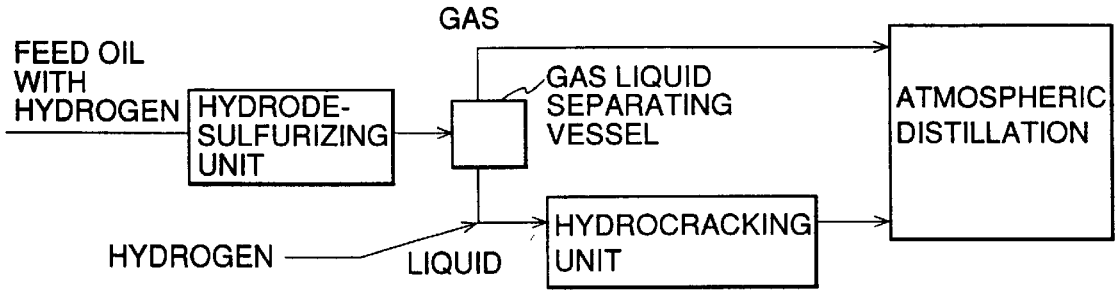
FIG. 8 is a schematic block flow diagram showing the hydrotreating process in Examples 28 & 29.

As illustrated in FIG. 8, the feed oil and hydrogen were fed in a 1000 mL hydrodesulfurizing reactor, where the feed oil was subjected to hydrodesulfurization reaction in the presence of the catalyst A as shown in Table 20. The reaction products were fed in a high-pressure gas-liquid separating vessel, while the temperature and pressure after the reaction were preserved. The reaction liquid thus separated and hydrogen were fed in a 1000 mL hydrocracking unit, where the reaction liquid was subjected to hydrocracking in the presence of the catalyst D as shown in Table 20. The combination of the product oil from the hydrocracking reaction and the gas separated from the separating vessel was subjected to atmospheric distillation.

The reaction conditions in each of the reactors are given in Table 21. The catalyst A as given in Table 20 was prepared by impregnating alumina carrier with the aqueous solution of the components shown in Table 20. The catalyst D as given in Table 20 was prepared by impregnating the mixture of iron-containing type-Y zeolite and alumina as the carrier with the aqueous solution of the metallic salt.

Subsequently, the hydrotreated petroleum thus obtained was fractionated by means of distillation in an atmospheric distillation tower into naphtha (C5 to ≦157° C. boiling range), kerosene fraction (>157° C. to ≦239° C. boiling range), gas oil fraction (≧239° C. to ≦370° C. boiling range) and residue (>370° C. boiling range), and evaluations were made of the properties of the fractions thus obtained.

In addition, storage stability tests were made of the kerosene fraction and the gas oil fraction by a specific method in which 400 mL of sample was placed in a 500 mL glass vessel with a vent, which was stored in a dark place kept at 43° C. for 30 days, and the results before and after the storage stability test were evaluated. The results are given in Tables 22 and 23.

It can be seen from Tables 22 and 23 that there are obtained kerosene and gas oil improved in smoke point and cetane index, respectively, since the intermediate fractions rich in paraffin components are formed by the hydrocracking of residual oil.

EXAMPLE 29

There was used, as the feed oil, an Arabian light crude oil which had been desalted. The properties of the feed oil are as follows.

| Feed oil B | |
|---|---|
| Density (15° C.) | 0.8639 g/cm$^3$ |
| Sulfur | 1.93% by weight |
| Nitrogen | 850 ppm by weight |
| Vanadium | 18 ppm by weight |

-continued

| Feed oil B | |
|---|---|
| Nickel | 5 ppm by weight |
| Iron | 7.0 ppm by weight |
| Asphaltene | 3.8% by weight |
| Naphtha fraction (C5 to 157° C.) | 14.7% by weight |
| Kerosene fraction (>157° C., ≦239° C.) | 14.2% by weight |
| Gas oil fraction (>239° C., ≦370° C.) | 25.6% by weight |
| Residue (>370° C.) | 45.5% by weight |

As illustrated in FIG. 8, the feed oil and hydrogen were fed in a 1000 mL hydrodesulfurizing reactor, where the feed oil was subjected to hydrodesulfurization reaction in the presence of the catalyst C as shown in Table 20. The reaction products were fed in a high-pressure gas-liquid separating vessel, while the temperature and pressure after the reaction were preserved. The reaction liquid thus separated and hydrogen were fed in a 1000 mL hydrocracking unit, where the reaction liquid was subjected to hydrocracking in the presence of the catalyst D as shown in Table 20. The combination of the product oil from the hydrocracking reaction and the gas separated from the separating vessel was subjected to atmospheric distillation.

The reaction conditions in each of the reactors are given in Table 21. The catalyst C as given in Table 20 was prepared by impregnating alumina carrier with the aqueous solution of the components shown in Table 20. The catalyst D as given in Table 20 was prepared by impregnating the mixture of iron-containing type-Y zeolite and alumina as the carrier with the aqueous solution of the metallic salt.

In the same manner as in Example 28, the resultant hydrotreated oil was fractionated into each of the fractions, and evaluations were made of the properties of the fractions thus obtained. In addition, storage stability tests were made of kerosene and gas oil fractions. The results are given in Tables 22 and 23, respectively. It can be seen from the tables that the intermediate fractions having favorable properties comparable to those in Example 28 can be produced in increased quantity even in the case of using desalted Arabian light crude oil as the feed oil.

EXAMPLE 30

Figure 9:
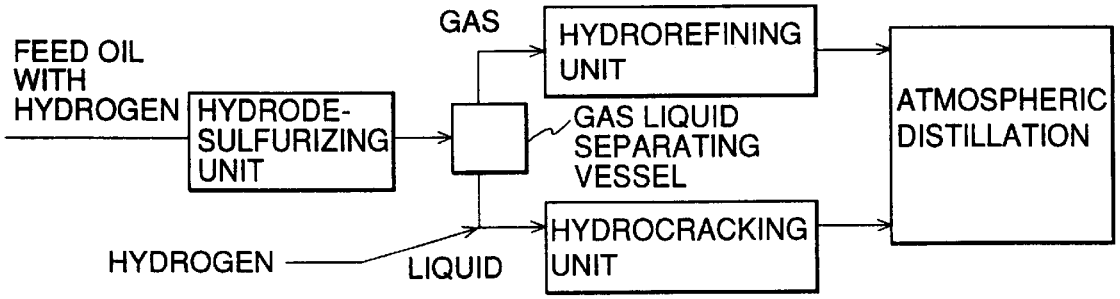
FIG. 9 is a schematic block flow diagram showing the hydrotreating process in Example 30.

As illustrated in FIG. 9, the feed oil B and hydrogen were fed in a 1000 mL hydrodesulfurizing reactor, where the feed oil was subjected to hydrodesulfurization reaction in the presence of the catalyst B as shown in Table 20. The reaction products were fed in a high-pressure gas-liquid separating vessel, while the temperature and pressure after the reaction were preserved. The reaction liquid thus separated and hydrogen were fed in a 1000 mL hydrocracking unit, where the reaction liquid was subjected to hydrocracking in the presence of the catalyst D as shown in Table 20. On the other hand, the gaseous components produced in the high-pressure gas-liquid separating vessel were introduced in a 100 mL hydrorefining reactor to bring the gas into contact with catalyst E. Thereafter the combination of the product oil from the hydrocracking reaction and the gas from the hydrorefining reactor was subjected to atmospheric distillation.

The reaction conditions in each of the reactors are given in Table 21. The catalysts B & E as given in Table 20 were prepared by impregnating alumina carrier with the aqueous solution of the components shown in Table 20. The catalyst D as given in Table 20 was prepared by impregnating the mixture of iron-containing type-Y zeolite and alumina as the carrier with the aqueous solution of the metallic salt.

In the same manner as in Example 28, the resultant hydrotreated oil was fractionated into each of the fractions, and evaluations were made of the properties of the fractions thus obtained. In addition, storage stability tests were made of kerosene and gas oil fractions. The results are given in Tables 22 and 23, respectively. It can be seen from the tables that kerosene and gas oil each having more preferable properties are obtained by hydrorefining treatment.

EXAMPLE 31

Figure 10:
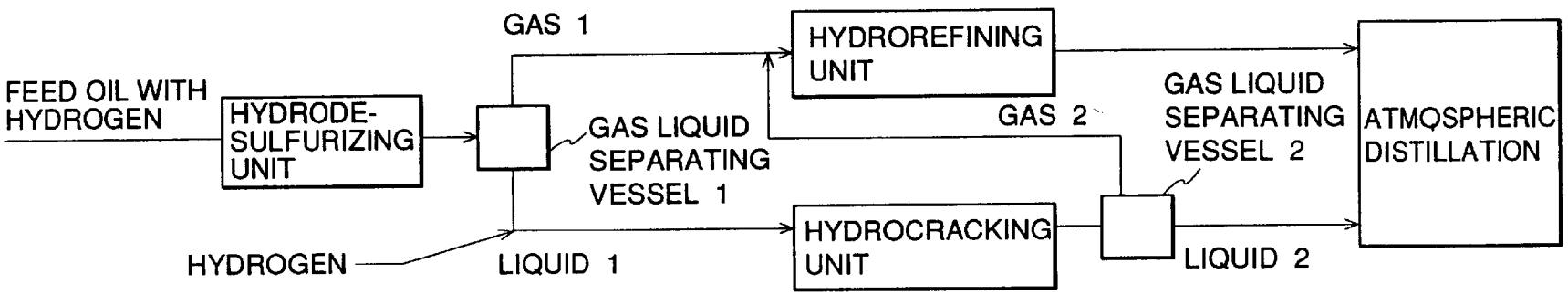
FIG. 10 is a schematic block flow diagram showing the hydrotreating process in Example 31.
Figure 11:
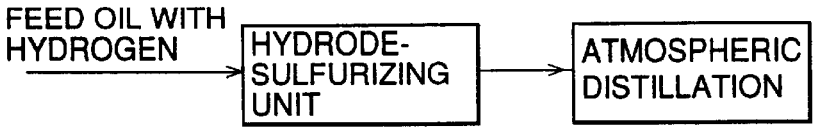
FIG. 11 is a schematic block flow diagram showing the hydrotreating process in Reference Example 8.
Figure 12:
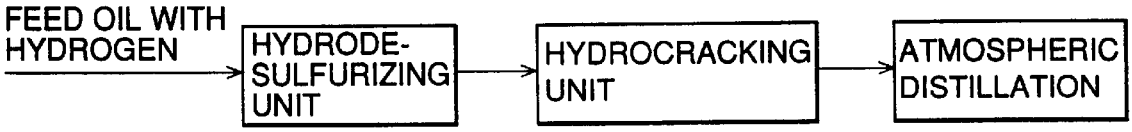
FIG. 12 is a schematic block flow diagram showing the hydrotreating process in Reference Example 9.

As illustrated in FIG. 10, the feed oil A and hydrogen were fed in a 1000 mL hydrodesulfurizing reactor, where the feed oil was subjected to hydrodesulfurization reaction in the presence of the catalyst B as shown in Table 20. The reaction products were fed in a high-pressure gas-liquid separating vessel 1, while the temperature and pressure after the reaction were preserved. The liquid components 1 thus separated and hydrogen were fed in a 1000 mL hydrocracking unit, where the reaction liquid was subjected to hydrocracking in the presence of the catalyst D as shown in Table 20. Further, the effluent from the hydrocracking reaction was separated in a high-pressure gas-liquid separating vessel 2 into liquid components 2 and gaseous components 2, while the temperature and pressure after the reaction were preserved. The gaseous components 1 and 2 obtained in the high-pressure gas-liquid separating vessel 1 and 2, respectively were combined and fed in a 100 mL hydrorefining reactor to bring the gases into contact with catalyst F.

In the same manner as in Example 28, the resultant liquid components 2 and the gaseous components from the hydrorefining were fractionated into each of the fractions, and evaluations were made of the properties of the fractions thus obtained. In addition, storage stability tests were made of kerosene and gas oil fractions. The results are given in Tables 22 and 23, respectively. It can be seen from the tables that both kerosene having favorable smoke point and gas oil having favorable hue are obtained by further hydrorefining the hydrocracked oil.

TABLE 20

| Catalyst (wt. %) | A | B | C | D | E | F |
|---|---|---|---|---|---|---|
| Composition | | | | | | |
| $Al_2O_3$ | 73.0 | 75.4 | 80.8 | 29.2 | 68.2 | — |
| $B_2O_3$ | 8.0 | — | — | — | 7.3 | — |
| $P_2O_5$ | — | 0.7 | — | — | — | — |
| $SiO_2$ | — | — | — | 50.9 | — | 81.2 |
| CoO | 4.0 | 2.8 | — | 5.6 | — | 4.1 |
| NiO | — | — | 4.7 | — | 3.7 | — |
| $Fe_2O_3$ | — | — | — | 2.6 | — | — |
| $MoO_3$ | 15.0 | 11.6 | 14.5 | 11.7 | — | 14.7 |
| $VO_3$ | — | — | — | — | 23.8 | — |
| Physical properties | | | | | | |
| Specific surface area ($m^2/g$) | 250 | 230 | 220 | 445 | 250 | 285 |
| Pore volume (mL/g) | 0.60 | 0.71 | 0.71 | 0.62 | 0.38 | 0.33 |
| Average pore diameter (k) | 100 | 100 | 100 | 158 | 60 | 20 |

TABLE 21

| | Example 28 | Example 29 | Example 30 | Example 31 |
|---|---|---|---|---|
| Feed oil | A | B | B | A |
| Hydrodesulfurizing unit | | | | |
| catalyst | catalyst A | catalyst C | catalyst B | catalyst A |
| reaction temperature (° C.) | 371 | 362 | 361 | 372 |
| hydrogen partial pressure (kg/cm$^2$) | 137 | 117 | 107 | 107 |
| LHSV (hr$^{-1}$) | 0.42 | 0.28 | 0.38 | 0.58 |
| hydrogen/oil (Nm$^3$/KL) | 788 | 618 | 588 | 588 |
| Hydrocracking unit | | | | |
| catalyst | catalyst D | catalyst D | catalyst D | catalyst D |
| reaction temperature (° C.) | 387 | 367 | 362 | 382 |
| hydrogen partial pressure (kg/cm$^2$) | 143 | 121 | 145 | 145 |
| LHSV (hr$^{-1}$) | 0.32 | 0.4 | 0.52 | 0.52 |
| hydrogen/oil (Nm$^3$/KL) | 601 | 523 | 530 | 630 |
| Hydrorefining unit | | | | |
| catalyst | — | — | Catalyst E | Catalyst F |
| reaction temperature (° C.) | — | — | 362 | 382 |
| hydrogen partial pressure (kg/cm$^2$) | — | — | 145 | 145 |
| LHSV (hr$^{-1}$) | — | — | 4.5 | 3.0 |
| hydrogen/oil (Nm$^3$/KL) | — | — | 630 | 630 |

TABLE 22

| | Product yield (wt. %) | | Sulfur | Nitrogen | Carbon | Content of |
|---|---|---|---|---|---|---|
| | Feed oil | Product petroleum | content (wt %) | content (wt-ppm) | residue (wt. %) | vanadium and nickel (wt-ppm) |
| Example 28 | | | | | | |
| Naphtha fraction | 0 | 5.3 | 0.007 | 1> | — | — |
| Kerosene fraction | 9.8 | 15.1 | 0.0017 | 5 | — | — |
| Gas oil fraction | 25.8 | 28.8 | 0.01 | 38 | — | — |
| Residue | 64.4 | 46.8 | 0.34 | 1360 | 7.3 | 12 + 7 |
| Example 29 | | | | | | |
| Naphtha fraction | 14.7 | 16.0 | 0.002 | 1> | — | — |
| Kerosene fraction | 14.2 | 17.5 | 0.001 | 5 | — | — |
| Gas oil fraction | 25.6 | 27.8 | 0.02 | 67 | — | — |
| Residue | 45.5 | 35.1 | 0.23 | 770 | 6.8 | 7 + 3 |
| Example 30 | | | | | | |
| Naphtha fraction | 14.7 | 16.2 | 0.001 | 1> | — | — |
| Kerosene fraction | 14.2 | 17.9 | 0.0007 | 3 | — | — |
| Gas oil fraction | 25.6 | 28.0 | 0.008 | 64 | — | — |
| Residue | 45.5 | 32.1 | 0.20 | 650 | 6.6 | 7 + 3 |
| Example 31 | | | | | | |
| Naphtha fraction | 0 | 6.2 | 0.005 | 1> | — | — |
| Kerosene fraction | 9.8 | 15.8 | 0.004 | 4 | — | — |
| Gas oil fraction | 25.8 | 29.3 | 0.01 | 37 | — | — |
| Residue | 64.4 | 45.3 | 0.31 | 1210 | 6.6 | 11 + 7 |

TABLE 23

| | Kerosene fraction | | | Gas oil fraction | | |
|---|---|---|---|---|---|---|
| | Hue (Saybolt color) | | Smoke | Hue (ASTM color) | | |
| | Before storage | After storage | point (mm) | Before storage | After storage | Cetane Index |
| Example 28 | +30 | +28 | 24.0 | 0.4 | 0.5 | 60 |
| Example 29 | +30 | +29 | 25.0 | 0.4 | 0.5 | 60 |
| Example 30 | +30 | +29 | 26.5 | 0.4 | 0.4 | 62 |
| Example 31 | +30 | +29 | 25.5 | 0.4 | 0.4 | 62 |

EXAMPLE 32

There was used, as the feed oil, an Arabian heavy crude oil which had been desalted and from which naphtha fraction (C5 to 157° C.) had been removed. The properties of the feed oil are as follows.

| | |
|---|---|
| Density (15° C.) | 0.9319 g/cm$^3$ |
| Sulfur | 3.24% by weight |
| Nitrogen | 1500 ppm by weight |
| Vanadium | 55 ppm by weight |
| Nickel | 18 ppm by weight |
| Kerosene fraction (>157° C., ≦239° C.) | 9.8% by weight |
| Gas oil fraction (>239° C., ≦370° C.) | 25.8% by weight |
| Residue (>370° C.) | 64.4% by weight |

Then the catalyst composition consisting of 20% by volume of the catalyst A (demetallization catalyst) and 80% by volume of the catalyst B which catalysts are shown in Table 24 was packed in that order in a 1000 milliliter (mL) tubular reactor. Subsequently, the feed oil was subject to hydrotreatment by passing itself through the reactor under the reaction conditions including a hydrogen partial pressure of 130 kg/cm$^2$, a hydrogen/oil ratio of 800 Nm$^3$/KL, a reaction temperature of 395° C. and an LHSV of 0.4 hr$^{-1}$.

The hydrotreated petroleum obtained after 4000 hours reaction time was fractionated into naphtha fraction (C5 to ≦157° C. boiling range), kerosene fraction (>157° C. to ≦239° C. boiling range), gas oil fraction (≧239° C. to ≦370° C. boiling range) and residue (>370° C. boiling range), and evaluations were made of the properties of the gas oil fractions thus obtained. The results are given in Table 25.

It can be seen that colorless gas oil excellent in hue is obtained from desalted naphtha-fraction-free Arabian heavy crude oil by virtue of using the alumina/boria based catalyst.

The properties of the catalysts A and B are given in Table 24.

EXAMPLE 33

The procedure in Example 32 was repeated to carry out hydrotreatment except that desalted Arabian light crude oil was used as the feed oil and that hydrogen partial pressure and LHSV were altered to 120 kg/cm$^2$ and 0.35 hr$^{-1}$, respectively. The properties of the feed oil are as follows.

| | |
|---|---|
| Density (15° C.) | 0.8639 g/cm$^3$ |
| Sulfur | 1.93% by weight |
| Nitrogen | 850 ppm by weight |
| Vanadium | 18 ppm by weight |
| Nickel | 5 ppm by weight |
| Naphtha fraction (C5 to 157° C.) | 14.7% by weight |
| Kerosene fraction (>157° C., ≦239° C.) | 14.2% by weight |
| Gas oil fraction (>239° C., ≦370° C.) | 25.6% by weight |
| Residue (>370° C.) | 45.5% by weight |

After 4000 hours of operation, the resultant hydrotreated oil was fractionated in the same manner as in Example 32, and evaluations were made of properties of the gas oil fraction. The results are given in Table 25.

It can be seen that colorless gas oil excellent in hue is obtained from desalted Arabian light crude oil by virtue of using the alumina/boria based catalyst.

EXAMPLE 34

The procedure in Example 32 was repeated to carry out the hydrotreatment of the feed oil except that the catalyst C as shown in Table 24 was employed in place of the catalyst B. The results are given in Table 25.

It can be seen that colorless gas oil excellent in hue is obtained from desalted naphtha-fraction-free Arabian heavy crude oil by virtue of using the alumina/boria based catalyst.

EXAMPLE 35

The procedure in Example 32 was repeated to carry out the hydrotreatment of the feed oil except that the catalyst D as shown in Table 24 was employed in place of the catalyst B. The results are given in Table 25.

Comparative Example 8

Hydrodesulfurization was applied to a straight run gas oil obtained by distilling Arabian heavy crude oil with the catalyst B used in Example 32. The properties of the feed oil are as follows.

| | |
|---|---|
| Density (15° C.) | 0.8587 g/cm$^3$ |
| Sulfur | 1.63% by weight |
| Nitrogen | 100 ppm by weight |

The reaction was carried out in a high-pressure fixed-bed tubular reactor of flow system packed inside with the catalyst B in a volume of 100 mL under the reaction conditions including a hydrogen partial pressure of 30 kg/cm$^2$, a hydrogen/oil ratio of 200 Nm$^3$/KL, a reaction temperature of 395° C. and an LHSV of 4 hr$^{-1}$.

After 4000 hours of operation, evaluations were made of the properties of the hydrotreated oil. The results are given in Table 25.

It can be seen therefrom that colorless gas oil with favorable hue can not be produced by hydrotreating straight-run gas oil with an alumina/boria based catalyst alone.

Comparative Example 9

The procedure in Example 32 was repeated to carry out the hydrotreatment of the feed oil except that the catalyst E as shown in Table 24 was employed in place of the catalyst B. The results are given in Table 25.

It can be seen therefrom that colorless gas oil with favorable hue and a sulfur content of about 0.05% by weight or less can not be produced with an alumina carrier alone, and that the hue worsens with a decrease in sulfur content.

TABLE 24

| | Catalyst | Catalyst A | Catalyst B | Catalyst C | Catalyst D | Catalyst E |
|---|---|---|---|---|---|---|
| Carrier | Composition, wt. % based on carrier | | | | | |
| | alumina | 100 | 90 | 94.5 | 95 | 100 |
| | boria | — | 10 | — | — | — |
| | phosphorus | — | — | 5.5 | — | — |
| | silica | — | — | — | 5 | — |
| | boron/phosphorus | | | | | |
| | dispersibility found/theoretical (%) | — | 91.9 | 90.0 | 91.5 | — |
| Active ingredient | Composition, wt. % based on catalyst | | | | | |
| | cobalt oxide | 2.5 | 3.7 | — | — | — |
| | nickel oxide | — | — | 3.7 | 3.7 | 3.7 |
| | molybdenum oxide | 8.0 | 14.0 | 12.0 | 12.1 | 12.1 |
| Specific surface area ($m^2/g$) | | 200 | 228 | 222 | 250 | 220 |
| Pore volume (mL/g) | | 0.60 | 0.71 | 0.64 | 0.60 | 0.60 |
| Average pore diameter (Å) | | 118 | 124 | 104 | 102 | 110 |

TABLE 25

| | Sulfur content (wt %) | Nitrogen content (wt-ppm) | Hue (ASTM color) | Aromatic content (vol %) bi-cyclic | Aromatic content (vol %) tri/poly-cyclic | Transmission factor at 440 nm of extract into DMF (%) |
|---|---|---|---|---|---|---|
| Example 32 | 0.01 | 43 | 0.4 | 3.4 | 0.4 | 86 |
| Example 33 | 0.01 | 35 | 0.3 | 2.8 | 0.2 | 90 |
| Example 34 | 0.01 | 50 | 0.4 | 2.7 | 0.2 | 88 |
| Example 35 | 0.01 | 48 | 0.4 | 2.9 | 0.2 | 87 |
| Comparative Example 8 | 0.02 | 22 | 1.2 | 7.1 | 0.6 | 20 |
| Comparative Example 9 | 0.05 | 130 | 1.0 | 6.7 | 0. 5 | 28 |

The methods for extraction into DMF (dimethylformamide) and determination are as follows.

(1) To 100 mL of fuel oil composition sample (abbreviated to "sample") is added 100 mL of DMF with shaking for 3 minutes in a separatory funnel.

(2) After the complete separation between the sample and DMF, DMF as the lower layer is taken out.

(3) The procedures in steps (1) and (2) are repeated 5 times.

(4) 200 mL of cold water is gently placed in 500 mL of extract in DMF and the mixture is allowed to stand.

(5) Colored substances floating on the surface of the liquid is separated away.

The determination of the colored substances can be made using transmission factor at 440 nm of the visible spectrum by a conventional method.

Industrial Applicability

According to the process for the hydrotreatment of a hydrocarbon oil, it is made possible to efficiently and stably produce high-quality kerosene and gas oil with favorable color tone in an economically advantageous manner by collectively hydrotreating crude oil or crude oil from which naphtha fraction is removed, and besides to prolong the service life of the catalyst, extend the continuous operation period of the process equipment and simplify a petroleum refinery equipment through the use of a specific production process.

What is claimed is:

1. A process for hydrotreating a hydrocarbon oil which comprises hydrotreating crude oil from which the naphtha fraction is optionally removed, in the presence of a catalyst (A) comprising at least one metal selected from the group consisting of the metals each belonging to any of the groups 6, 8, 9 and 10 of the Periodic Table, said metal being supported on at least one carrier selected from the group consisting of alumina/boria carrier and a carrier containing an iron-containing aluminosilicate, wherein the metal content of the catalyst (A) ranges from 1–35% by weight expressed in terms of the oxide thereof; and (B) a demetallization catalyst in combination with catalyst (A), said crude oil containing at most 135 ppm by weight of at least one metallic component selected from the group consisting of vanadium, nickel and iron, and at most 12% by weight of asphaltenes.

2. The process according to claim 1 wherein the metal belonging to any of the groups 6, 8, 9 and 10 of the Periodic Table is tungsten, molybdenum, nickel or cobalt.

3. The process according to claim 1 wherein the demetallization catalyst comprises at least one metal selected from the group consisting of the metals belonging to any of the groups 6, 8, 9 and 10 of the Periodic Table, said metal being supported on an inorganic oxide, an acidic carrier or a natural mineral, said catalyst having an average pore diameter of at least 100 Å.

4. The process according to claim 1 wherein the content of the demetallization catalyst is in the range of 10 to 80% by volume based on the total volume of the catalyst.

5. The process according to claim 1, wherein, in the carrier embodiments for catalyst A, the atomic dispersibility of boron, is not less than 85% of the theoretical dispersibility.

6. The process according to claim 2, wherein, in catalyst A, the catalytically active metal is combinations of metals which are the combinations of nickel-molybdenum, cobalt-molybdenum, nickel-tungsten or nickel-cobalt-molybdenum.

7. The process according to claim 1, wherein, in catalyst A, the carrier is composed of 10–90% by weight of iron-containing aluminosilicate and 90–10% by weight of an inorganic oxide.

8. The process according to claim 7, wherein the carrier is composed of 30–70% by weight of iron-containing aluminosilicate and 70–30% by weight of an inorganic oxide.

9. The process according to claim 7, wherein the iron-containing aluminosilicate is iron metal-containing aluminosilicate of the formula:

$$aFe_2O_3.Al_2O_3.bSiO_2.nH_2O$$

wherein n ranges from 0–30, $15<b<100$, and $0.005<a/b<0.15$.

10. The process according to claim 9, wherein the iron-containing aluminosilicate has an $[Fe]_{dep}$ value of at most 35% and a reduction peak temperature at the higher temperature portion Th within the range:

$$700^\circ\ C. \leqq Th \leqq (-300 \times UD + 8320)^\circ\ C.$$

wherein UD is the lattice constant (Å) of the iron-containing aluminosilicate.

* * * * *